US010025268B2

(12) United States Patent
Makiguchi et al.

(10) Patent No.: US 10,025,268 B2
(45) Date of Patent: Jul. 17, 2018

(54) IMAGE FORMING APPARATUS MAIN BODY AND IMAGE FORMING SYSTEM USING AN ELECTROPHOTOGRAPHIC IMAGE FORMING PROCESS TO FORM AN IMAGE ON A MEDIUM

(71) Applicant: CANON KABUSHIKI KAISHA, Tokyo (JP)

(72) Inventors: Daisuke Makiguchi, Izunokuni (JP); Masato Tanabe, Susono (JP); Hiroki Shimizu, Suntou-gun (JP); Takahito Ueno, Mishima (JP); Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/128,086

(22) PCT Filed: Mar. 17, 2015

(86) PCT No.: PCT/JP2015/001485
§ 371 (c)(1),
(2) Date: Sep. 21, 2016

(87) PCT Pub. No.: WO2015/146074
PCT Pub. Date: Oct. 1, 2015

(65) Prior Publication Data

US 2017/0102669 A1 Apr. 13, 2017

(30) Foreign Application Priority Data

Mar. 24, 2014 (JP) ..... 2014-060768

(51) Int. Cl.
*G03G 21/18* (2006.01)

(52) U.S. Cl.
CPC ..... *G03G 21/1842* (2013.01)

(58) Field of Classification Search
CPC ..... G03G 21/1842; G03G 21/1875; G03G 21/1892; G03G 21/1896
(Continued)

(56) References Cited

U.S. PATENT DOCUMENTS 5,907,751 A * 5/1999 Kawaguchi et al. ..... G03G 21/1853 399/111
2012/0148294 A1 6/2012 Akutsu et al.

FOREIGN PATENT DOCUMENTS

JP 2001235935 A 8/2001
JP 2004012562 A 1/2004
(Continued)

*Primary Examiner* — William J Royer
(74) *Attorney, Agent, or Firm* — Canon U.S.A., Inc. IP Division

(57) ABSTRACT

A main body includes a second movable member that is movable and that has a first recess portion. The second movable member is moved from a first position where a first projecting portion of a first cartridge can enter the first recess portion to a second position by a movement of the first projecting portion, thereby allowing a second cartridge to be moved to an attachment position of the main body. The second movable member also allows a third projecting portion of the second cartridge to enter the first recess portion at the first position. The second movable member is moved to the second position when the third projecting portion enters the first recess portion, thereby allowing the second cartridge to be moved to the attachment position.

54 Claims, 35 Drawing Sheets

(58) Field of Classification Search
USPC ..... 399/12, 111
See application file for complete search history.

(56) References Cited

FOREIGN PATENT DOCUMENTS

| | | | |
|---|---|---|---|
| JP | 2014178398 | A | 9/2014 |
| WO | 2014142353 | A1 | 9/2014 |

* cited by examiner

IMAGE FORMING APPARATUS MAIN BODY AND IMAGE FORMING SYSTEM USING AN ELECTROPHOTOGRAPHIC IMAGE FORMING PROCESS TO FORM AN IMAGE ON A MEDIUM

TECHNICAL FIELD

The present invention relates to a main body of an electrophotographic image forming apparatus and an image forming system. The electrophotographic image forming apparatus herein (referred to as the image forming apparatus hereafter) forms an image on a recording material (recording medium) by using an electrophotographic image forming process. Examples of the image forming apparatus include apparatuses and machines such as a printer (a laser beam printer, an LED printer, and the like), a copier, a facsimile machine, a word processor, and a multifunction machine (multifunction printer) having the functions of these apparatuses and machines.

BACKGROUND ART

In the related-art, a process cartridge method is adopted for an image forming apparatus using the electrophotographic image forming process. With the process cartridge method, a cartridge can be attached to and removed from an apparatus main body of the image forming apparatus. In this process cartridge method, an electrophotographic photosensitive drum and process devices that perform operations on the electrophotographic photosensitive drum are integrally assembled into a cartridge. Thus, maintenance of the image forming apparatus can be simplified and performed by a user himself or herself.

However, with the image forming apparatus using such a process cartridge method, not only a cartridge having functions matching the image forming apparatus but also a cartridge not having functions matching the image forming apparatus may be attached. As a structure for addressing this problem, the following method has been proposed: that is, when a cartridge not matching to an image forming apparatus main body is inserted, a cam portion for opening/closing a shutter is brought into engagement with a wrong-cartridge-insertion block engagement portion at an opening of the apparatus main body so as to open a shutter, thereby blocking insertion of a wrong cartridge (for example, PTL 1)

CITATION LIST

Patent Literature

[PTL 1]
Japanese Patent Laid-Open No. 2004-012562

SUMMARY OF INVENTION

Solution to Problem

With the above-described structure, only a single type of cartridge can be attached to a single type of image forming apparatus main body. Meanwhile, there exists a need for a structure that also allows a cartridge having a new function added thereto to be attached to a single type of image forming apparatus main body. Thus, a structure is desired, with which a cartridge matching to the image forming apparatus main body such as a cartridge having a new function added thereto can be attached to the image forming apparatus main body and a wrong cartridge that does not match to the image forming apparatus main body is prevented from being attached to the image forming apparatus main body. Furthermore, it is required that the types of cartridges be easily recognizable by the user because the types of cartridges that can be attached to a single type of image forming apparatus main body increase.

Furthermore, although it is desired that insertion of a plurality of cartridges having new functions added thereto be allowed, it is required that the size of a space in which a structure preventing a wrong cartridge from being attached be reduced due to restrictions of the sizes of the cartridges.

According to an aspect of the present invention, an image forming apparatus main body allows a first cartridge and a second cartridge to be inserted thereinto. The first cartridge includes a first projecting portion and a second projecting portion, the second cartridge includes a third projecting portion, which has a shape different from that of the first projecting portion, and a fourth projecting portion. The image forming apparatus main body includes a movable member that has a first recess portion and that is movable. In the image forming apparatus main body, during attachment of the first cartridge to the image forming apparatus main body, the movable member is moved from a first position where the first projecting portion is allowed to enter the first recess portion to a second position by a movement of the first projecting portion in the first recess portion toward a downstream side in an insertion direction of the first cartridge, and allows the second projecting portion to pass through an upstream side of the movable member in a movement direction in which the movable member is moved from the first position to the second position so as to allow the first cartridge to be moved to the attachment position of the image forming apparatus main body. In the image forming apparatus main body, during attachment of the second cartridge to the image forming apparatus main body, the movable member at the first position allows the third projecting portion to enter the first recess portion, and, when the third projecting portion enters the first recess portion, the movable member at the second position allows the fourth projecting portion to pass through the upstream side of the first recess portion in the movement direction so as to allow the second cartridge to be moved to the attachment position of the image forming apparatus main body.

According to another aspect of the present invention, an image forming system includes a first cartridge that includes a first projecting portion and a second projecting portion. The image forming system also includes a second cartridge that includes a third projecting portion, which has a shape different from that of the first projecting portion, and a fourth projecting portion. The image forming system also includes a first image forming apparatus main body that allows the first cartridge and the second cartridge to be inserted thereinto. In the image forming system, the first image forming apparatus main body includes a first movable member that has a first recess portion and that is movable. In the image forming system, during attachment of the first cartridge to the first image forming apparatus main body, the first movable member is moved from a first position where the first projecting portion is allowed to enter the first recess portion to a second position by a movement of the first projecting portion in the first recess portion toward a downstream side in an insertion direction of the first cartridge, thereby allowing the second projecting portion to pass through an upstream side of the first movable member in a movement direction in which the first movable member is moved from the first position to the second position so as to allow the first cartridge to be moved to the attachment position of the first image forming apparatus main body. In the image forming system, during attachment of the second cartridge to the first image forming apparatus main body, the first movable member at the first position allows the third projecting portion to enter the first recess portion, and, when the third projecting portion enters the first recess portion, the first movable member at the second position allows the fourth projecting portion to pass through the upstream side of the first recess portion in the movement direction so as to allow the second cartridge to be moved to the attachment position of the first image forming apparatus main body.

Further features of the present invention will become apparent from the following description of exemplary embodiments with reference to the attached drawings.

DESCRIPTION OF EMBODIMENTS

An image forming apparatus and process cartridges according to embodiments of the present invention will be described below with reference to the drawings.

[General Structure of Entirety of Image Forming Apparatus]

[Entire Structure of Image Forming Apparatus]

Figure 2:
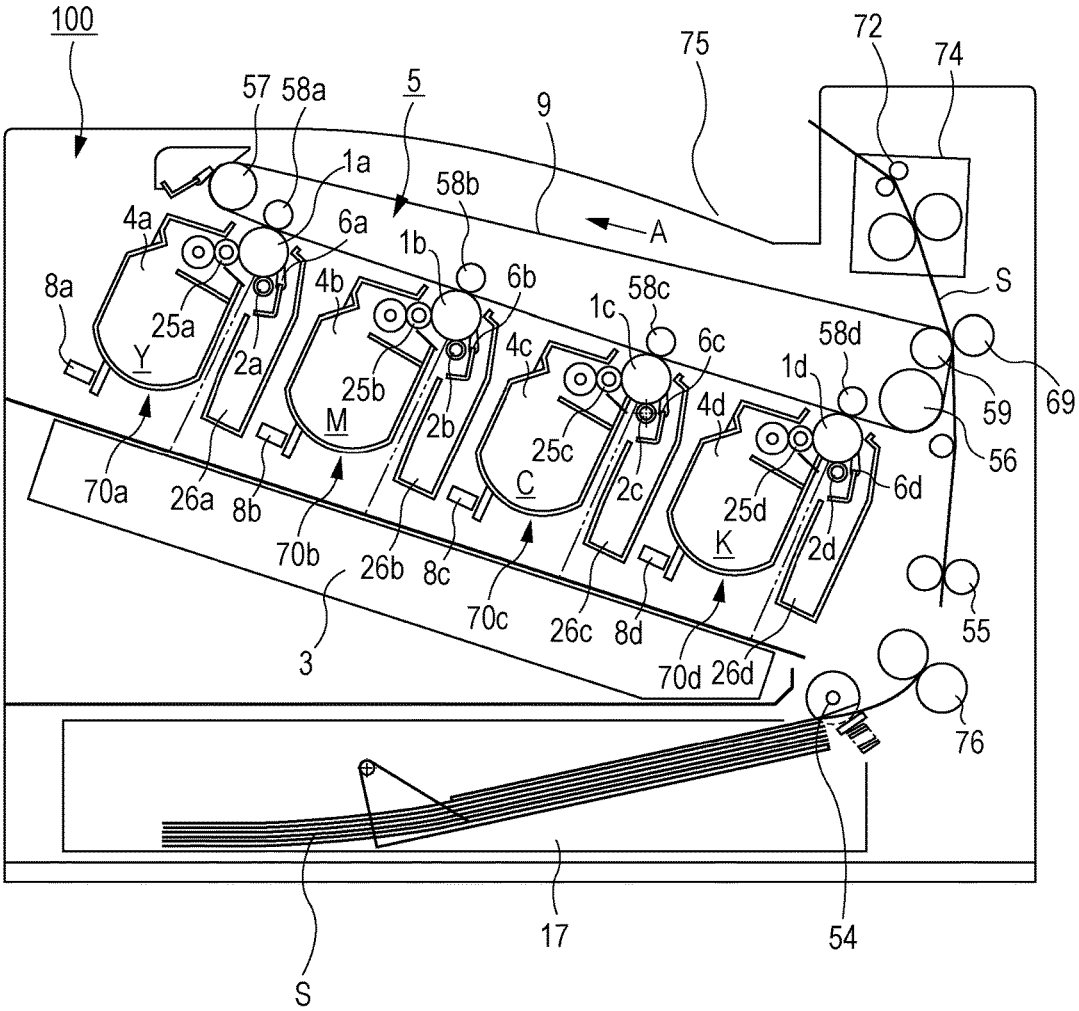
FIG. 2 is a main sectional view of an image forming apparatus according to an embodiment of the present invention.

Initially, the entirety of an image forming apparatus main body 100 (referred to as a main body hereafter) is generally described with reference to FIG. 2. As illustrated in FIG. 2, four detachable process cartridges 70 (70*a*, 70*b*, 70*c*, and 70*d*) are attached to the main body 100. Here, the process cartridges 70 each include an electrophotographic photosensitive drum (referred to as a photosensitive drum hereafter) and at least a developing unit as a process device among process devices that performs operation on the photosensitive drum. The photosensitive drum and the process devices are integrally assembled into a cartridge, which is detachably attached to the image forming apparatus main body 100. An upstream side and a downstream side of the process cartridges 70 (referred to as cartridges hereafter) in a direction in which the cartridges 70 are inserted into the main body 100 are respectively defined as a front side-surface side and a rear side-surface side. In FIG. 2, the cartridges 70 are housed in the main body 100 such that an arrangement direction of the cartridges 70 is inclined relative to the horizontal direction.

A photosensitive drum 1 (1*a*, 1*b*, 1*c*, and 1*d*) and the process devices such as a charging roller 2(2*a*, 2*b*, 2*c*, and 2*d*), a developing roller 25(25*a*, 25*b*, 25*c*, and 25*d*), and a cleaning member 6 (6*a*, 6*b*, 6*c*, and 6*d*)) are integrally provided in each of the cartridges 70. The process devices are disposed around the photosensitive drum 1. The charging rollers 2 uniformly charge the surfaces of the photosensitive drums 1. The developing rollers 25 develop latent images formed on the photosensitive drums 1 with toner so as to form visible images. The cleaning members 6 remove the toner remaining on the photosensitive drums 1 after toner images formed on the photosensitive drums 1 have been transferred onto a recording medium.

A scanner unit 3 is provided below the cartridges 70. The scanner unit 3 causes the photosensitive drums 1 to be selectively exposed to light in accordance with image information so as to form the latent images on the photosensitive drums 1.

A cassette 17 is attached in a lower portion of the main body 100. The cassette 17 contains recording media S, which are sheets such as sheets of paper. A recording medium conveying device is provided so as to convey the recording media S to an upper portion of the main body 100 through a secondary transfer roller 69 and a fixing unit 74. More specifically, a feeding roller 54, a conveying roller pair 76, and a registration roller pair 55 are provided. The feeding roller 54 separates the recording media S from the cassette 17 from one another and feeds the recording media S one after another. The conveying roller pair 76 conveys each of the recording media S having been fed. The registration roller pair 55 causes the latent images formed on the photosensitive drums 1 to be synchronized with the recording media S. Furthermore, an intermediate transfer unit 5 is provided above the cartridges 70. The intermediate transfer unit 5 serves as an intermediate transfer device that transfers the toner images formed on the photosensitive drums 1. The intermediate transfer unit 5 includes a drive roller 56, a driven roller 57, primary transfer rollers 58 (58*a*, 58*b*, 58*c*, and 58*d*), and a facing roller 59. The primary transfer rollers 58 are disposed at positions facing the photosensitive drums 1 for the respective colors. The facing roller 59 is disposed at a position facing the secondary transfer roller 69. An annular transfer belt 9 is looped over these rollers. The transfer belt 9 is rotated so that the transfer belt 9 faces and is in contact with each of the photosensitive drums 1. By applying a voltage to each of the primary transfer rollers 58, primary transfer from each of the photosensitive drums 1 to the transfer belt 9 is performed. Toner on the transfer belt 9 is transferred to the recording media S by applying a voltage to the facing roller 59, which is disposed inside the transfer belt 9, and the secondary transfer roller 69.

In order to form images, the photosensitive drums 1 are rotated, charged by the charging rollers 2, and selectively exposed to the light from the scanner unit 3. Thus, electrostatic latent images are formed on the photosensitive drums 1. These electrostatic latent images are developed by the developing roller 25. Thus, toner images of the colors are formed on the respective photosensitive drums 1. The registration roller pair 55 conveys the recording media S to a secondary transfer position in synchronization with the image formation. In the secondary transfer position, the facing roller 59 is in contact with the secondary transfer roller 69 through the transfer belt 9. The toner images of the colors on the transfer belt 9 are transferred onto the recording media S through secondary transfer by applying a transfer bias to the secondary transfer roller 69. Thus, a color image is formed on the recording media S. The recording media S on which the color image has been formed is heated and is subjected to pressure by the fixing unit 74, so that the toner images are fixed. After that, the recording media S is output to an output unit 75 by an output roller 72. The fixing unit 74 is disposed on an upper portion of the main body 100.

[General Description of Entirety of Cartridges]

Figure 3:
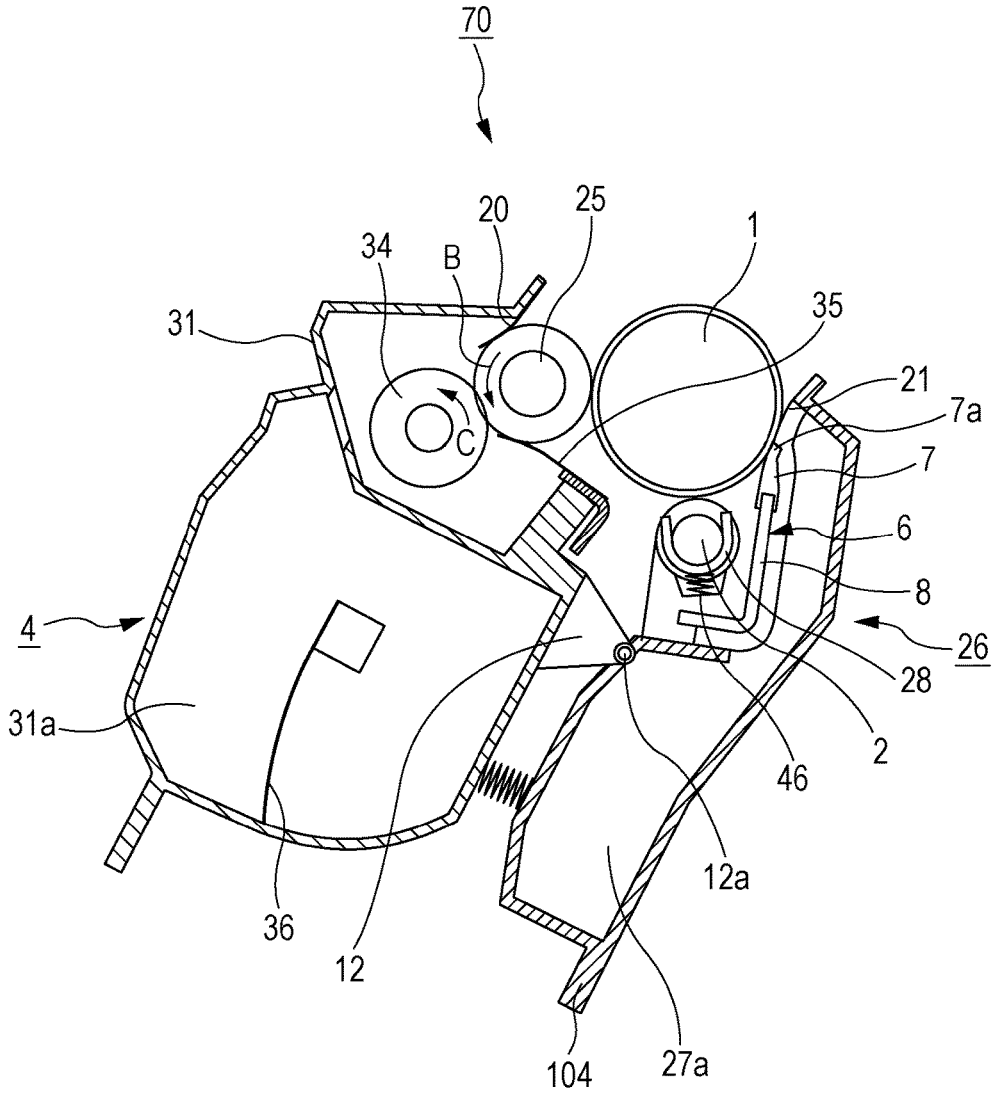
FIG. 3 is a main sectional view of a cartridge according to the embodiment of the present invention.

Next, the entirety of the cartridges 70 is generally described with reference to FIG. 3. FIG. 3 illustrates a main section of one of the cartridges 70 that contains toner. It is noted that the toner cartridge 70*a* that contains yellow toner Y, the toner cartridge 70*b* that contains magenta toner M, the toner cartridge 70*c* that contains cyan toner C, and the toner cartridge 70*d* that contains black toner K are similarly structured or structured in the same manner.

The cartridges 70 include cleaning units 26 (26*a*, 26*b*, 26*c*, and 26*d*) and developing units 4 (4*a*, 4*b*, 4*c*, and 4*d*). The cleaning units 26 each include the photosensitive drum 1, the charging roller 2, and the cleaning member 6. The developing units 4 each include the developing roller 25.

As described above, the charging roller 2 and the cleaning member 6 are disposed at the circumference of each of the photosensitive drums 1. The cleaning member 6 includes an elastic member 7 and a cleaning support member 8(8*a*, 8*b*, 8*c*, and 8*d*). The elastic member 7 is formed of a rubber blade. A tip portion 7*a* of the elastic member 7 is in contact with the photosensitive drum 1 in a state in which the tip portion 7*a* is inclined relative to a normal to the photosensitive drum 1 in a rotational direction. Residual toner removed from the surface of the photosensitive drum 1 by the cleaning member 6 drops into a removed toner chamber 27*a*. An anti-leakage sheet 21 is in contact with the photosensitive drum 1 so as to prevent the removed toner in the removed toner chamber 27*a* from leaking from the removed toner chamber 27*a*. The photosensitive drum 1 is rotated in accordance with an image forming operation by transmitting a drive force from the main body 100 to the cleaning unit 26. The charging roller 2 is rotatably attached to the cleaning unit 26 through charging roller bearings 28. The charging roller 2 is pressed toward the photosensitive drum 1 by a roller pressure member 46, so that the charging roller 2 is rotated by the photosensitive drum 1.

Each of the developing units 4 includes the developing roller 25 and a developing frame 31. The developing roller 25 is in contact with a corresponding one of the photosensitive drums 1 and rotated in an arrow B direction. The developing frame 31 supports the developing roller 25. The developing unit 4 is rotatably connected to the cleaning units 26 at a shaft 12*a* through developing bearings 12 attached to respective sides of the developing frame 31 (see FIG. 3). A toner supply roller 34 and a developing blade 35 are disposed at the circumference of the developing roller 25. The toner supply roller 34 is in contact with the developing roller 25 and rotated in an arrow C direction. The developing blade 35 regulates a toner layer on the developing roller 25. An anti-blowoff sheet 20 that prevents the toner from leaking from the developing frame 31 is provided in the developing frame 31 so as to be in contact with the developing roller 25. Furthermore, a toner conveying member 36 is provided in a toner containing chamber 31*a* of the developing frame 31. The toner conveying member 36 agitates the toner contained in the toner containing chamber 31*a* and conveys the toner to the toner supply roller 34.

[Structure for Attaching and Detaching the Cartridges to and from the Main Body]

Figure 4A:
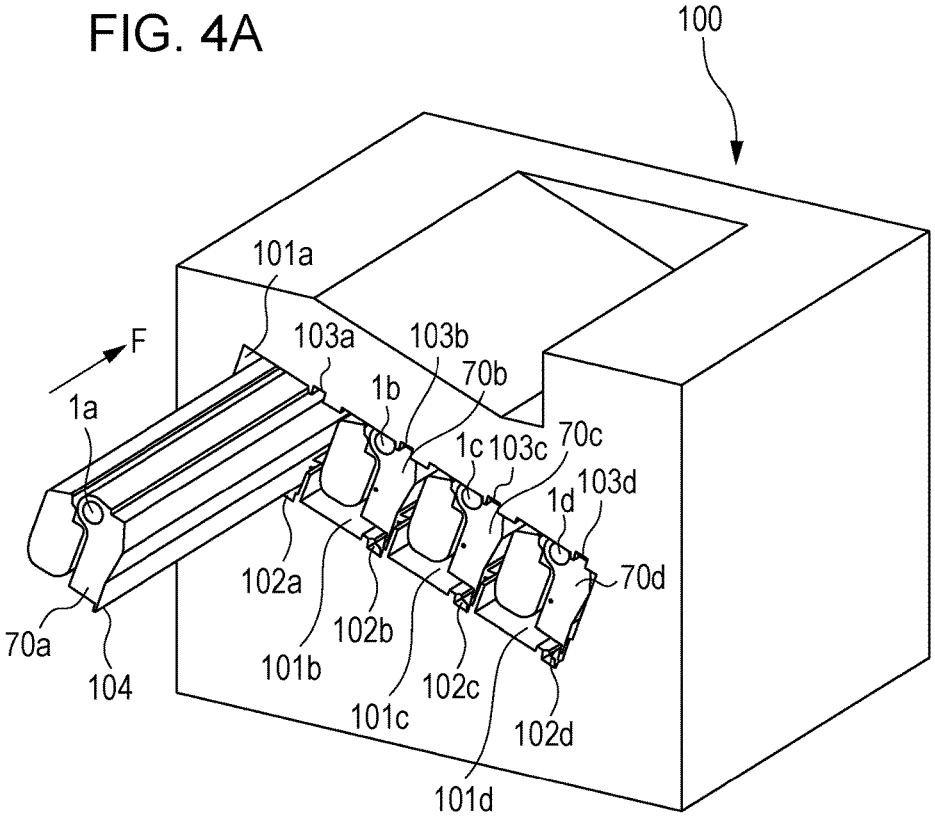
FIG. 4A illustrates a structure for attaching the cartridge to an image forming apparatus main body according to the embodiment of the present invention.

Next, the structure for attaching and detaching the cartridges 70(70*a*, 70*b*, 70*c*, and 70*d*) to and from the main body 100 is described with reference to FIGS. 4A and 4B. In the present embodiment, as illustrated in FIG. 4A, the cartridges 70 are inserted into openings 101 (101*a*, 101*b*, 101*c*, and 101*d*) of the main body 100 from a front side to a rear side in a direction parallel to the axial direction of the photosensitive drums 1 (direction indicated by an arrow F). Herein, the front side is defined as the upstream side in the insertion direction of the cartridges 70 and the rear side is defined as the downstream side in the insertion direction of the cartridges 70. As guide portions of the main body 100, first guide portions 102 (102*a*, 102*b*, 102*c*, and 102*d*) are provided on the lower side and second guide portions 103 (103*a*, 103*b*, 103*c*, and 103*d*) are provided on the upper side in the main body 100. The first guide portions 102 and the second guide portions 103 have shapes for guiding that extend in an insertion direction F of the cartridges 70.

Figure 4B:
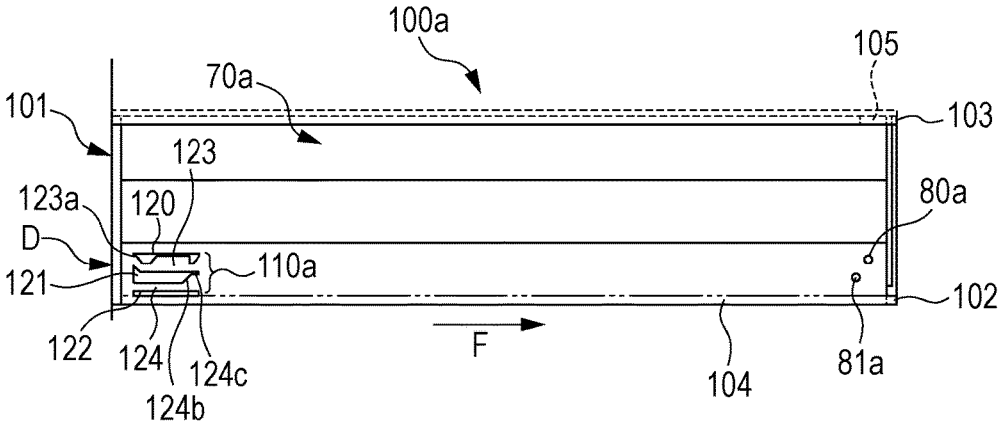
FIG. 4B illustrates a structure for attaching the cartridge to the image forming apparatus main body according to the embodiment of the present invention.

As illustrated in FIG. 4B, each of the cartridges 70 has a first portion to be guided 104 and a second portion to be guided 105. The first guide portion 102 is brought into engagement with the first portion to be guided 104 of the cartridge 70 on the front side in the insertion direction, and after that, the second guide portion 103 is brought into engagement with the second portion to be guided 105. Then, the cartridge 70 is moved along the first guide portion 102 and the second guide portion 103 in the insertion direction F so as to be inserted into the main body 100. Thus, the cartridge 70 is attached at an attachment position D in the main body 100.

Hereafter, features of the present invention will be described using first to fourth embodiments. Hereafter, specific main body 100 is represented as a main body 100*a*, 100A, 100*d*, 100*e*, or the like. Also, cartridges corresponding to the main bodies 100*a*, 100A, 100*d*, 100*e*, or the like are represented as cartridges 70*a*, 70A, 70*d*, 70*e*, or the like.

First Embodiment

A first embodiment according to the present invention is described below with reference to FIGS. 5 to 13F.

Initially, the structures of a first main body 100*a* and the first cartridge 70*a* operable with the first main body 100*a* are described.

Figure 5:
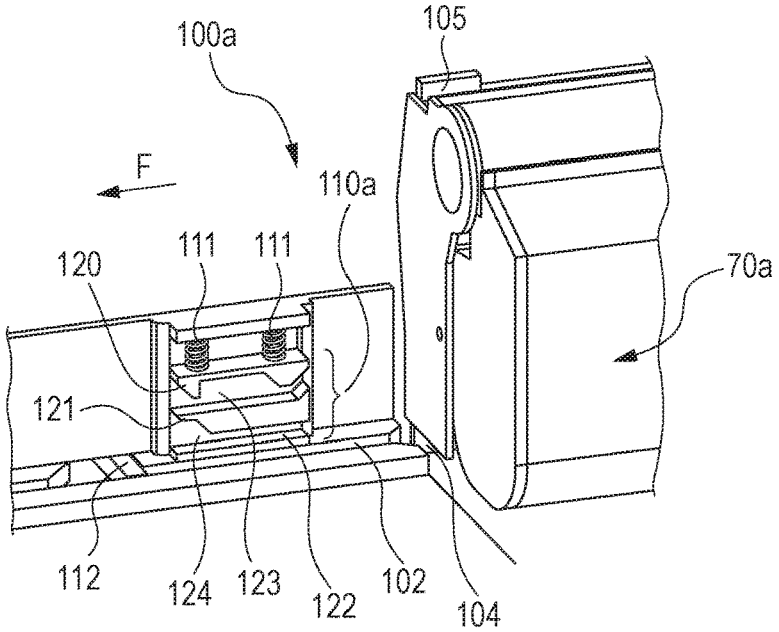
FIG. 5 is an explanatory view of structures of a movable member and a recess portion according to a first embodiment.

FIG. 5 illustrates a state of a portion near the opening 101 of the first main body 100*a* illustrated in FIG. 4A with the first cartridge 70*a* about to be inserted. The first and second guide portions 102 and 103 (see FIG. 4A), a first movable member 110*a*, and urging springs 111 are provided in the first main body 100*a*. The first and second guide portions 102 and 103 guide insertion of the first cartridge 70*a*. The first movable member 110*a* is movable. The urging springs 111 urge the first movable member 110*a* to a first position. The first main body 100*a* allows the first cartridge 70*a* to be disposed at the attachment position D (see FIG. 4B) after attachment of a wrong cartridge has been blocked by the first movable member 110*a* when the first cartridge 70*a* is inserted along the first and second guide portions 102 and 103. In the present embodiment, the first movable member 110*a* is urged downward in the first main body 100*a* by the urging springs 111 so as to be positioned at the first position and is upwardly movable in the first main body 100*a*. That is, the first movable member 110*a* is urged toward the upstream side by the urging springs 111 in a movement direction and movable toward the downstream side in the movement direction. Herein, the movement direction refers to a direction indicated by G in which the movable member 110 is moved, and the insertion direction refers to the insertion direction F in which the first cartridge 70*a* is inserted.

The first movable member 110*a* has a first recess portion 123 and a second recess portion 124. The first recess portion 123 is defined by the first contact portion 120 and a second contact portion 121. The second recess portion 124 is defined by a second contact portion 121 and a first entrance block portion 122. The first movable member 110*a* is structured such that the first movable member 110*a* is movable without changing relative positional relationships between the first contact portion 120, the second contact portion 121, and the first entrance block portion 122. In the present embodiment, a direction in which the first contact portion 120, the second contact portion 121, and the first entrance block portion 122 are arranged is coincident with the movement direction G.

Figure 1:
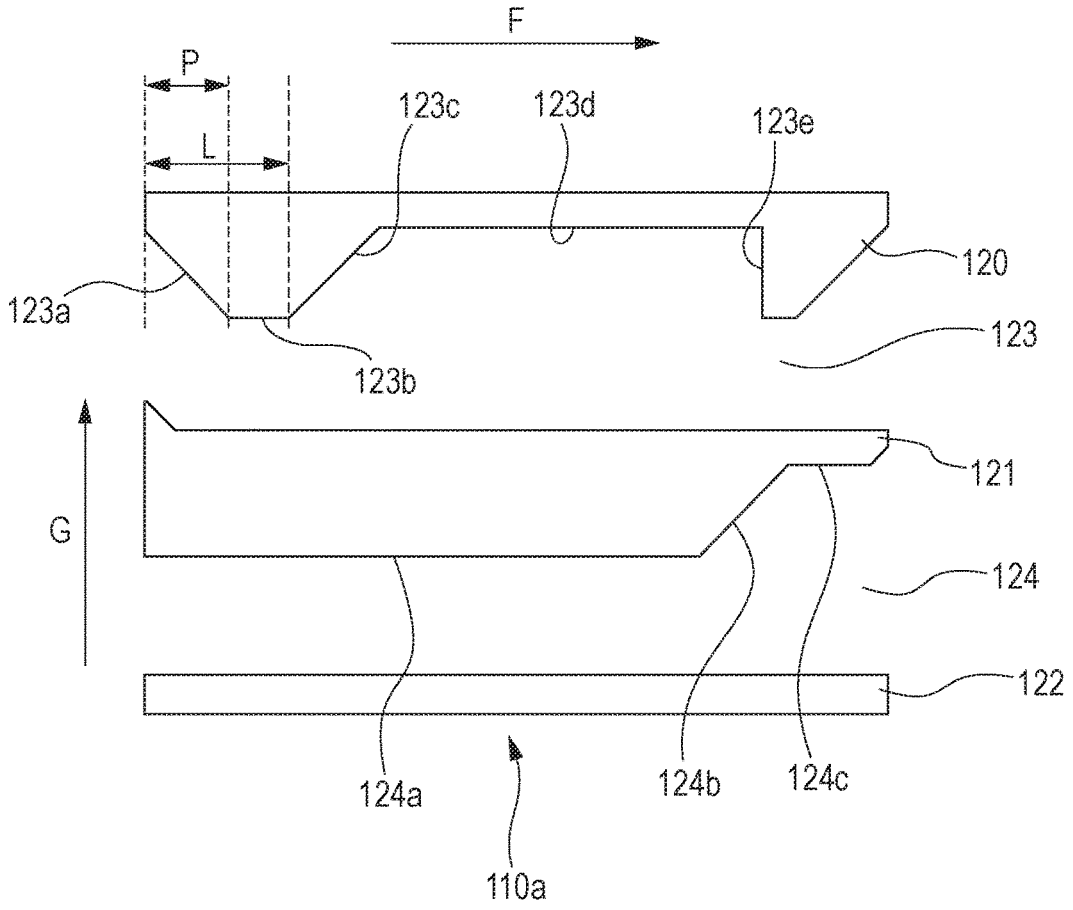
FIG. 1 illustrates entire structures of a first recess portion and a second recess portion provided in a movable member according to a first embodiment.

As illustrated in FIG. 1, a first inclined portion 123*a*, a first flat portion 123*b*, a second inclined portion 123*c*, a first recessed surface portion 123*d*, and a first regulating portion 123*e* are provided in this order in the insertion direction F in the first recess portion 123, that is, on an upstream portion of the first contact portion 120 in the movement direction G.

Specifically, the first inclined portion 123*a* is inclined toward the upstream side in the movement direction G as it extends toward the downstream side in the insertion direction F. The first flat portion 123*b* is connected to the first inclined portion 123*a* and extends substantially parallel to the insertion direction F. The second inclined portion 123*c* is inclined toward the downstream side in the movement direction G as it extends toward the downstream side in the insertion direction F. The first regulating portion 123*e*, which is perpendicular to the insertion direction F, that is, substantially parallel to the movement direction G, is continuous with the first recessed surface portion 123*d*, which is substantially parallel to the insertion direction F.

Likewise, a second flat portion 124*a*, a third inclined portion 124*b*, and a third flat portion 124*c* are provided in this order in the insertion direction F in the second recess portion 124, that is, on an upstream surface of the second contact portion 121 in the movement direction G. Specifically, the second flat portion 124*a* and the third flat portion 124*c* are substantially parallel to the insertion direction F. The third inclined portion 124*b* is inclined toward the downstream side in the movement direction G as it extends toward the downstream side in the insertion direction F. Furthermore, as illustrated in FIG. 5, a stopper member 112 and a connecting member are provided in the first main body 100*a*. The stopper member 112 is interlocked with the first movable member 110*a*. The connecting member connects the first movable member 110*a* and the stopper member 112.

Figure 6:
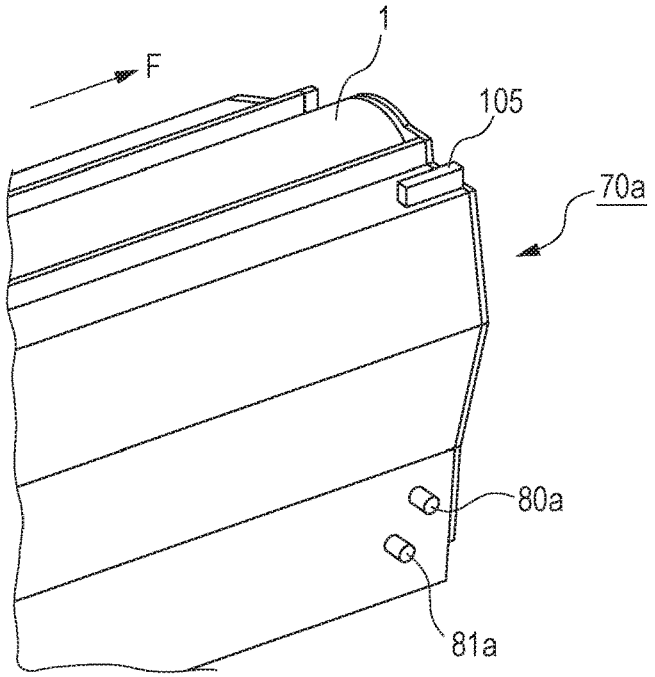
FIG. 6 is an explanatory view of first and second projecting portions of a cartridge according to the first embodiment.

As illustrated in FIG. 6, a first projecting portion 80*a* and a second projecting portion 81*a* are provided on the first cartridge 70*a* such that the first projecting portion 80*a* and the second projecting portion 81*a* project in a direction intersecting the insertion direction F. In the present embodiment, sections of the first projecting portion 80*a* and the second projecting portion 81*a* have circular shapes in a plane specified by the insertion direction F and the movement direction G. The first projecting portion 80*a* is disposed on a downstream side in the insertion direction F, and the second projecting portion 81*a* is disposed upstream of the first projecting portion 80*a* in the insertion direction F.

Figure 7A:
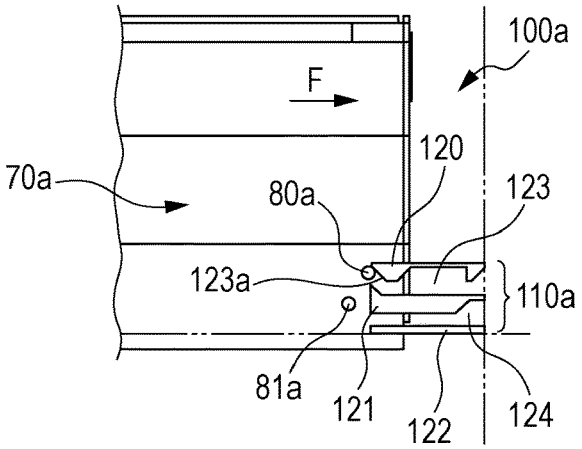
FIG. 7A is an explanatory view of an operation performed when the cartridge is inserted into an image forming apparatus main body according to the first embodiment.
Figure 7B:
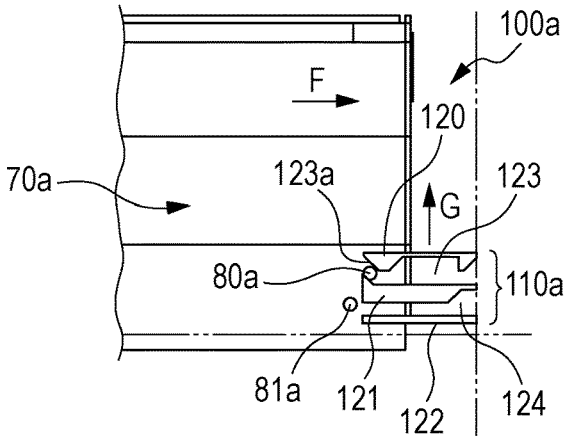
FIG. 7B is an explanatory view of the operation performed when the cartridge is inserted into the image forming apparatus main body according to the first embodiment.
Figure 7C:
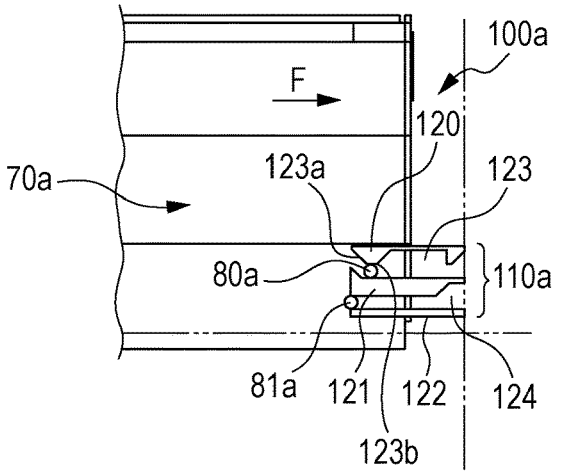
FIG. 7C is an explanatory view of the operation performed when the cartridge is inserted into the image forming apparatus main body according to the first embodiment.

As illustrated in FIG. 7C, in the movement direction G, the width of the inside of the first recess portion 123 is greater than the width of the first projecting portion 80*a*. Also in the movement direction G, the width of the inside of the second recess portion 124 is greater than the width of the second projecting portion 81*a*. The first projecting portion 80*a* and the second projecting portion 81*a* are structured such that, when the first projecting portion 80*a* is moved to an end portion of the first inclined portion 123*a* on the upstream side in the movement direction G, the second projecting portion 81*a* can enter the second recess portion 124. That is, in the insertion direction F, the distance between the first projecting portion 80*a* and the second projecting portion 81*a* is set to be greater than a first distance P (FIG. 1). The first distance P is a distance between the first position of the first movable member 110*a* where the first projecting portion 80*a* is brought into contact with the first inclined portion 123*a* and a second position of the first movable member 110*a* where the second projecting portion 81*a* becomes engageable with the second recess portion 124. In other words, in the insertion direction F, the length through which the first inclined portion 123*a* is in contact with the first projecting portion 80*a* until the second position is reached is less than the distance between the first projecting portion 80*a* and the second projecting portion 81*a*. Furthermore, in the insertion direction F, the distance between the first projecting portion 80*a* and the second projecting portion 81*a* is less than a second distance L (FIG. 1), which is the sum of the length of the first flat portion 123*b* and the first distance P through which the first projecting portion 80*a* is in contact with the first inclined portion 123*a*.

[Attachment of the First Cartridge Operable with the First Main Body]

Next, the relationships between the first projecting portion 80*a*, the second projecting portion 81*a*, and the first movable member 110*a* during attachment of the first cartridge 70*a* operable with the first main body 100*a* to the first main body 100*a* by inserting the first cartridge 70*a* in the insertion direction F are described. Here, in FIGS. 7A to 7F, the left side corresponds to the front side of the image forming apparatus and the right side corresponds to the rear side of the image forming apparatus.

As illustrated in FIG. 7A, when the first cartridge 70*a* is inserted along the first guide portion 102 and the second guide portion 103 (see FIG. 4A), the first projecting portion 80*a* is brought into engagement with the first recess portion 123 of the first movable member 110*a* positioned at the first position. When the first cartridge 70*a* is further inserted, the first projecting portion 80*a* is brought into contact with the first inclined portion 123*a* of the first contact portion 120 provided at the entrance of the first recess portion 123 as illustrated in FIG. 7B. Thus, the first movable member 110*a* receives a force from the first cartridge 70*a* through the first projecting portion 80*a*. This causes the first movable member 110*a* urged downward by the urging springs 111 to be moved upward (in the movement direction G).

Figure 7D:
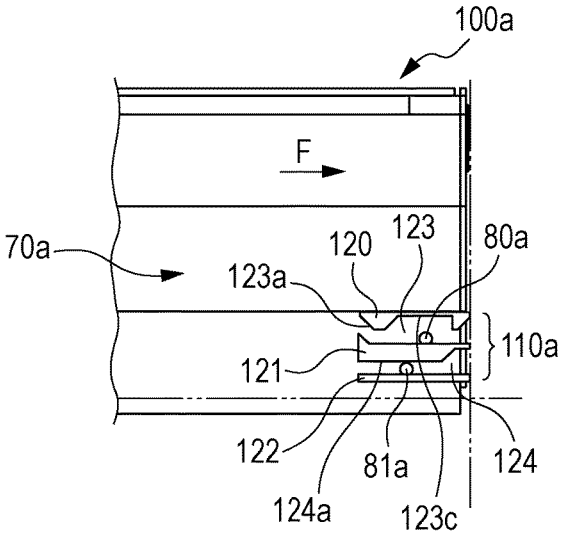
FIG. 7D is an explanatory view of the operation performed when the cartridge is inserted into the image forming apparatus main body according to the first embodiment.

When the first cartridge 70*a* is yet further inserted, as illustrated in FIG. 7C, the first projecting portion 80*a* is brought into contact with the first flat portion 123*b* of the first recess portion 123. This causes the first movable member 110*a* to be moved to the second position where the second recess portion 124 of the first movable member 110*a* is engageable with the second projecting portion 81*a*. The first flat portion 123*b* can extend time during which the first movable member 110*a* stays at the second position where the second projecting portion 81*a* is engageable with the second recess portion 124. Thus, even in the case where members included in the first cartridge 70*a* and the first main body 100*a* expand or contract due to heat, the second projecting portion 81*a* can become engageable with the second recess portion 124. When the second projecting portion 81*a* is brought into engagement with the second recess portion 124, as illustrated in FIG. 7D, the second projecting portion 81*a* supports the second flat portion 124*a* of the first movable member 110*a* while the first cartridge 70*a* is inserted. Thus, the first cartridge 70*a* is inserted while the first cartridge 70*a* is held upward.

Figure 7E:
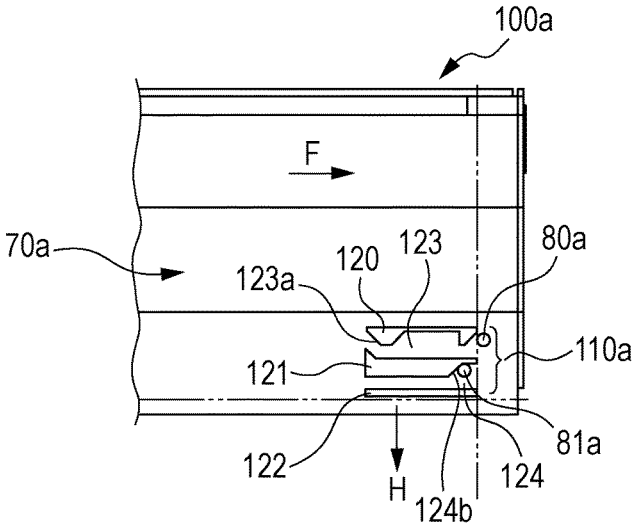
FIG. 7E is an explanatory view of the operation performed when the cartridge is inserted into the image forming apparatus main body according to the first embodiment.
Figure 7F:
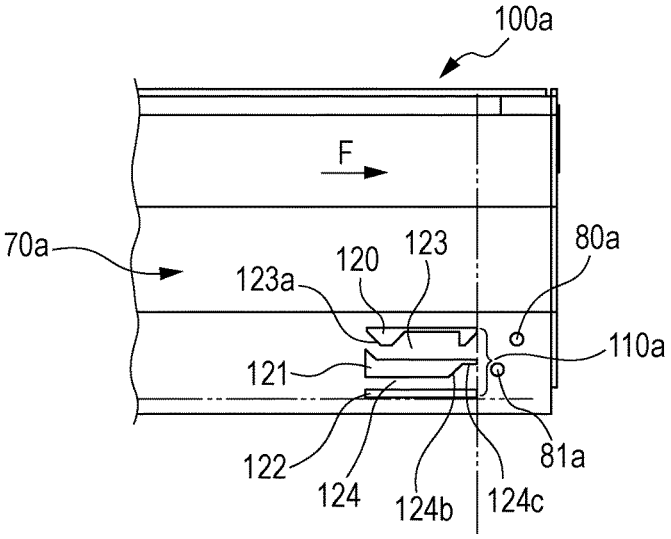
FIG. 7F is an explanatory view of the operation performed when the cartridge is inserted into the image forming apparatus main body according to the first embodiment.

When the first cartridge 70*a* is yet further inserted and, as illustrated in FIG. 7E, the second projecting portion 81*a* is moved to a position on the third inclined portion 124*b*, the first movable member 110*a* is moved in a second movement direction (arrow H), which is a downward direction, as the first cartridge 70*a* is inserted. More specifically, by supporting the surface of the second contact portion 121 facing the first entrance block portion 122 with the second projecting portion 81*a*, the first movable member 110*a* is urged downward by restoring forces of the urging springs 111 and is moved downward as the first cartridge 70*a* is inserted. FIG. 7F illustrates a state in which the first cartridge 70*a* has been completely inserted into the first main body 100*a*. Thus, the first cartridge 70*a* is operable with the first main body 100*a* and can be inserted into the attachment position D (see FIG. 4B) in the first main body 100*a*.

[Removal of the First Cartridge Operable with the First Main Body from the First Main Body]

Figure 8A:
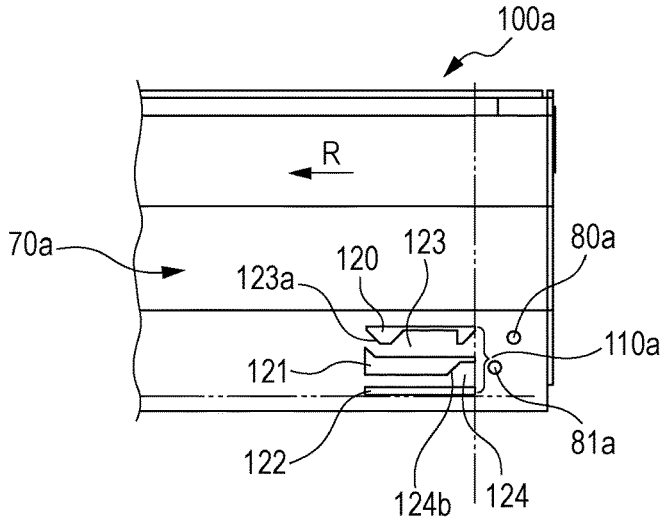
FIG. 8A is an explanatory view of an operation performed when the cartridge is removed from the image forming apparatus main body according to the first embodiment.

Next, the relationships between the first and second projecting portions 80*a* and 81*a* and the first movable member 110*a* when the first cartridge 70*a* is pulled in a removal direction R to be removed from the first main body 100*a* are described with reference to FIGS. 8A to 8F. Similarly to FIG. 7F, FIG. 8A illustrates a state in which the first cartridge 70*a* has been completely inserted into the first main body 100*a*.

Figure 8B:
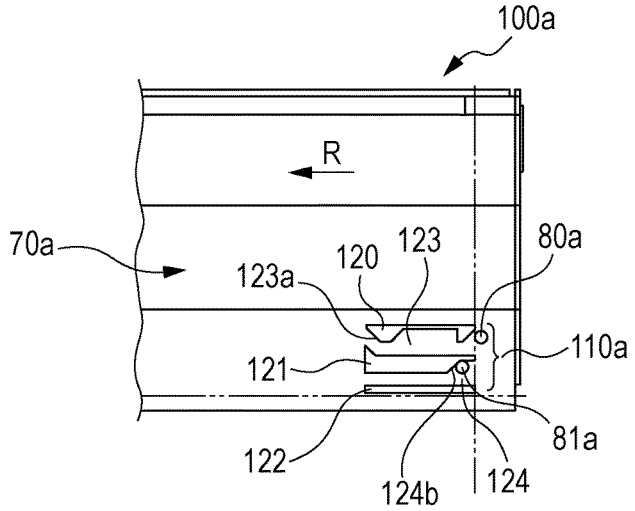
FIG. 8B is an explanatory view of the operation performed when the cartridge is removed from the image forming apparatus main body according to the first embodiment.

Initially, when the first cartridge 70*a* is pulled in a removal direction R, which is opposite to the insertion direction F, the second projecting portion 81*a* is brought into engagement with the second recess portion 124 of the first movable member 110*a* and brought into contact with the second contact portion 121 of the second recess portion 124 as illustrated in FIG. 8B. That is, the second projecting portion 81*a* is brought into contact with the third inclined portion 124*b* of the second contact portion 121. Thus, when the first cartridge 70*a* is pulled, the first movable member 110*a* receives the force from the first cartridge 70*a* through the second projecting portion 81*a*. This causes the first movable member 110*a* urged downward by the urging springs 111 to be moved upward (in the movement direction G).

Figure 8C:
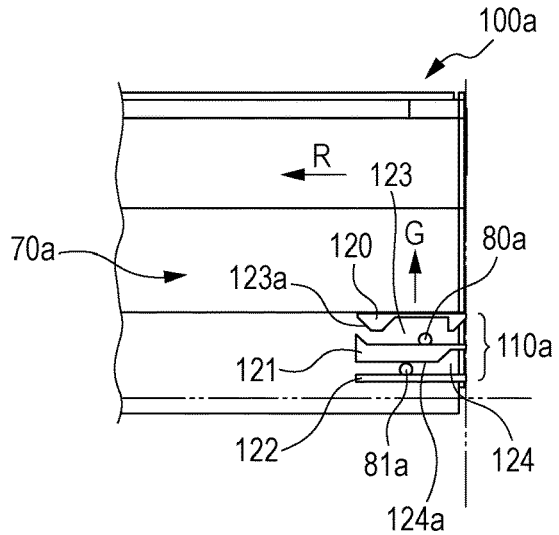
FIG. 8C is an explanatory view of the operation performed when the cartridge is removed from the image forming apparatus main body according to the first embodiment.

When the first cartridge 70*a* is further pulled, as illustrated in FIG. 8C, the second projecting portion 81*a* is brought into contact with the second flat portion 124*a* of the second contact portion 121. This causes the first movable member 110*a* to be moved to the second position. While the first cartridge 70*a* is being further pulled, the second projecting portion 81*a* supports the second flat portion 124*a* of the first movable member 110*a*. Thus, the first cartridge 70*a* is being removed while the first movable member 110*a* is held upward.

Figure 8D:
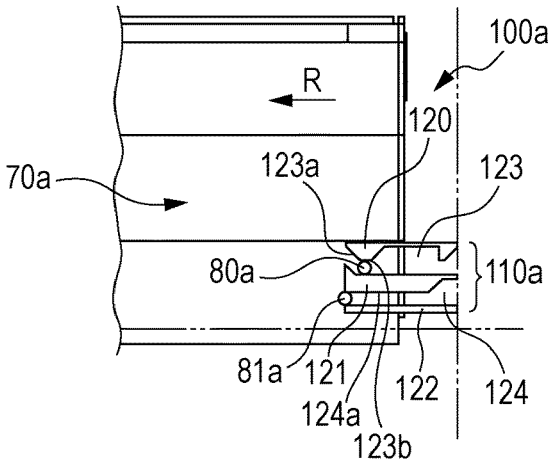
FIG. 8D is an explanatory view of the operation performed when the cartridge is removed from the image forming apparatus main body according to the first embodiment.
Figure 8E:
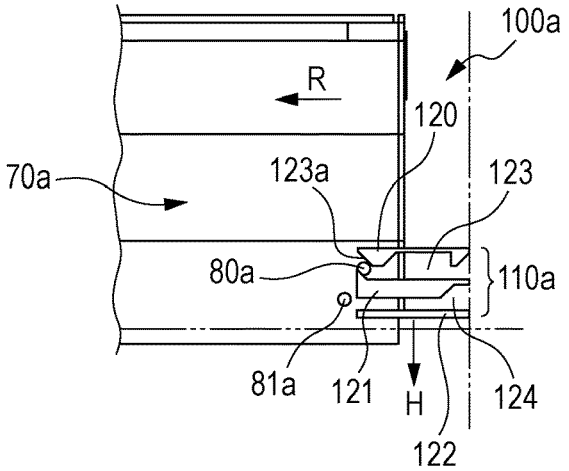
FIG. 8E is an explanatory view of the operation performed when the cartridge is removed from the image forming apparatus main body according to the first embodiment.
Figure 8F:
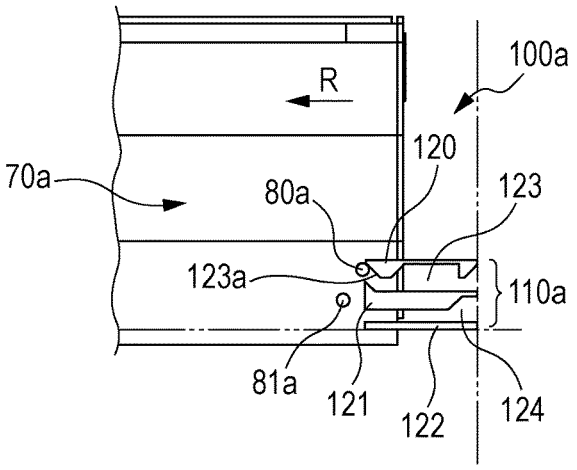
FIG. 8F is an explanatory view of the operation performed when the cartridge is removed from the image forming apparatus main body according to the first embodiment.

When the first cartridge 70*a* is yet further pulled, as illustrated in FIG. 8D, the first projecting portion 80*a* is brought into contact with the surface of the first contact portion 120 of the first recess portion 123 on the upstream side in the movement direction G. After that, the second projecting portion 81*a* is disengaged from the second recess portion 124. When the first cartridge 70*a* is yet further pulled and, as illustrated in FIG. 8E, the first projecting portion 80*a* is moved to a position on the first inclined portion 123*a*, the first movable member 110*a* is moved in the second movement direction (arrow H), which is the downward direction, as the first cartridge 70*a* is pulled. More specifically, by supporting the surface of the first contact portion 120 facing the second contact portion 121 with the first projecting portion 80*a*, the first movable member 110*a* urged downward by the restoring forces of the urging springs 111 is moved downward as the first cartridge 70*a* is pulled. FIG. 8F illustrates a state in which the first and second projecting portions 80*a* and 81*a* are disengaged from the first and second recess portions 123 and 124 of the first movable member 110*a*, and the first movable member 110*a* is positioned at the first position. Thus, the first cartridge 70*a* of the first main body 100*a* can be removed from the first main body 100*a*.

[Attachment of Cartridges not Operable with the First Main Body]

Next, the cases where cartridges 70*b* and 70*c*, which are not operable with the first main body 100*a* unlike the first cartridge 70*a*, are inserted into the above-described first main body 100*a* is described with reference to FIGS. 9A to 10B.

Hereafter, in the insertion direction F, the first distance P is defined as a distance through which the first inclined portion 123*a* is in contact with a projecting portion 80*b* and by which the first movable member 110*a* is moved from the first position to the second position, where a projecting portion 81*b* becomes engageable with the second recess portion 124. Initially, the cartridge 70*b* is described as an example. The distance between the projecting portion 80*b* and the projecting portion 81*b* of this cartridge 70*b* is set to be greater than the second distance L, which is the sum of the first distance P and the length of the first flat portion 123*b*. The relationships between the projecting portions 80*b* and 81*b* and the first movable member 110*a* when the cartridge 70*b* is inserted into the first main body 100*a* in the insertion direction F are described with reference to FIGS. 9A to 9C.

Figure 9A:
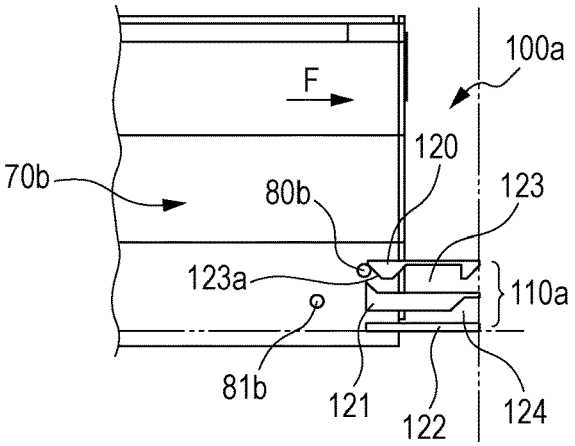
FIG. 9A is an explanatory view of an operation to prevent a wrong cartridge from being inserted when the cartridge is inserted into the image forming apparatus main body according to the first embodiment.
Figure 9B:
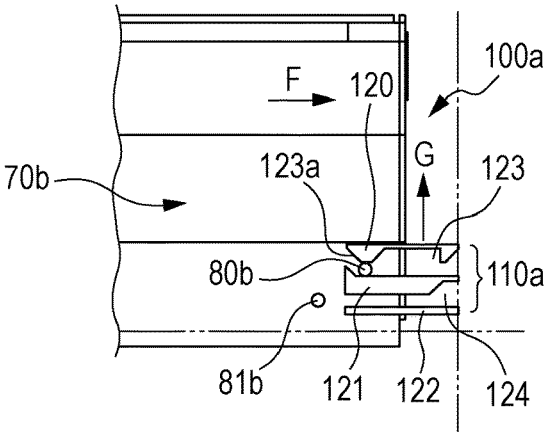
FIG. 9B is an explanatory view of the operation to prevent the wrong cartridge from being inserted when the cartridge is inserted into the image forming apparatus main body according to the first embodiment.
Figure 9C:
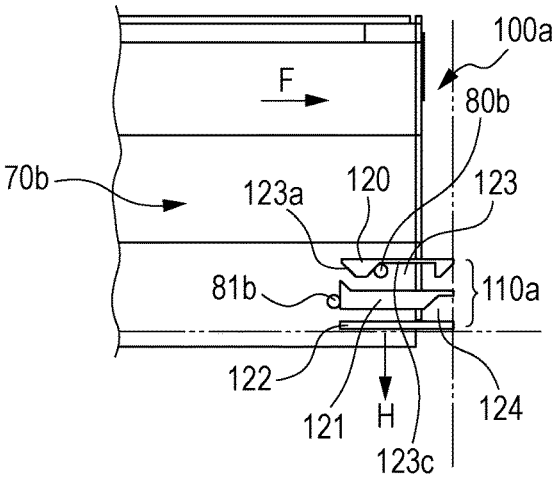
FIG. 9C is an explanatory view of the operation to prevent the wrong cartridge from being inserted when the cartridge is inserted into the image forming apparatus main body according to the first embodiment.

As illustrated in FIG. 9A, when the cartridge 70*b* is initially inserted, the projecting portion 80*b* and the first recess portion 123 of the first movable member 110*a* are brought into engagement with each other. When the cartridge 70*b* is further inserted, the projecting portion 80*b* is brought into contact with the first inclined portion 123*a* of the first contact portion 120 provided at the entrance of the first recess portion 123 as illustrated in FIG. 9B. Thus, the first movable member 110*a* receives a force from the cartridge 70*b* through the projecting portion 80*b*. This causes the first movable member 110*a* urged downward by the urging springs 111 to be moved upward (in the movement direction G). When the cartridge 70*b* is further inserted and the projecting portion 80*b* is moved to a position on the second inclined portion 123*c* as illustrated in FIG. 9C, the first movable member 110*a* is moved in the second movement direction (arrow H), which is the downward direction, as the cartridge 70*b* is inserted. More specifically, by supporting the second inclined portion 123*c* of the first movable member 110*a* with the projecting portion 80*b*, the first movable member 110*a* urged downward by the restoring forces of the urging springs 111 is moved downward as the cartridge 70*b* is inserted. When the cartridge 70*b* is inserted and the projecting portion 80*b* is moved to a position on the first recessed surface portion 123*d*, the projecting portion 81*b* is brought into contact with an end surface of the second contact portion 121 on the upstream side in the insertion direction F and not brought into engagement with the second recess portion 124 of the first movable member 110*a*. As a result, insertion of the cartridge 70*b*, which is a wrong cartridge in this case, into the first main body 100*a* can be prevented.

Next, a cartridge 70*c* in which the distance between a projecting portion 80*c* and a projecting portion 81*c* is made to be less than the first distance P in the insertion direction F is described as an example. The relationships between the projecting portions 80*c* and 81*c* and the first movable member 110*a* when the cartridge 70*c* is inserted into the first main body 100*a* in the insertion direction F are described with reference to FIGS. 10A and 10B.

Figure 10A:
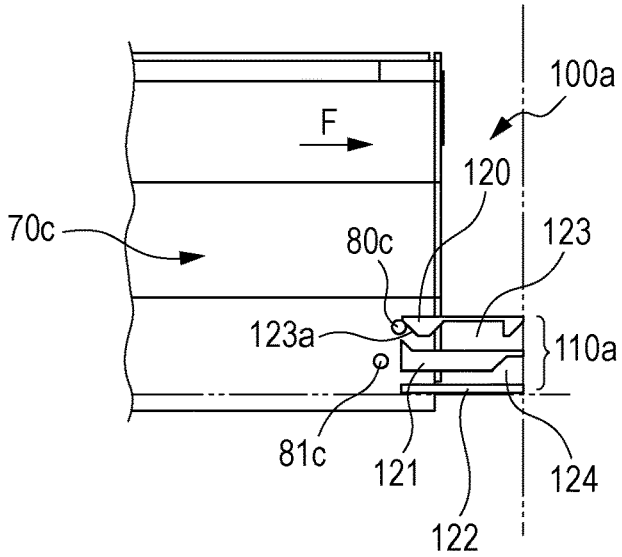
FIG. 10A is an explanatory view of an operation to prevent a wrong cartridge from being inserted when the cartridge is inserted into the image forming apparatus main body according to the first embodiment.
Figure 10B:
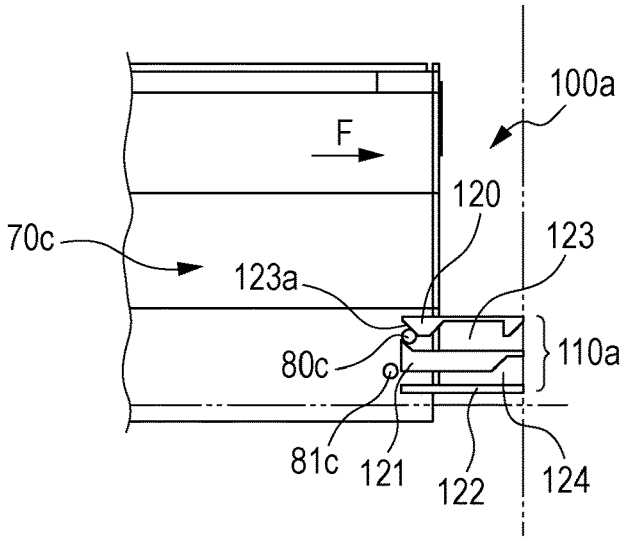
FIG. 10B is an explanatory view of the operation to prevent the wrong cartridge from being inserted when the cartridge is inserted into the image forming apparatus main body according to the first embodiment.
Figure 16A:
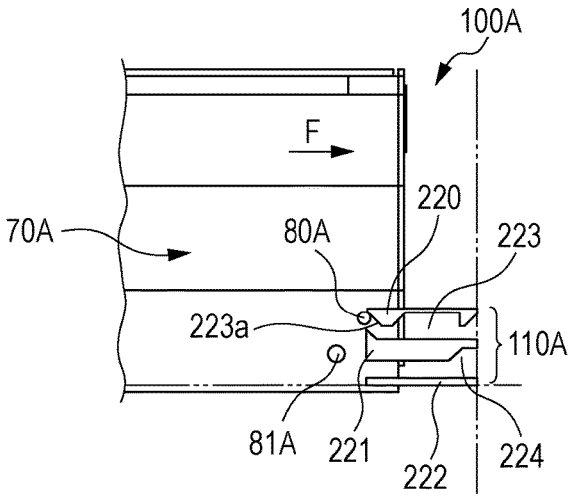
FIG. 16A is an explanatory view of an operation performed when the cartridge is inserted into an image forming apparatus main body according to the second embodiment.

As illustrated in FIG. 10A, when the cartridge 70*c* is initially moved, the projecting portion 80*c* and the first recess portion 123 of the second movable member 110A (FIG. 16A) are brought into engagement with each other. When the cartridge 70*c* is further inserted, the projecting portion 80*c* is brought into contact with the first inclined portion 123*a* of the first contact portion 120 provided at the entrance of the first recess portion 123 as illustrated in FIG. 10B. Thus, the first movable member 110*a* receives a force from the cartridge 70*c* through the projecting portion 80*c*. This causes the first movable member 110*a* urged downward by the urging springs 111 to be moved upward (in the movement direction G). However, while the first movable member 110*a* is moved upward as the cartridge 70*c* is inserted, the projecting portion 81*c* is brought into contact with the end surface of the second contact portion 121 on the upstream side in the insertion direction F. Thus, the projecting portion 81*c* is not brought into engagement with the second recess portion 124 of the first movable member 110*a*. As a result, insertion of the cartridge 70*c*, which is a wrong cartridge in this case, into the first main body 100*a* can be prevented.

Although it is not illustrated, when the width of a first projecting portion 80*a* provided on the cartridge 70*a* is made to be larger than the entrance of the first recess portion 123 in the movement direction G, the first projecting portion 80*a* is not engageable with the first recess portion 123. Likewise, when a second projecting portion 81*a* provided on the cartridge 70*a* is made to be larger than the entrance of the second recess portion 124 in the movement direction G, the second projecting portion 81*a* is not engageable with the second recess portion 124. Thus, insertion of the wrong cartridge 70*a* into the first main body 100*a* can be prevented also by depending on the sizes of the first and second projecting portions 80*a* and 81*a*.

[Summarization]

According to the above description, the first and second projecting portions 80*a* and 81*a* of the cartridge 70*a* that is not operable with the first main body 100*a* do not have the sizes and are not arranged so as to correspond to the first and second recess portions 123 and 124, and accordingly, the cartridge 70*a* cannot be inserted into the attachment position D. Thus, a situation in which the wrong cartridges 70*b* and 70*c* not operable with the first main body 100*a* are attached to the attachment position D can be prevented.

The first main body 100*a* has, as illustrated in FIG. 1, the first regulating portion 123*e* in the first contact portion 120 of the first recess portion 123. With such a structure, in the case where the first projecting portion 80*a* of a second cartridge 70A has been lost due to, for example, damage or the like, when the second cartridge 70A (FIG. 12) is inserted, the first regulating portion 123*e* is brought into contact with the first projecting portion 80*a*. Accordingly, as long as the cartridge is not recognized as that operable with the image forming apparatus, the first regulating portion 123*e* blocks the insertion of the cartridge. Thus, the likelihood of insertion of the wrong cartridge that is not operable with the first main body 100*a* can be further reliably reduced.

[About Stopper Member]

The stopper member 112 may be provided in the main body 100. The stopper member 112 is described below with reference to FIGS. 11A and 11B.

Figure 11A:
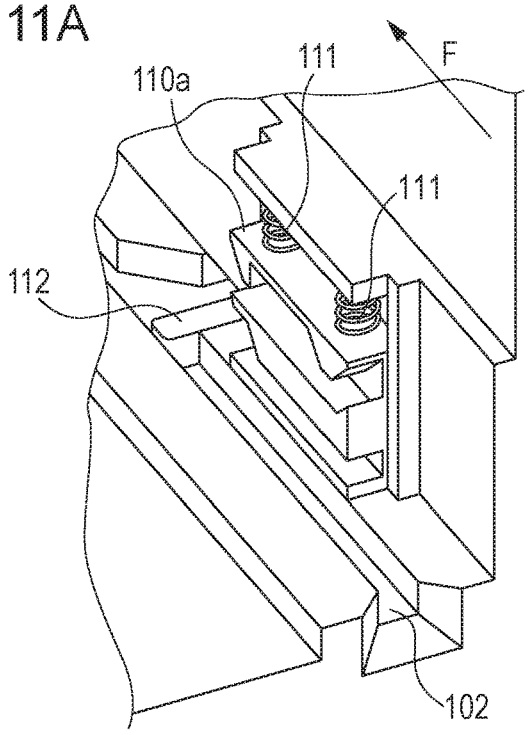
FIG. 11A is an explanatory view of a stopper member according to the first embodiment.
Figure 11B:
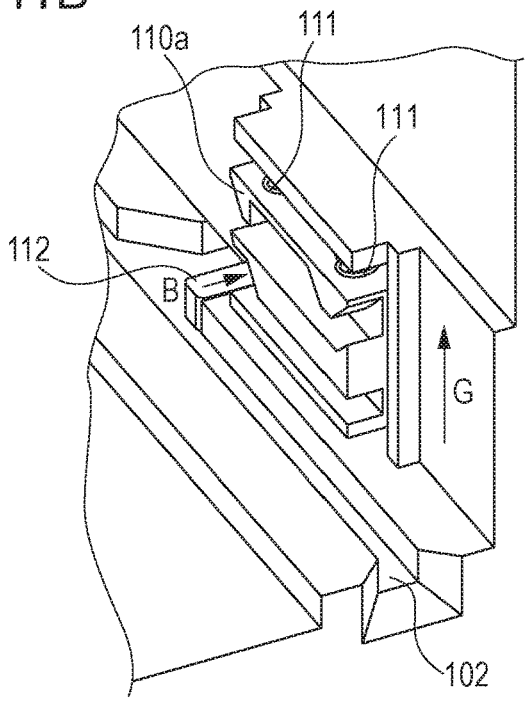
FIG. 11B is an explanatory view of the stopper member according to the first embodiment.

As illustrated in FIG. 11A, when the first cartridge 70*a* is not inserted, the stopper member 112 extends in a direction that intersects the insertion direction F and is positioned so as to project into the first guide portion 102 in the first main body 100*a*. In contrast, as illustrated in FIG. 11B, when the second cartridge 70A is inserted and the first movable member 110*a* is moved upward (in the movement direction G) by the first and second projecting portions 80*a* and 81*a* of the second cartridge 70A, the stopper member 112 is retracted in an arrow B direction. More specifically, by connecting the stopper member 112 and the first movable member 110*a* to each other by a cam (not illustrated), the stopper member 112 is moved from the inside to the outside of the first guide portion 102. Thus, the first cartridge 70*a* becomes insertable.

Accordingly, the first movable member 110*a* and the stopper member 112 cannot be moved when, for example, the cartridge is the cartridge 70*b* or 70*c* that is not operable with the first main body 100*a* or at least one of the first and second projecting portions 80*a* and 81*a* is lost due to damage or the like. Thus, as long as the cartridge is not recognized as the cartridge operable with the image forming apparatus, the cartridge is brought into contact with the stopper member 112 and cannot advance to the attachment position D (see FIG. 4B). That is, the likelihood of insertion of a wrong cartridge that is not operable with the main body 100 can be further reliably reduced.

[Second Cartridge Attachable to First Main Body]

Meanwhile, a need exists for allowing various types of cartridges to be attached to the first main body 100*a*. The various types of cartridges include cartridges that contain different amounts of developer according to applications of users, that correspond to a succeeding model of the first main body 100*a* with improved functions and performances, and so forth. Thus, the second cartridge 70A that is attachable to the first main body 100*a* is described.

Figure 12:
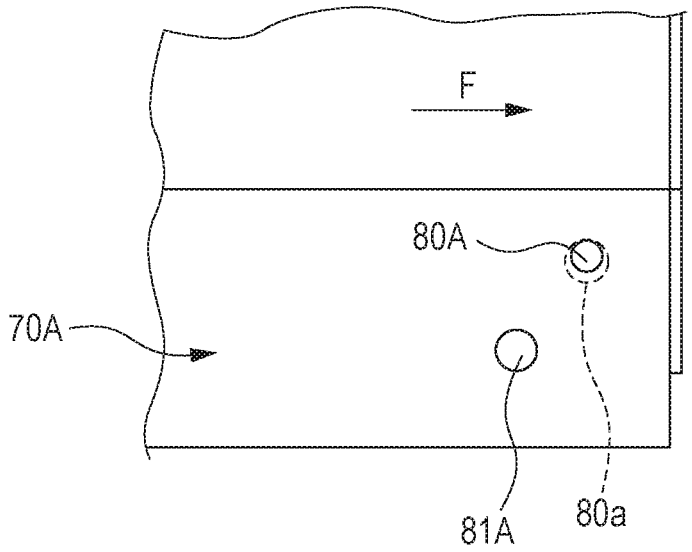
FIG. 12 is an explanatory view of third and fourth projecting portions of a cartridge according to the first embodiment.

As illustrated in FIG. 12, the second cartridge 70A has a third projecting portion 80A and a fourth projecting portion 81A. The shape of third projecting portion 80A is different from that of the first projecting portion 80*a*. Specifically, in the present embodiment, in the plane specified by the insertion direction F and the movement direction G, the section of the first projecting portion 80*a* has a circular shape, a section of the third projecting portion 80A also has a circular shape, and the sections of the first projecting portion 80*a* and the third projecting portion 80A have a common tangent line at the downstream end portion in the movement direction G and have different diameters. As is the case with the first cartridge 70*a*, the third projecting portion 80A and the fourth projecting portion 81A are provided on the second cartridge 70A such that the third projecting portion 80A and the fourth projecting portion 81A project in a direction intersecting the insertion direction F. The third projecting portion 80A is disposed on the downstream side in the insertion direction F of the cartridge, and the fourth projecting portion 81A is disposed upstream of the third projecting portion 80A in the insertion direction F of the cartridge. As illustrated in FIG. 13B, the third projecting portion 80A has a shape that can enter the first recess portion 123. Furthermore, regarding the third and fourth projecting portions 80A and 81A, as illustrated in FIG. 13C, the fourth projecting portion 81A is engageable with the second recess portion 124 when the third projecting portion 80A is moved to the end portion of the first inclined portion 123*a* on the upstream side in the movement direction G. That is, in the insertion direction F, the distance between the third projecting portion 80A and the fourth projecting portion 81A is greater than the first distance P through which the third projecting portion 80A is in contact with the first inclined portion 123*a* and less than the second distance L, which is the sum of the first distance P and the length of the first flat portion 123*b* (see FIG. 1).

[Attachment of the Second Cartridge into the First Main Body]

Next, the relationships between the third and fourth projecting portions 80A and 81A and the first movable member 110*a* during attachment of the second cartridge 70A to the first main body 100*a* by inserting the second cartridge 70A in the insertion direction F are described with reference to FIGS. 13A to 13F. Here, in FIGS. 13A to 13F, the left side corresponds to the front side of the image forming apparatus and the right side corresponds to the rear side of the image forming apparatus.

Figure 13A:
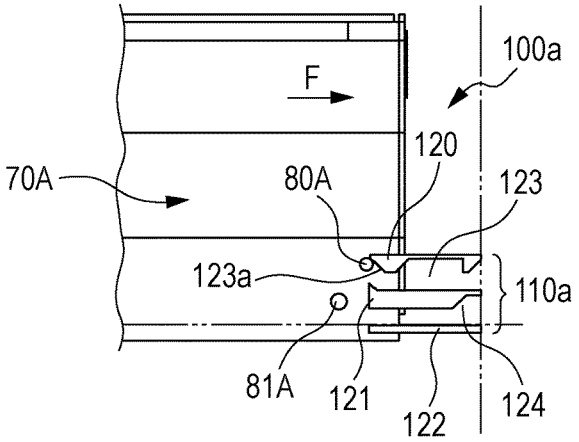
FIG. 13A is an explanatory view of an operation performed when the cartridge is inserted into the image forming apparatus main body according to the first embodiment.
Figure 13B:
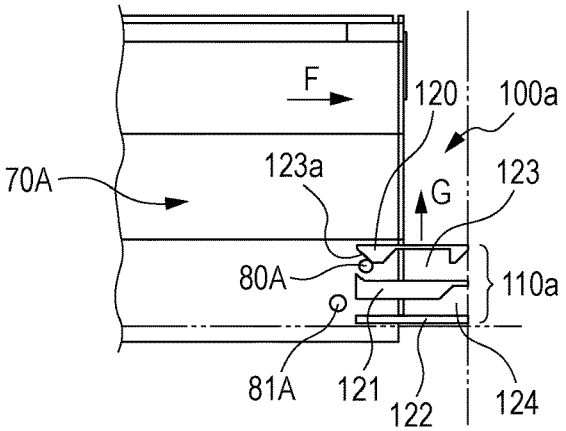
FIG. 13B is an explanatory view of the operation performed when the cartridge is inserted into the image forming apparatus main body according to the first embodiment.
Figure 13C:
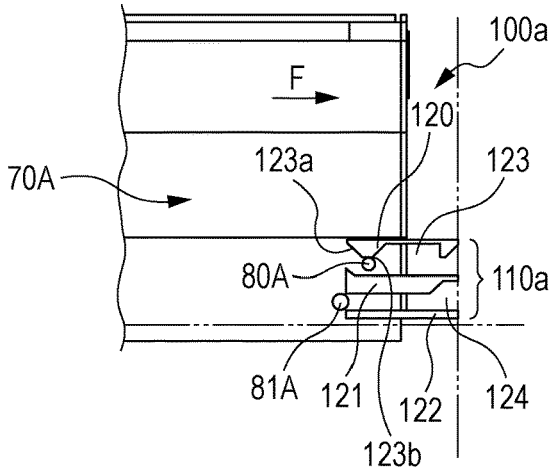
FIG. 13C is an explanatory view of the operation performed when the cartridge is inserted into the image forming apparatus main body according to the first embodiment.

As illustrated in FIG. 13A, when the second cartridge 70A is initially inserted, the third projecting portion 80A and the first recess portion 123 of the first movable member 110*a* are brought into engagement with each other. When the second cartridge 70A is further inserted, the third projecting portion 80A is brought into contact with the first inclined portion 123*a* of the first contact portion 120 provided at the entrance of the first recess portion 123 as illustrated in FIG. 13B. Thus, the first movable member 110*a* receives a force from the second cartridge 70A through the third projecting portion 80A. This causes the first movable member 110*a* urged downward by the urging springs 111 to be moved upward (in the movement direction G).

When the second cartridge 70A is yet further inserted, as illustrated in FIG. 13C, the third projecting portion 80A is brought into contact with the first flat portion 123*b* of the first recess portion 123. This causes the first movable member 110*a* to be moved to the second position where the second recess portion 124 of the first movable member 110*a* is engageable with the fourth projecting portion 81A. The first flat portion 123*b* can extend time during which the first movable member 110*a* stays at the second position where the fourth projecting portion 81A is engageable with the second recess portion 124. Thus, even in the case where members included in the second cartridge 70A and the first main body 100*a* expand or contract due to heat, the fourth projecting portion 81A can become engageable with the second recess portion 124.

Figure 13D:
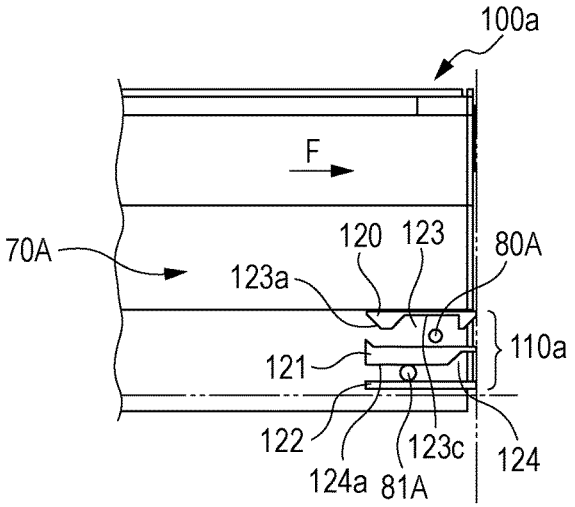
FIG. 13D is an explanatory view of the operation performed when the cartridge is inserted into the image forming apparatus main body according to the first embodiment.

When the fourth projecting portion 81A is brought into engagement with the second recess portion 124, as illustrated in FIG. 13D, the fourth projecting portion 81A supports the second flat portion 124*a* of the first movable member 110*a* while the second cartridge 70A is inserted. Thus, the first movable member 110*a* is held upward while the second cartridge 70A is inserted.

Figure 13E:
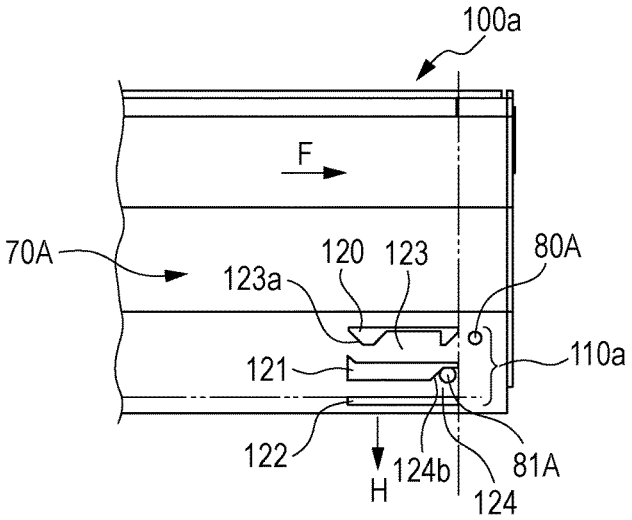
FIG. 13E is an explanatory view of the operation performed when the cartridge is inserted into the image forming apparatus main body according to the first embodiment.
Figure 13F:
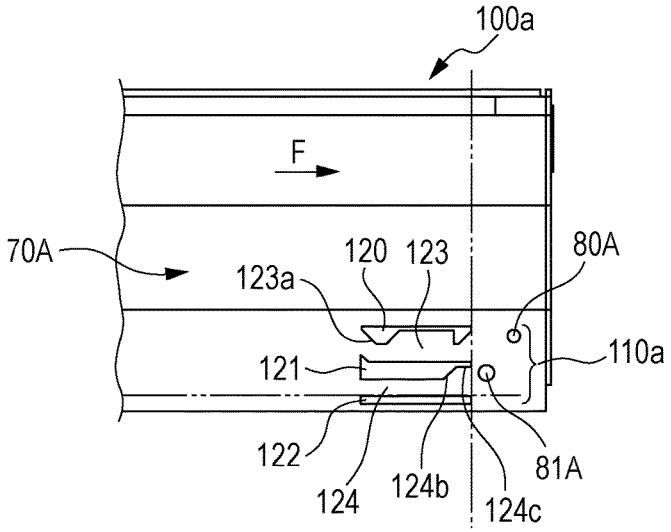
FIG. 13F is an explanatory view of the operation performed when the cartridge is inserted into the image forming apparatus main body according to the first embodiment.

When the second cartridge 70A is yet further inserted and, as illustrated in FIG. 13E, the fourth projecting portion 81A is moved to a position on the third inclined portion 124*b*, the first movable member 110*a* is moved in a second movement direction (arrow H), which is a downward direction, as the second cartridge 70A is inserted. More specifically, by supporting the surface of the first contact portion 120 facing the second contact portion 121 with the third projecting portion 80A, the first movable member 110*a* is urged downward by the restoring forces of the urging springs 111 and is moved downward as the second cartridge 70A is inserted. FIG. 13F illustrates a state in which the second cartridge 70A has been completely inserted into the first main body 100*a*. Thus, the second cartridge 70A can be inserted into the first main body 100*a*.

[Removal of the Second Cartridge from the First Main Body]

Figure 14A:
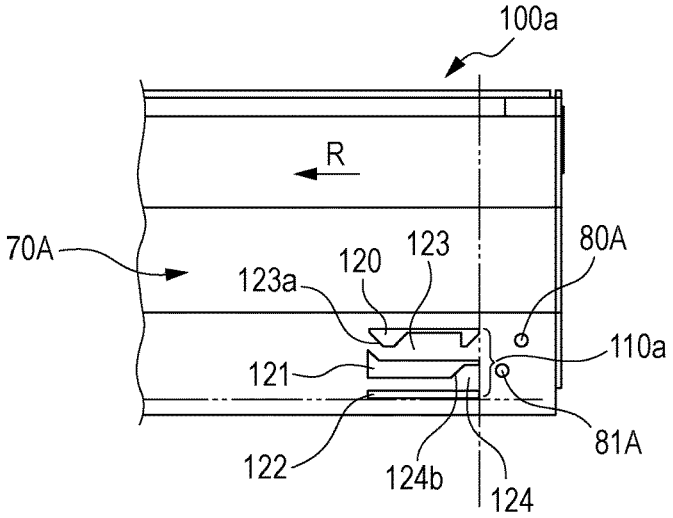
FIG. 14A is an explanatory view of an operation performed when the cartridge is removed from the image forming apparatus main body according to the first embodiment.

Next, the relationships between the third and fourth projecting portions 80A and 81*a* and the first movable member 110*a* when the second cartridge 70A is pulled in a removal direction R to be removed from the first main body 100*a* are described with reference to FIGS. 14A to 14F. Similarly to FIG. 13F, FIG. 14A illustrates a state in which the second cartridge 70A has been completely inserted into the first main body 100*a*.

Figure 14B:
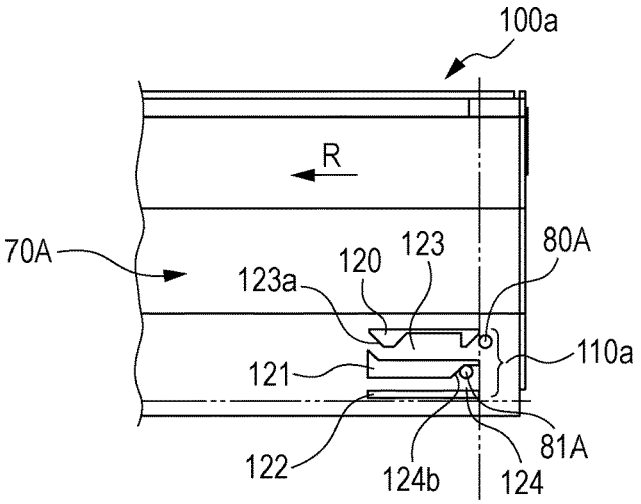
FIG. 14B is an explanatory view of the operation performed when the cartridge is removed from the image forming apparatus main body according to the first embodiment.
Figure 14C:
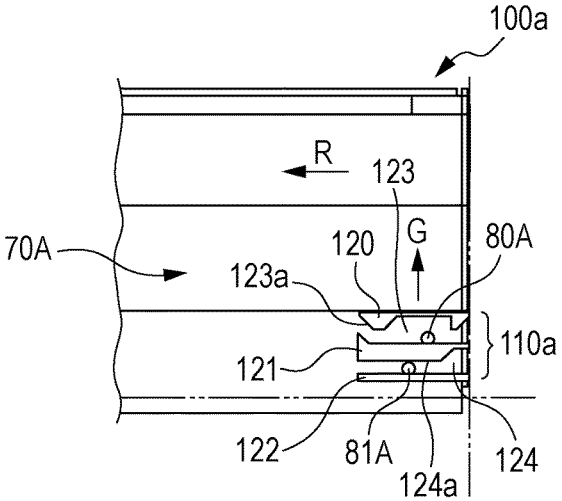
FIG. 14C is an explanatory view of the operation performed when the cartridge is removed from the image forming apparatus main body according to the first embodiment.

Initially, when the second cartridge 70A is pulled, the fourth projecting portion 81A is brought into engagement with the second recess portion 124 of the first movable member 110*a* and brought into contact with the second contact portion 121 of the second recess portion 124 as illustrated in FIG. 14B. That is, the fourth projecting portion 81A is brought into contact with the third inclined portion 124*b* of the second contact portion 121. Thus, the first movable member 110*a* receives a force from the second cartridge 70A through the fourth projecting portion 81A. This causes the first movable member 110*a* urged downward by the urging springs 111 to be moved upward (in the movement direction G). When the second cartridge 70A is further pulled, as illustrated in FIG. 14C, the fourth projecting portion 81A is brought into contact with the second flat portion 124*a* of the second contact portion 121. This causes the first movable member 110*a* to be moved to the second position. While the second cartridge 70A is being further pulled, the fourth projecting portion 81A supports the first movable member 110*a*. Thus, the second cartridge 70A is being removed while the first movable member 110*a* is held upward.

Figure 14D:
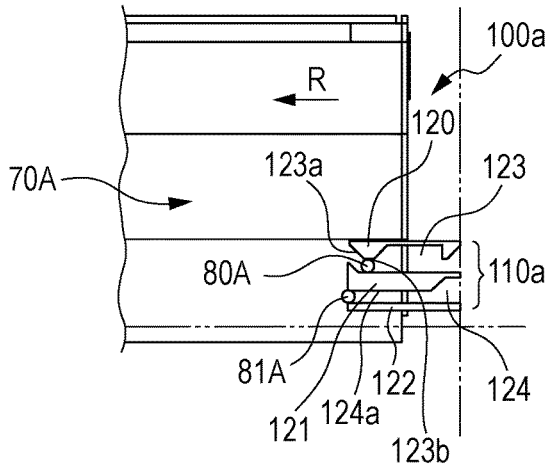
FIG. 14D is an explanatory view of the operation performed when the cartridge is removed from the image forming apparatus main body according to the first embodiment.
Figure 14E:
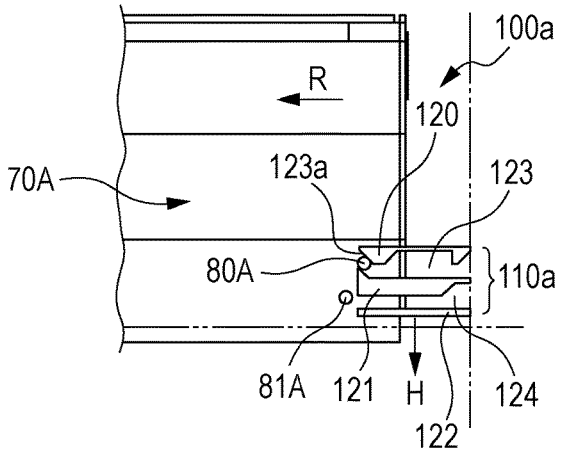
FIG. 14E is an explanatory view of the operation performed when the cartridge is removed from the image forming apparatus main body according to the first embodiment.

When the second cartridge 70A is yet further pulled, as illustrated in FIG. 14D, the third projecting portion 80A is brought into contact with and brought into engagement with the first recess portion 123. After that, the fourth projecting portion 81A is disengaged from the second recess portion 124. When the second cartridge 70A is yet further pulled and, as illustrated in FIG. 14E, the third projecting portion 80A is moved to a position on the first inclined portion 123*a*, the first movable member 110*a* is moved in the second movement direction (arrow H), which is the downward direction, as the second cartridge 70A is pulled. More specifically, by supporting the surface of the first contact portion 120 facing the second contact portion 121 with the third projecting portion 80A, the first movable member 110*a* urged downward by the restoring forces of the urging springs 111 is moved downward as the second cartridge 70A is pulled.

Figure 14F:
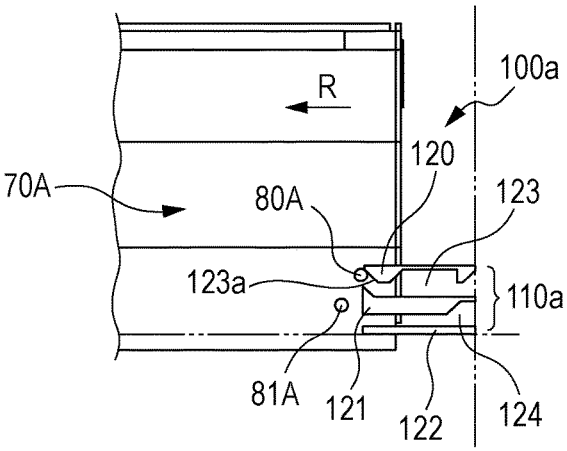
FIG. 14F is an explanatory view of the operation performed when the cartridge is removed from the image forming apparatus main body according to the first embodiment.

FIG. 14F illustrates a state in which the third and fourth projecting portions 80A and 81A are disengaged from the first and second recess portions 123 and 124 of the first movable member 110*a*, and the first movable member 110*a* is positioned at the first position. Thus, the second cartridge 70A can be removed from the first main body 100*a*.

Advantageous Effects

As described above, the first main body 100*a* includes the first movable member 110*a* having the first recess portion 123 and the second recess portion 124. Thus, an image forming system which realizes the following structure in a reduced space can be provided: a structure that prevents a wrong cartridge not operable with the first main body 100*a* from being attached and that allows a plurality of types of cartridges operable with the first main body 100*a* to be attached. More specifically, the distance between the first projecting portion 80*a* and the second projecting portion 81*a* of the first cartridge 70*a* is set to be greater than the first distance P in the insertion direction F. Furthermore, the distance between the first projecting portion 80*a* and the second projecting portion 81*a* is set to be greater than the first distance P and less than the second distance L, which is the sum of the first distance P and the length of the first flat portion 123*b*. Furthermore, the second cartridge 70A is used. The second cartridge 70A includes projecting portions, for example, the third projecting portion 80A and the fourth projecting portion 81A, in a manner in which the relationships between the projecting portions and the first inclined portion 123*a* are similar to those between the first and second projecting portions 80*a* and 81*a* of the first cartridge

70*a* and the first inclined portion 123*a*. Thus, the following structure can be realized in a reduced space: that is, a structure that allows a plurality of types of cartridges 70 operable with the first main body 100*a* to be inserted and that can prevent a wrong cartridge not matching to the image forming apparatus the main body from being attached. Furthermore, the two projecting portions can be used as visible identifiers, and accordingly, the types of the cartridges operable with and attachable to the first main body 100*a* can be easily identified.

Second Embodiment

A second embodiment has a structure developed from and different from that of the first embodiment. In the present embodiment, a cartridge that corresponds to a succeeding model of the first main body 100*a* with improved functions and performances can be attached to the first main body 100*a*. Meanwhile, this structure does not allow attachment of the first cartridge 70*a* that corresponds to the first main body 100*a*, the functions and the performance of which are lower than those of the succeeding models. That is, with the structure according to the present embodiment, attachment of the cartridge for a succeeding models not corresponding to the first main body 100*a* is prevented and attachment of the cartridge corresponding to the succeeding model to the first main body 100*a* and the succeeding model is allowed. The structures described hereafter use the first main body 100*a*, the first cartridge 70*a* operable with the first main body 100*a*, a second main body 100A serving as a succeeding model of the first main body 100*a*, and the second cartridge 70A operable with the second main body 100A. Description of the first main body 100*a*, the first cartridge 70*a* operable with the first main body 100*a*, and the second cartridge 70A is omitted because the structures of these components are the same as or similar to those described in the first embodiment. In the following, the difference between the first main body 100*a* and the second main body 100A and the relationships between the second main body 100A and the first and the second cartridges 70*a* and 70A are mainly described. The second embodiment of the present invention is described with reference to FIGS. 15 to 17B.

In the present embodiment, the second cartridge 70A operable with the second main body 100A can be attached to the first main body 100*a* as described in the first embodiment. In contrast, the first cartridge 70*a* operable with the first main body 100*a* cannot be attached to the second main body 100A. The structures of the first main body 100*a* and the second cartridge 70A are described with reference to FIG. 15.

The second main body 100A has a structure similar to that of the first main body 100*a* of the first embodiment. Similarly to FIG. 5, the first and second guides (not illustrated), the second movable member 110A, and urging springs (not illustrated) are provided in the second main body 100A. The first and second guides guide insertion of the second cartridge 70A. The second movable member 110A is movable. The urging springs urge the second movable member 110A to the first position. Also in the present embodiment, the second movable member 110A is urged downward in the second main body 100A by the urging springs so as to be positioned at the first position and is upwardly movable in the second main body 100A.

Figure 15:
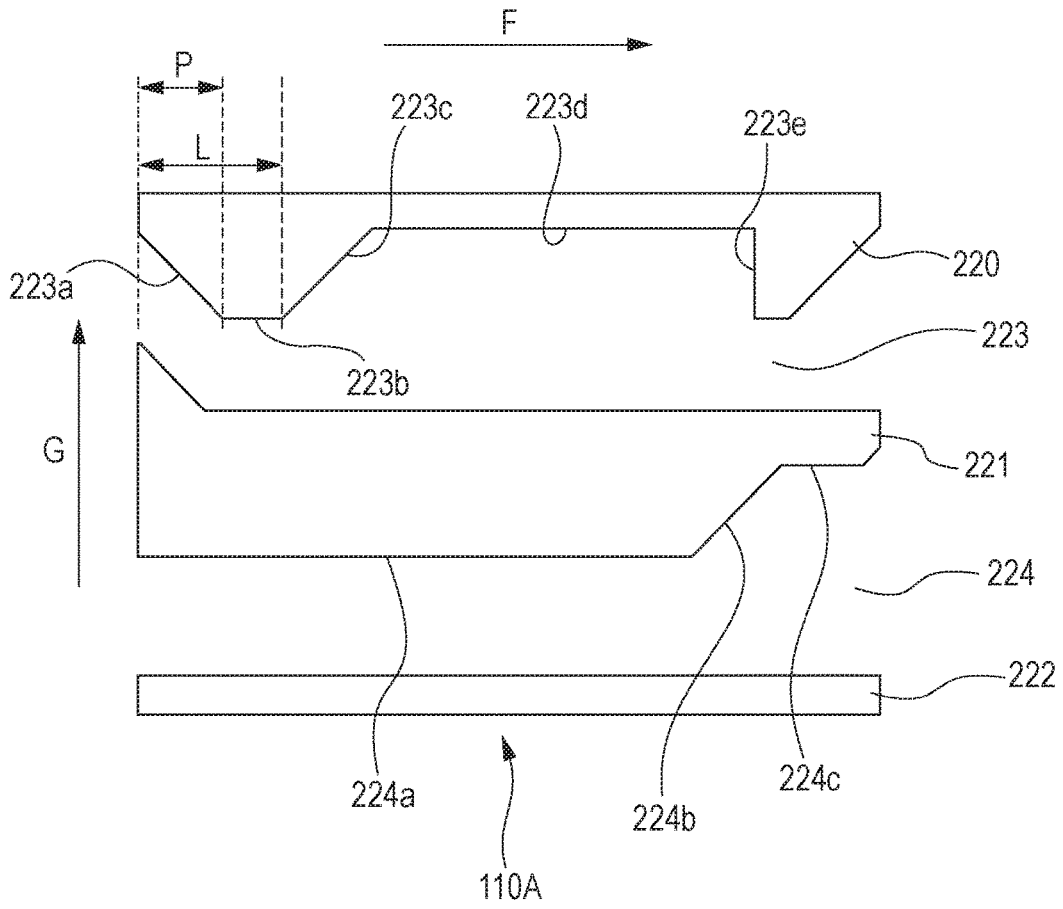
FIG. 15 is an explanatory view of a structure of a movable member according to a second embodiment.

As illustrated in FIG. 15, the second movable member 110A has a third recess portion 223 and a fourth recess portion 224. The third recess portion 223 is defined by a third contact portion 220 and a fourth contact portion 221. The fourth recess portion 224 is defined by the fourth contact portion 221 and a second entrance block portion 222. The second movable member 110A is structured such that the second movable member 110A is movable in an arrangement direction in which the third contact portion 220, the fourth contact portion 221, and the second entrance block portion 222 are arranged without changing relative positional relationships between the third contact portion 220, the fourth contact portion 221, and the second entrance block portion 222.

A fourth inclined portion 223*a*, a fourth flat portion 223*b*, a fifth inclined portion 223*c*, a second recessed surface portion 223*d*, and a second regulating portion 223*e* are provided in this order in the insertion direction F in the third recess portion 223, that is, on an upstream portion of the third contact portion 220 in the movement direction G. Specifically, the fourth inclined portion 223*a* is inclined toward the upstream side in the movement direction G as it extends toward the downstream side in the insertion direction F. The fourth flat portion 223*b* is connected to the fourth inclined portion 223*a* and extends substantially parallel to the insertion direction F. The fifth inclined portion 223*c* is inclined toward the downstream side in the movement direction G as it extends toward the downstream side in the insertion direction F. The second regulating portion 223*e*, which is perpendicular to the insertion direction F, that is, substantially parallel to the movement direction G, is continuous with the second recessed surface portion 223*d*, which is substantially parallel to the insertion direction F. Likewise, a fifth flat portion 224*a*, a sixth inclined portion 224*b*, and a sixth flat portion 224*c* are provided in this order in the insertion direction F in the fourth recess portion 224, that is, on an upstream surface of the fourth contact portion 221 in the movement direction G. Specifically, the fifth flat portion 224*a* and the sixth flat portion 224*c* are substantially parallel to the insertion direction F. The sixth inclined portion 224*b* is inclined toward the downstream side in the movement direction G as it extends toward the downstream side in the insertion direction F.

Figure 16B:
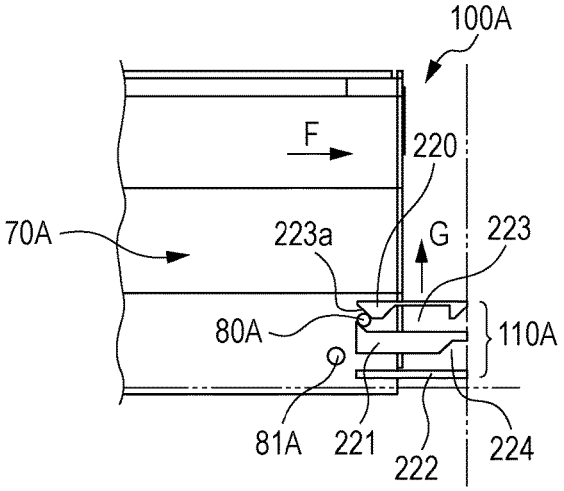
FIG. 16B is an explanatory view of the operation performed when the cartridge is inserted into the image forming apparatus main body according to the second embodiment.
Figure 16C:
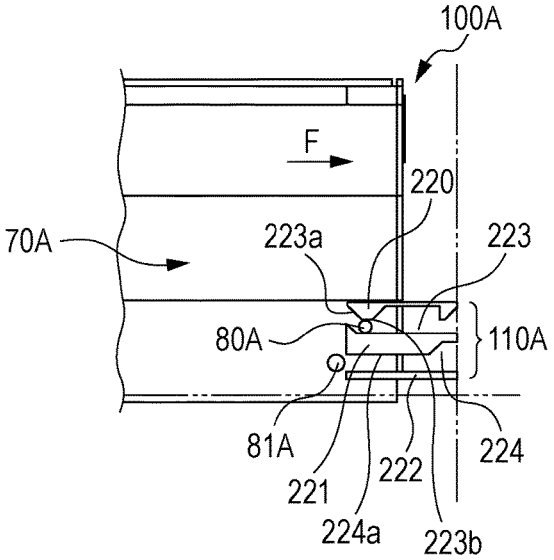
FIG. 16D is an explanatory view of the operation performed when the cartridge is inserted into the image forming apparatus main body according to the second embodiment.
FIG. 16E is an explanatory view of the operation performed when the cartridge is inserted into the image forming apparatus main body according to the second embodiment.
FIG. 16F is an explanatory view of the operation performed when the cartridge is inserted into the image forming apparatus main body according to the second embodiment.
Figure 16D:
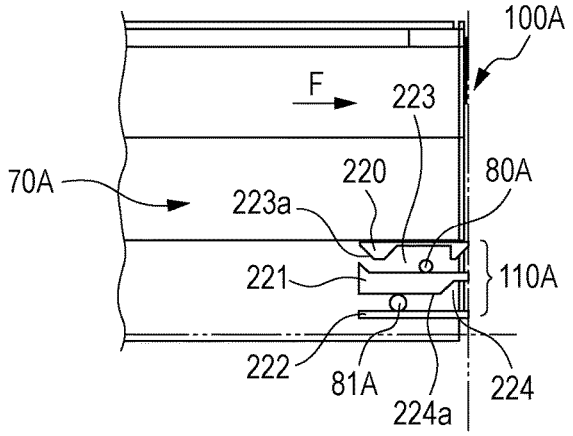
Figure 16E:
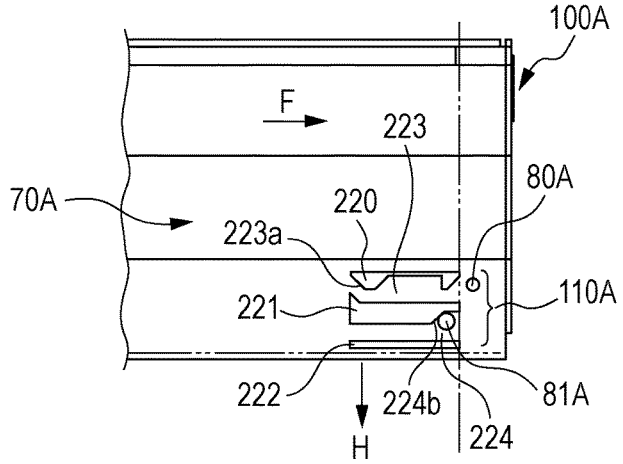
Figure 16F:
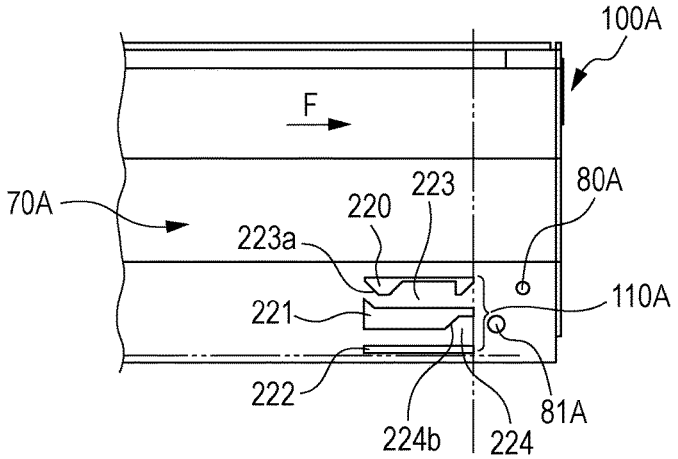

As illustrated in FIG. 16B, the width of the inside of the third recess portion 223 formed by the third contact portion 220 and the fourth contact portion 221 in the arrangement direction is greater than that of the third projecting portion 80A, thereby allowing the third projecting portion 80A to enter the third recess portion 223. Likewise, the width of the inside of the fourth recess portion 224 formed by the fourth contact portion 221 and the second entrance block portion 222 in the arrangement direction is, as illustrated in FIG. 16C, greater than that of the fourth projecting portion 81A, thereby allowing the fourth recess portion 224 to be engaged with the fourth projecting portion 81A. That is, in the arrangement direction, the width inside the third recess portion 223 of the second main body 100A is different from the width inside the first recess portion 123 of the first main body 100*a*. More specifically, in the arrangement direction, the thickness of the fourth contact portion 221 is increased compared to that of the second contact portion 121. That is, compared to the first movable member 110*a*, a gap between the third contact portion 220 and the fourth contact portion 221 of the second movable member 110A in the movement direction G is reduced. The position and the size of the surface of the fourth contact portion 221 of the second main body 100A provided on the downstream side in the movement direction G are made to be the same as or similar to those of the second contact portion 121 of the first main body 100*a*.

[Attachment of the Second Cartridge to the Second Main Body]

Next, the relationships between the third and fourth projecting portions 80A and 81A and the second movable member 110A of the second main body 100A during attachment of the second cartridge 70A to the second main body 100A by inserting the second cartridge 70A in the insertion direction F are described. Similarly to the first embodiment illustrated in FIGS. 7A to 7F, the second movable member 110A is provided in the second main body 100A as illustrated in FIGS. 16A to 16F. The third and fourth projecting portions 80A and 81A are respectively to be engaged with the third and fourth recess portions 223 and 224, and as the second cartridge 70A is inserted, the second movable member 110A is moved from the first position to the second position. Thus, the second cartridge 70A can be inserted into the attachment position D (see FIG. 4B) of the second main body 100A.

Furthermore, the relationships between the second movable member 110A, the third and fourth projecting portions 80A and 81A, and the third and fourth recess portions 223 and 224 when removing the second cartridge 70A from the second main body 100A by pulling the second cartridge 70A in the removal direction R are described. Similarly to the first embodiment illustrated in FIGS. 8A to 8F, the third and fourth projecting portions 80A and 81A are brought into engagement with the third and fourth recess portions 223 and 224 of the second movable member 110A of the second main body 100A, and the second movable member 110A is moved from the first position to the second position. The second cartridge 70A is pulled from the attachment position D (see FIG. 4B) of the second main body 100A as described above, and accordingly, removable from the second main body 100A. Thus, the second cartridge 70A is attachable to and removable from the second main body 100A.

[Attachment of the First Cartridge to the Second Main Body]

Next, the relationships between the second movable member 110A of the second main body 100A and the first projecting portion 80*a* of the first cartridge 70*a* during attachment of the first cartridge 70*a* to the second main body 100A by inserting the first cartridge 70*a* in the insertion direction F are described with reference to FIGS. 17A and 17B.

Figure 17A:
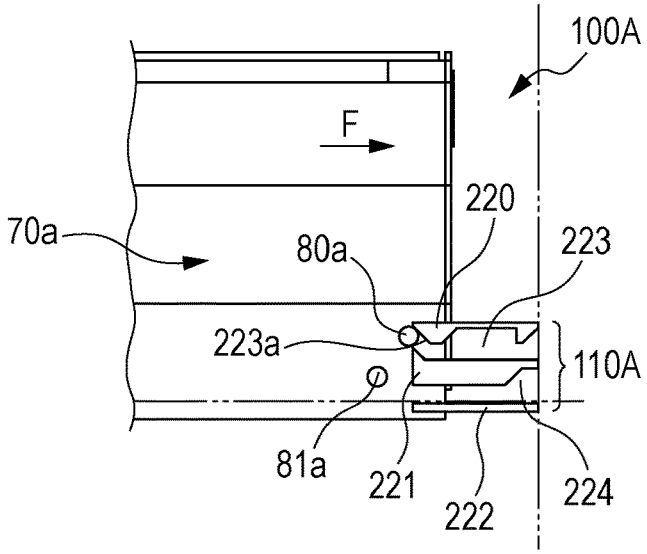
FIG. 17A is an explanatory view of the operation performed when the cartridge is inserted into the image forming apparatus main body according to the second embodiment.
Figure 17B:
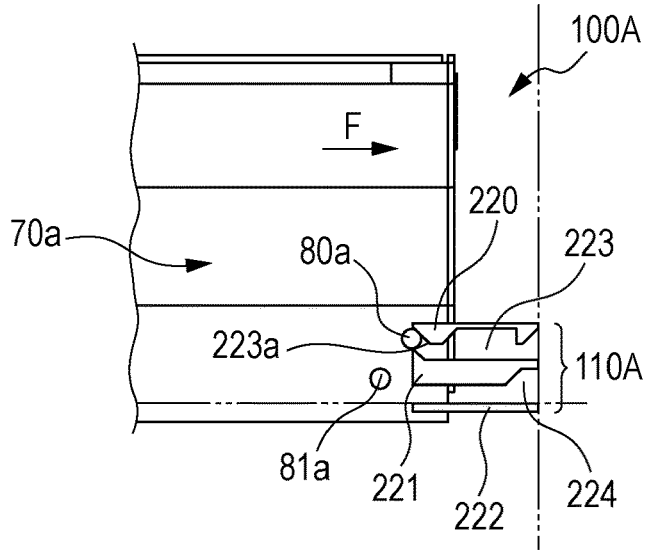
FIG. 17B is an explanatory view of the operation performed when the cartridge is inserted into the image forming apparatus main body according to the second embodiment.

As illustrated in FIG. 17A, when the first cartridge 70*a* is initially moved in the insertion direction F, the first projecting portion 80*a* and the third recess portion 223 of the second movable member 110A are brought into engagement with each other. When the first cartridge 70*a* is further inserted, the first projecting portion 80*a* is brought into contact with the fourth inclined surface 223*a* provided at the entrance of the third recess portion 223 as illustrated in FIG. 17B. More specifically, the first projecting portion 80*a* is brought into contact with the third contact portion 220 of the second movable member 110A. Thus, the second movable member 110A receives a force from the first cartridge 70*a*. This causes the second movable member 110A urged downward by the urging springs (not illustrated) to be moved upward (in the movement direction G). However, with respect to the movement direction G, the first projecting portion 80*a* of the first cartridge 70*a* is larger than the entrance of the third recess portion 223 of the second movable member 110A of the second main body 100A. Thus, when the first cartridge 70*a* is inserted, the first projecting portion 80*a* is caught by the third recess portion 223. Accordingly, the first cartridge 70*a* cannot be inserted into the second main body 100A.

Advantageous Effects

As described above, as is the case with the first embodiment, the second cartridge 70A in addition to the first cartridge 70*a* is attachable to and removable from the first main body 100*a* while attachment of a cartridge not operable with the main body is prevented. In contrast, the first cartridge 70*a*, which is a cartridge other than the second cartridge 70A, cannot be attached to the second main body 100A. Thus, an image forming system which realizes the following structure in a reduced space can be provided: a structure that prevents a wrong cartridge from being attached to the main body, that allows the cartridge corresponding to the succeeding model to be attached, and that prevents the cartridge corresponding to the existing model from being attached to the succeeding model. Furthermore, the two projecting portions can be used as visible identifiers, and accordingly, the type of the cartridge operable with and attachable to the main body can be easily identified.

Third Embodiment

According to a third embodiment, the effects similar to the effects obtained by the first embodiment can be obtained with a different structure. In the following, a third main body 100*d*, a third cartridge 70*d* corresponding to and operable with the third main body 100*d*, and a structure that uses the third cartridge 70*d* operable with the third main body 100*d* are described.

General structures of the entirety of the third main body 100*d* and the third cartridge 70*d* and the entirety of the third cartridge 70*d* according to the third embodiment are similar to the structures described in the first embodiment, and description thereof is omitted. In the following, the difference between the third main body 100*d* and the first main body 100*a*, the difference between the third cartridge 70*d* and the second cartridge 70A, and the relationships between the third main body 100*d* and the third cartridge 70*d* are mainly described. The third embodiment according to the present invention is described below with reference to FIGS. 18 to 23B.

The section of the third projecting portion 80A in a plane specified by the insertion direction F and the movement direction G has a circular shape in the example described in the first embodiment. In the present embodiment, the shape of this section is a shape other than a circle, that is, this section has a non-circular shape such as an ellipse, or a rectangle or a polygon chamfered so as to form curved surfaces. In the following, a structure using the third main body 100*d* and the third cartridge 70*d* corresponding to and operable with the third main body 100*d* is described.

Similarly to FIGS. 4A, 4B, and 5, the first and second guides (not illustrated), a third movable member 110*d*, and urging springs (not illustrated) are provided in the third main body 100*d*. The first and second guide portions guide insertion of the third cartridge 70*d*. The third movable member 110*d* is movable. The urging springs urge the third movable member 110*d* to the first position. Also in the present embodiment, the third movable member 110*d* is urged downward in the third main body 100*d* by the urging springs so as to be positioned at the first position and is upwardly movable in the third main body 100*d*.

Figure 18:
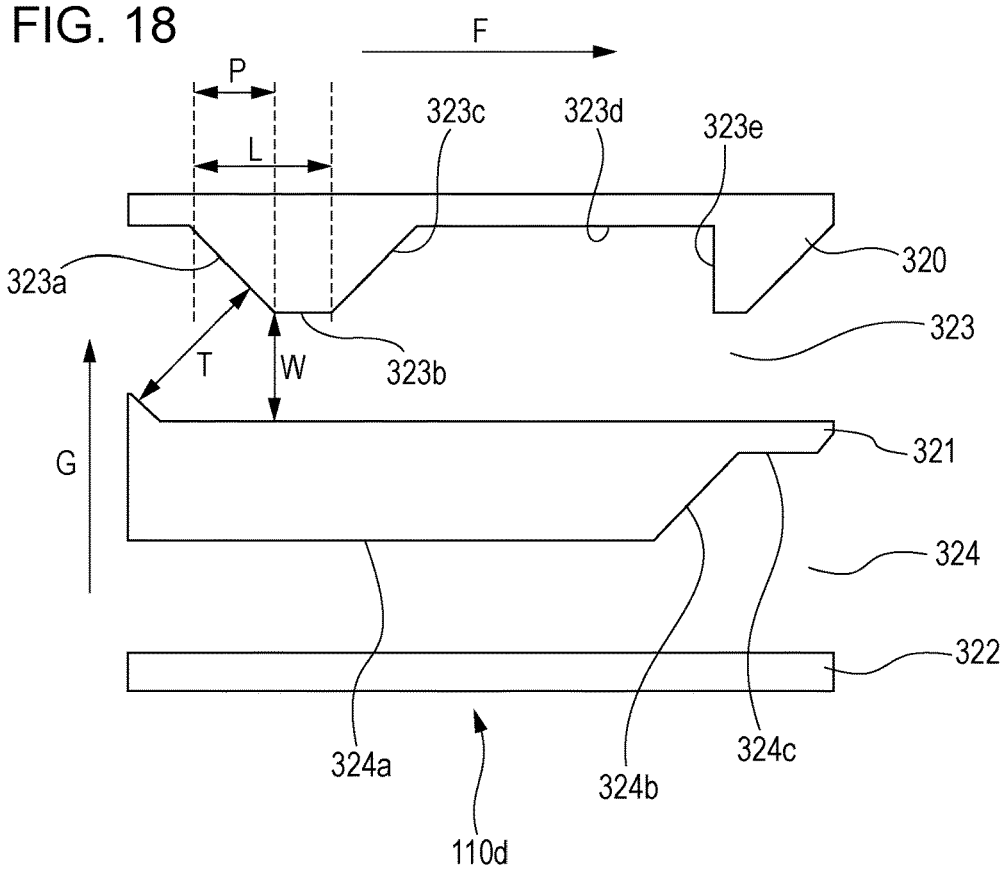
FIG. 18 is an explanatory view of a structure of a movable member according to a third embodiment.

As illustrated in FIG. 18, the third movable member 110*d* has a fifth recess portion 323 and a sixth recess portion 324. The fifth recess portion 323 is defined by a fifth contact portion 320 and a sixth contact portion 321. The sixth recess portion 324 is defined by the sixth contact portion 321 and a third entrance block portion 322. The fifth recess portion 323 is formed by the fifth contact portion 320 and the sixth contact portion 321. The sixth recess portion 324 is formed by the sixth contact portion 321 and the third entrance block portion 322.

A seventh inclined portion 323*a*, a seventh flat portion 323*b*, an eighth inclined portion 323*c*, a third recessed surface portion 323*d*, and a third regulating portion 323*e* are provided in this order in the insertion direction F in the fifth recess portion 323, that is, on an upstream portion of the fifth contact portion 320 in the movement direction G. Specifically, the seventh inclined portion 323*a* is inclined toward the downstream side in the movement direction G as it extends toward the downstream side in the insertion direction F. The seventh flat portion 323*b* is connected to the seventh inclined portion 323*a* and extends substantially parallel to the insertion direction F. The eighth inclined portion 323*c* is inclined toward the downstream side in the movement direction G as it extends toward the downstream side in the insertion direction F. The third regulating portion 323*e*, which is perpendicular to the insertion direction F, that is, substantially parallel to the movement direction G, is continuous with the third recessed surface portion 323*d*, which is substantially parallel to the insertion direction F.

With respect to the movement direction G, a width T is greater than a width W in the fifth recess portion 323. The width T is a width of the inside of the fifth recess portion 323 in a direction perpendicular to the seventh inclined portion 323*a*. The width W is a width of the inside of the fifth recess portion 323 in the movement direction G at an end portion on the downstream side of the seventh inclined portion 323*a* in the insertion direction F.

An eighth flat portion 324*a*, a ninth inclined portion 324*b*, and a ninth flat portion 324*c* are provided in this order in the insertion direction F in the sixth recess portion 324, that is, on an upstream portion of the sixth contact portion 321 in the movement direction G. Specifically, the eighth flat portion 324*a* and the ninth flat portion 324*c* are substantially parallel to the insertion direction F. The ninth inclined portion 324*b* is inclined toward the downstream side in the movement direction G as it extends toward the downstream side in the insertion direction F.

Figure 19:
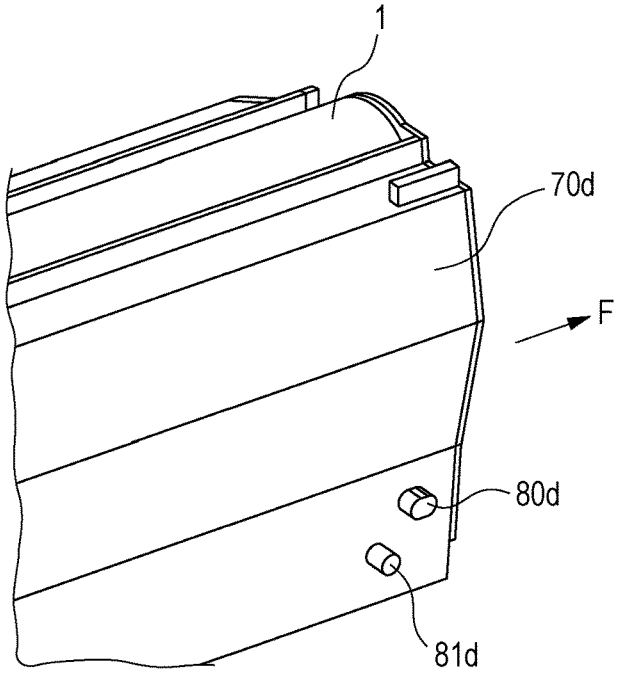
FIG. 19 is an explanatory view of fifth and sixth projecting portions of a cartridge according to the third embodiment.
Figure 20A:
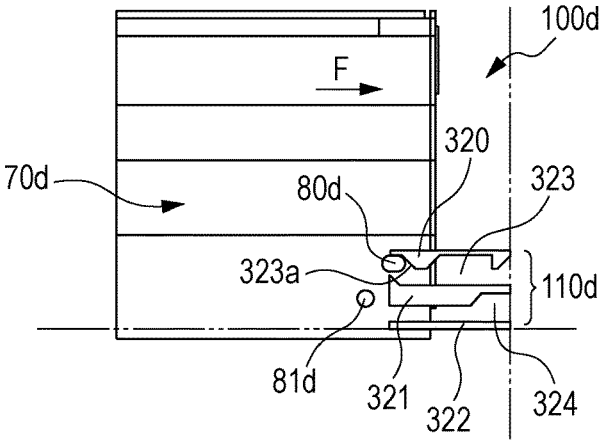
FIG. 20A is an explanatory view of an operation performed when a cartridge is inserted into an image forming apparatus main body according to the third embodiment.
Figure 20B:
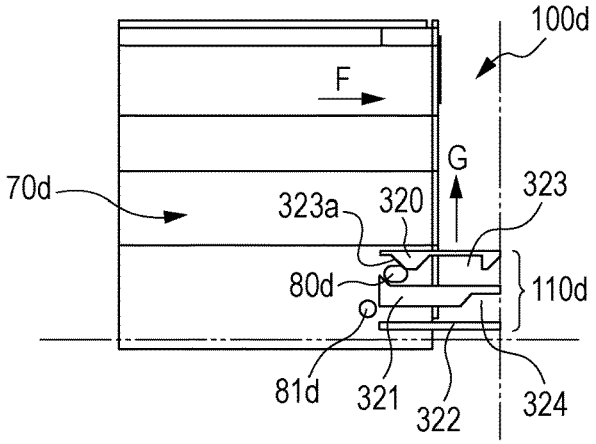
FIG. 20B is an explanatory view of the operation performed when the cartridge is inserted into the image forming apparatus main body according to the third embodiment.
Figure 20C:
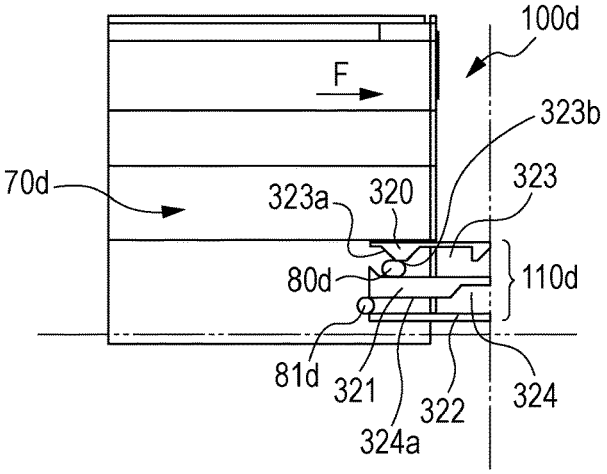
FIG. 20C is an explanatory view of the operation performed when the cartridge is inserted into the image forming apparatus main body according to the third embodiment.
Figure 20D:
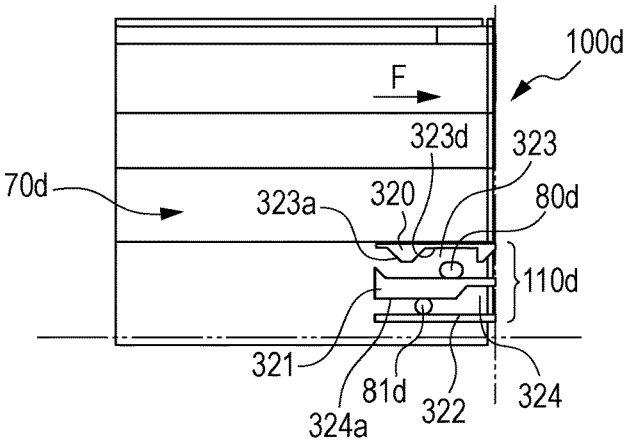
FIG. 20D is an explanatory view of the operation performed when the cartridge is inserted into the image forming apparatus main body according to the third embodiment.
Figure 20E:
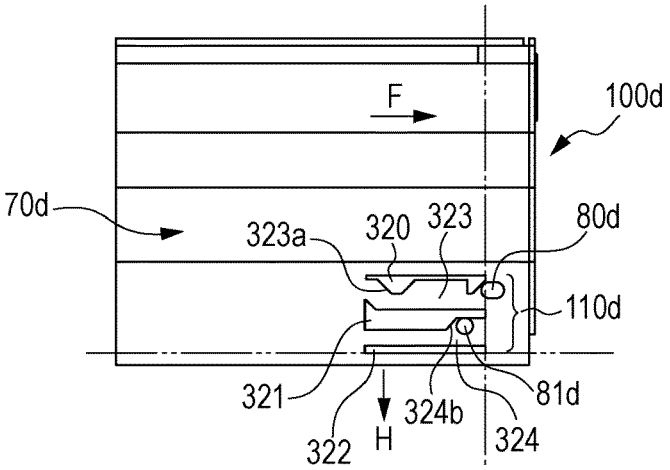
FIG. 20E is an explanatory view of the operation performed when the cartridge is inserted into the image forming apparatus main body according to the third embodiment.
Figure 20F:
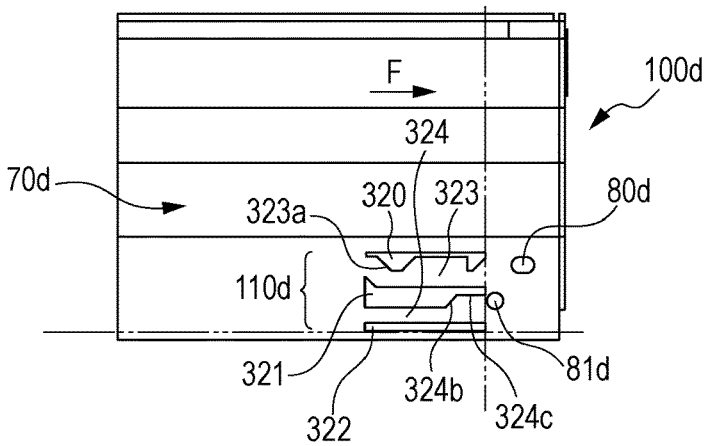
FIG. 20F is an explanatory view of the operation performed when the cartridge is inserted into the image forming apparatus main body according to the third embodiment.
Figure 21A:
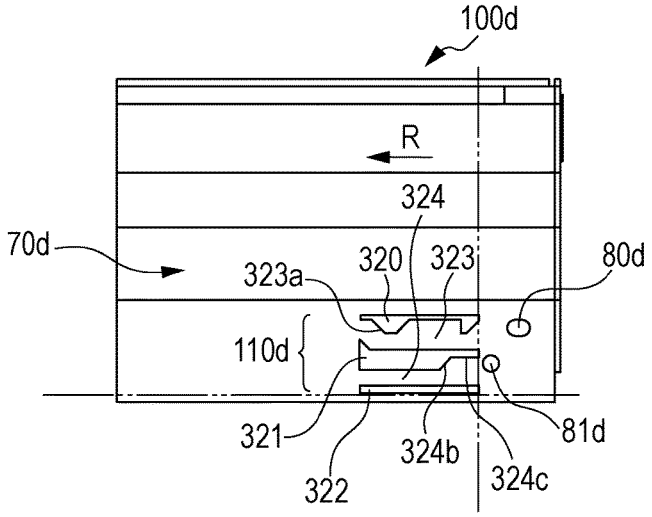
FIG. 21A is an explanatory view of an operation performed when the cartridge is removed from the image forming apparatus main body according to the third embodiment.
Figure 21B:
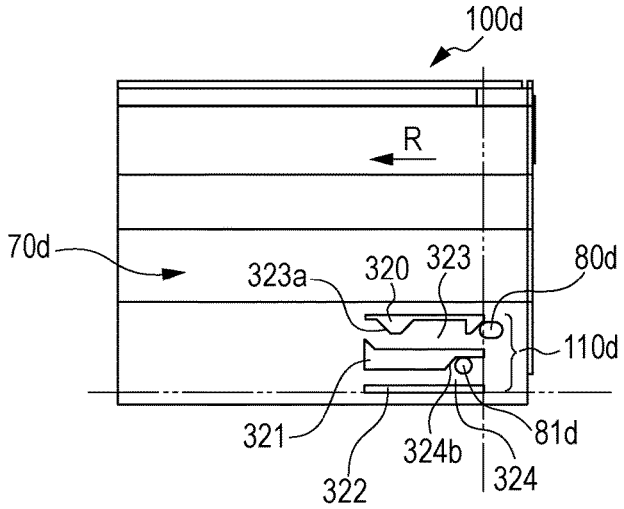
FIG. 21B is an explanatory view of the operation performed when the cartridge is removed from the image forming apparatus main body according to the third embodiment.
Figure 21C:
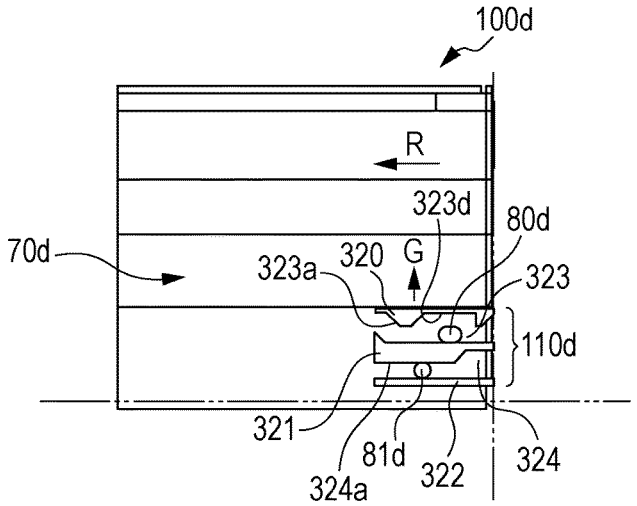
FIG. 21C is an explanatory view of the operation performed when the cartridge is removed from the image forming apparatus main body according to the third embodiment.
Figure 21D:
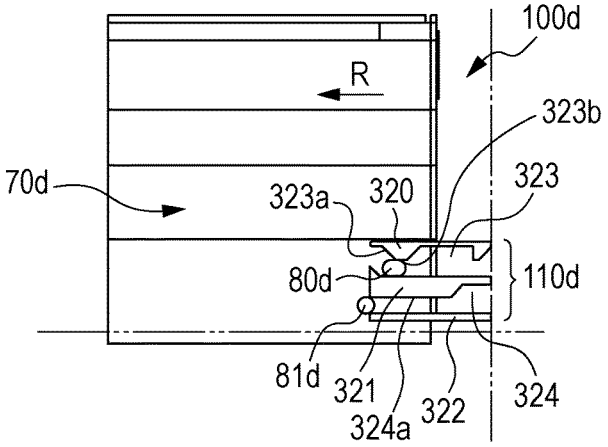
FIG. 21D is an explanatory view of the operation performed when the cartridge is removed from the image forming apparatus main body according to the third embodiment.
Figure 21E:
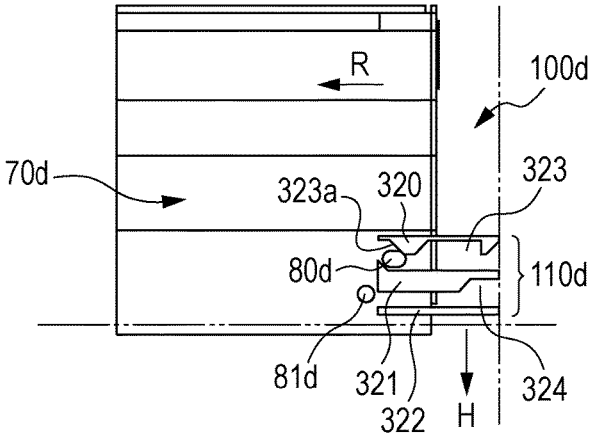
FIG. 21E is an explanatory view of the operation performed when the cartridge is removed from the image forming apparatus main body according to the third embodiment.
Figure 21F:
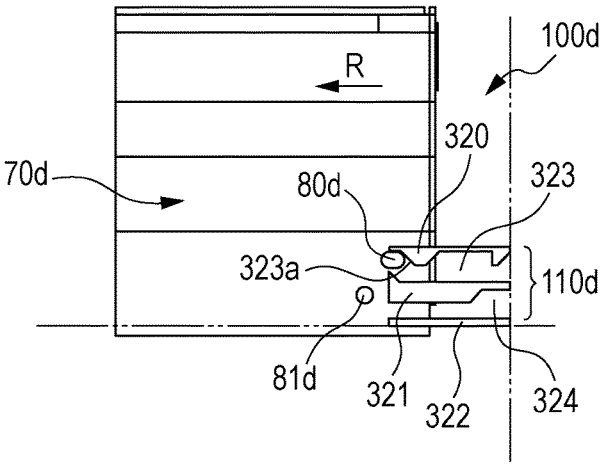
FIG. 21F is an explanatory view of the operation performed when the cartridge is removed from the image forming apparatus main body according to the third embodiment.

As illustrated in FIG. 19, the fifth projecting portion 80*d* and the sixth projecting portion 81*d* are provided on the third cartridge 70*d* such that the fifth projecting portion 80*d* and the sixth projecting portion 81*d* project in a direction intersecting the insertion direction F. In the present embodiment, the section of the fifth projecting portion 80*d* in a plane specified by the insertion direction F and the movement direction G has a chamfered rectangular shape the long side of which extends in the insertion direction F and the short side of which extends in the movement direction G, and the section of the sixth projecting portion 81*d* in the plane specified by the insertion direction F and the movement direction G has a circular shape. The sections of the fifth projecting portion 80*d* and the sixth projecting portion 81*d* in the plane specified by the insertion direction F and the movement direction G may have shapes other than the above-described shape, that is, a non-circular shape including an ellipse, and a rectangle or a polygon chamfered so as to form curved surfaces. The fifth projecting portion 80*d* is disposed on a downstream side in the insertion direction F, and the sixth projecting portion 81*d* is disposed upstream of the fifth projecting portion 80*d* in the insertion direction F.

In the movement direction G, the width of the fifth recess portion 323 is greater than the width of the fifth projecting portion 80*d* of the third cartridge 70*d* operable with the third main body 100*d*. Likewise in the movement direction G, the width of the sixth recess portion 324 is greater than the width of the sixth projecting portion 81*d*. Regarding the fifth and sixth projecting portions 80*d* and 81*d*, the sixth projecting portion 81*d* becomes engageable with the sixth recess portion 324 when the fifth projecting portion 80*d* is moved to an end portion of the seventh inclined portion 323*a* on the upstream side in the movement direction G. That is, in the insertion direction F, the distance between the fifth projecting portion 80*d* and the sixth projecting portion 81*d* is greater than the first distance P and less than the second distance L, which is the sum of the first distance P and the length of the seventh flat portion 323*b* (see FIG. 18).

[Structure for Attaching and Detaching the Third Cartridge to and from the Third Main Body]

Next, the relationships between the fifth and sixth projecting portions 80*d* and 81*d* and the fifth and sixth recess portions 323 and 324 during attachment of the third cartridge 70*d* to the third main body 100*d* by inserting the third cartridge 70*d* in the insertion direction F are described. As is the case with the first embodiment, the third cartridge 70*d* is inserted into the third main body 100*d* along the first and second guide portions (not illustrated). As illustrated in FIGS. 20A to 20F, as the fifth and sixth projecting portions 80*d* and 81*d* are brought into engagement with the fifth and sixth recess portions 323 and 324 and the third cartridge 70*d* is inserted, the third movable member 110*d* is moved from the first position to the second position. Thus, the third cartridge 70*d* can be inserted into the attachment position D (see FIG. 4B) of the third main body 100*d*.

Furthermore, the relationships between the fifth and sixth projecting portions 80*d* and 81*d* and the fifth and sixth recess portions 323 and 324 when the third cartridge 70*d* is removed from the third main body 100*d* by pulling the third cartridge 70*d* in the removal direction R are described. Similarly to the first embodiment illustrated in FIGS. 8A to 8F, as illustrated in FIGS. 21A to 21F, as the fifth and sixth projecting portions 80*d* and 81*d* are brought into engagement with the fifth and sixth recess portions 323 and 324 and the third cartridge 70*d* is pulled, the third movable member 110*d* is moved from the first position to the second position. The third cartridge 70*d* is pulled from the attachment position D (see FIG. 4B) of the third main body 100*d* as described above, and accordingly, removable from the third main body 100*d*. Thus, the third cartridge 70*d* can be attached to and removed from the third main body 100*d*.

[Fourth Cartridge Attachable to Third Main Body]

Next, a fourth cartridge 70D, which can be attached to the third main body 100*d*, is described, and after that, the relationships between a seventh and eighth projecting portions 80D and 81D provided on the fourth cartridge 70D and the fifth and sixth recess portions 323 and 324 provided in the third main body 100*d* are described.

The fourth cartridge 70D has an eighth projecting portion 81D in addition to a seventh projecting portion 80D having a shape different from that of the fifth projecting portion 80*d*. Specifically, the section of the fifth projecting portion 80*d* in a plane determined by the insertion direction F and the movement direction G has a non-circular shape. The section of the seventh projecting portion 80D has a shape the length of which in the movement direction G is substantially the same as that of the fifth projecting portion 80*d* and the length of which in the insertion direction F is less than that of the fifth projecting portion 80*d*. The seventh projecting portion 80D and eighth projecting portion 81D are provided on the fourth cartridge 70D such that the seventh projecting portion 80D and the eighth projecting portion 81D project in a direction intersecting the insertion direction F. The seventh projecting portion 80D is disposed on the upstream side in the insertion direction F of the cartridge, and the eighth projecting portion 81D is disposed downstream of the seventh projecting portion 80D in the insertion direction F of the cartridge. Furthermore, the seventh projecting portion 80D has a shape that can enter the fifth recess portion 323. More specifically, the seventh projecting portion 80D is equal to the width W of the inside of the fifth recess portion 323 in the movement direction G and equal to or less than the width T of the inside of the fifth recess portion 323 in a direction perpendicular to the seventh inclined portion 323*a* (see FIG. 18).

Furthermore, regarding the seventh projecting portion 80D and eighth projecting portion 81D, when the fourth cartridge 70D is inserted along the first and second guide portions (not illustrated) and the seventh projecting portion 80D is moved to an end portion of the seventh inclined portion 323*a* on the upstream side in the movement direction G, the eighth projecting portion 81D is engageable with the sixth recess portion 324. That is, in the insertion direction F, the distance between the seventh projecting portion 80D and the eighth projecting portion 81D is greater than the first distance P, by which the third movable member 110*d* is moved from the first position to the second position by using the seventh inclined portion 323*a*, and less than the second distance L, which is the sum of the first distance P and the length of the seventh flat portion 323*b*.

In the present embodiment, the first main body 100*a* and the cartridge 70*a* of the first embodiment illustrated in FIGS. 4A to 6 are used as a fourth main body 100D and the fourth cartridge 70D. In the first main body 100*a*, the width W of the inside of the first recess portion 123 in the movement direction G at an end portion of the first inclined portion 123*a* on the downstream side in the insertion direction F and the width T of the inside of the first recess portion 123 in a direction perpendicular to the first inclined portion 123*a* are the same. That is, the first main body 100*a* corresponds to the fourth main body 100D in which the width T of the inside of the fifth recess portion 323 in a direction perpendicular to the seventh inclined portion 323*a* is minimized.

[Structure for Attaching and Detaching the Fourth Cartridge to and from the Third Main Body]

Figure 22A:
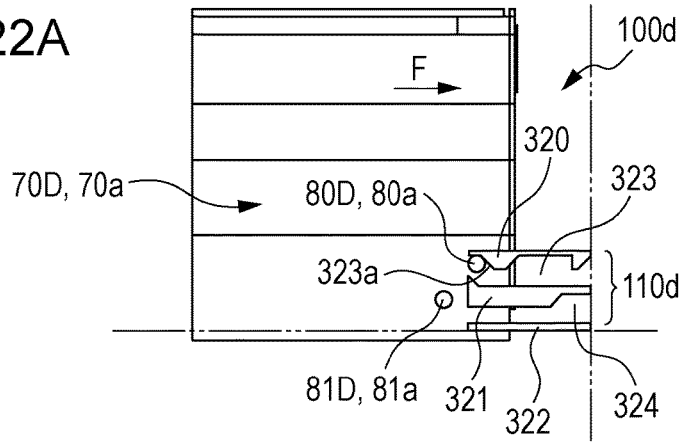
FIG. 22A is an explanatory view of an operation performed when the cartridge is inserted into an image forming apparatus main body according to the third embodiment.
Figure 22B:
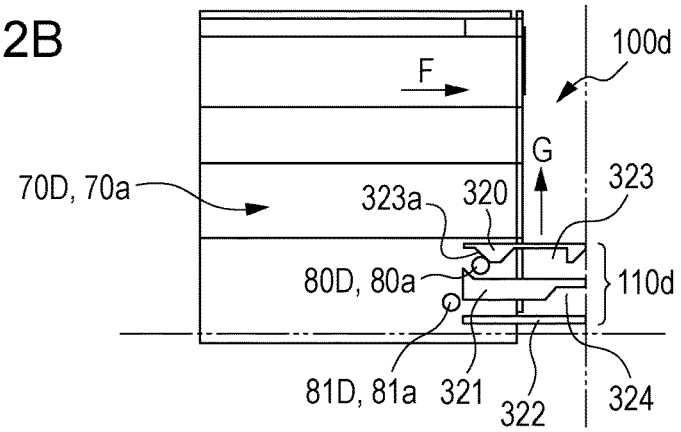
FIG. 22B is an explanatory view of the operation performed when the cartridge is inserted into the image forming apparatus main body according to the third embodiment.
Figure 22C:
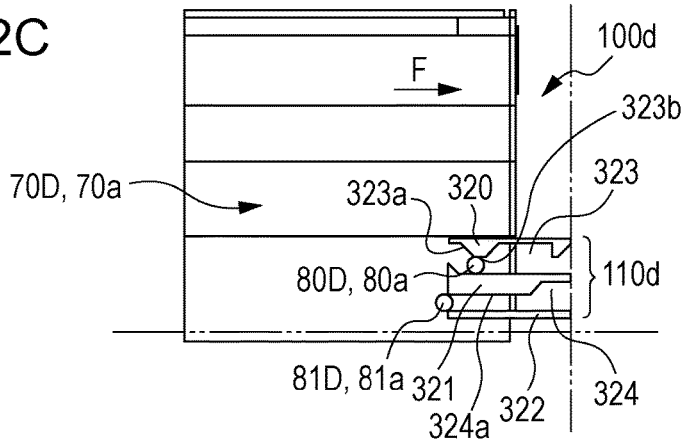
FIG. 22C is an explanatory view of the operation performed when the cartridge is inserted into the image forming apparatus main body according to the third embodiment.
Figure 22D:
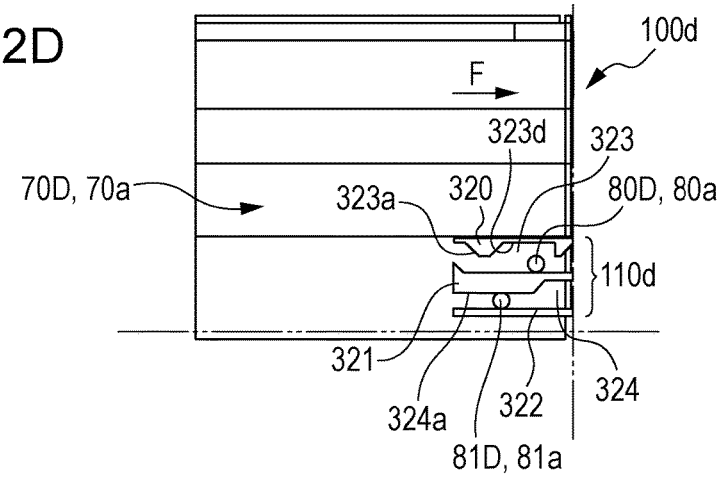
FIG. 22D is an explanatory view of the operation performed when the cartridge is inserted into the image forming apparatus main body according to the third embodiment.
Figure 22E:
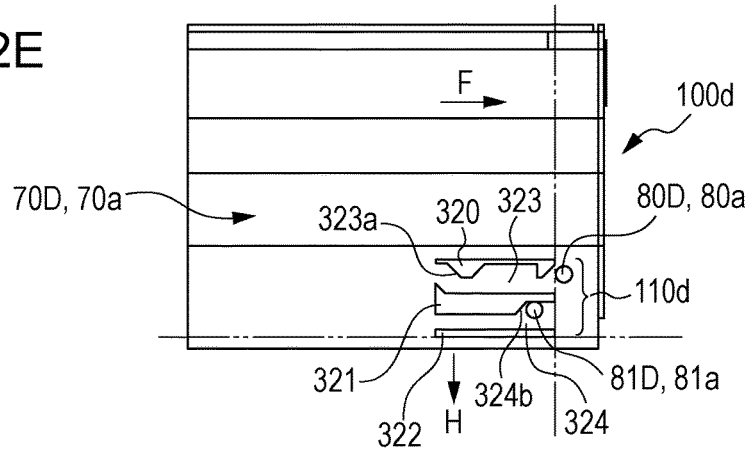
FIG. 22E is an explanatory view of the operation performed when the cartridge is inserted into the image forming apparatus main body according to the third embodiment.
Figure 22F:
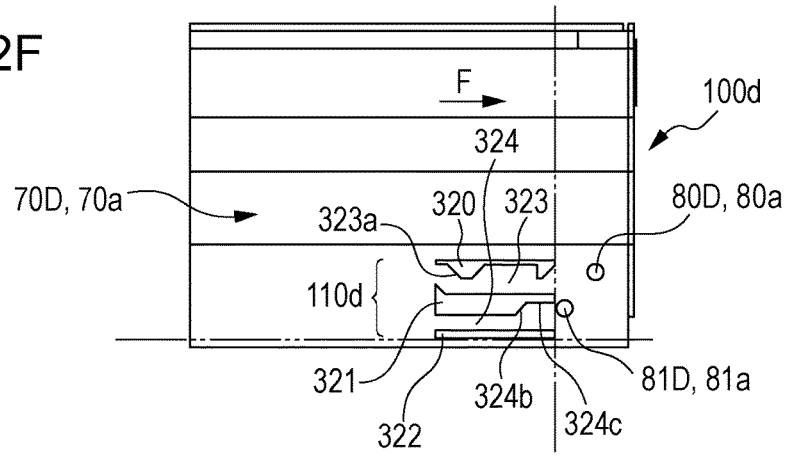
FIG. 22F is an explanatory view of the operation performed when the cartridge is inserted into the image forming apparatus main body according to the third embodiment.

Next, the relationships between the first and second projecting portions 80*a* and 81*a* and the fifth and sixth recess portions 323 and 324 during attachment of the cartridge 70*a* to the third main body 100*d* by inserting the cartridge 70*a* in the insertion direction F are described with reference to FIGS. 22A to 22F. As illustrated in FIGS. 22A to 22F, as the first and second projecting portions 80*a* and 81*a* are brought into engagement with the fifth and sixth recess portions 323 and 324 and the cartridge 70*a* is inserted, the third movable member 110*d* is moved from the first position to the second position similarly to the first embodiment illustrated in FIGS. 7A to 7F. As illustrated in FIG. 22B, the first projecting portion 80*a* is brought into contact with the fifth contact portion 320 and is moved from the first position to the second position by the seventh inclined portion 323*a* similarly to FIG. 21B. However, there is a difference in that the distance between the first projecting portion 80*a* and the sixth contact portion 321 is greater than the distance between the fifth projecting portion 80*d* and the sixth contact portion 321. That is, the width of an end portion of the seventh inclined portion 323*a* on the movement side in the insertion direction F, that is, the width of the seventh flat portion 323*b* in the movement direction G is made to allow a cartridge 70 to be inserted into the attachment position D (see FIG. 4B) of the third main body 100*d*.

Furthermore, the relationships between the first and second projecting portions 80*a* and 81*a* and the fifth and sixth recess portions 323 and 324 when the cartridge 70*a* is removed from the third main body 100*d* by pulling the cartridge 70*a* in the removal direction R are described. Similarly to the first embodiment illustrated in FIGS. 8A to 8F, as the first and second projecting portions 80*a* and 81*a* are brought into engagement with the fifth and sixth recess portions 323 and 324 of the third movable member 110*d* and the cartridge 70*a* is pulled, a movement from the first position to the second position is performed. The cartridge 70*a* is pulled from the attachment position D (see FIG. 4B) of the third main body 100*d* as described above, and accordingly, removable from the third main body 100*d*. Thus, the cartridge 70*a* can be attached to and removed from the third main body 100*d*.

[Insertion of the Third Cartridge not Operable with the Fourth Main Body]

Figure 23A:
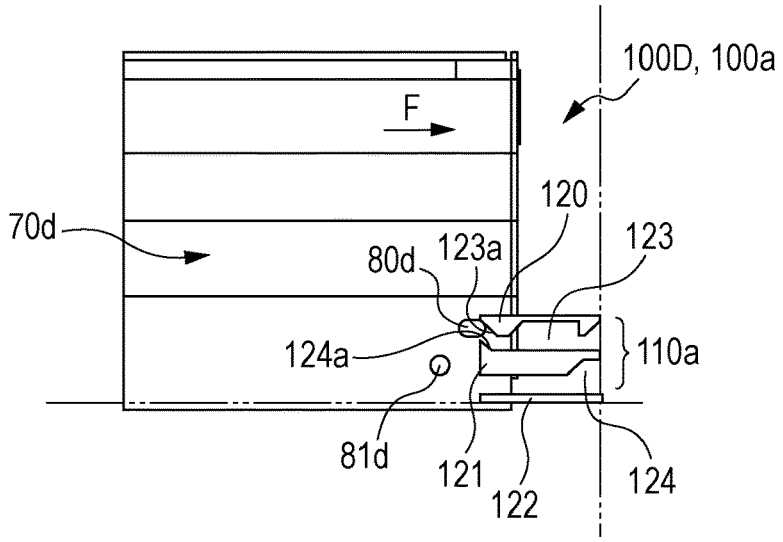
FIG. 23A is an explanatory view of an operation to prevent a wrong cartridge from being inserted when the cartridge is inserted into the image forming apparatus main body according to the third embodiment.
Figure 23B:
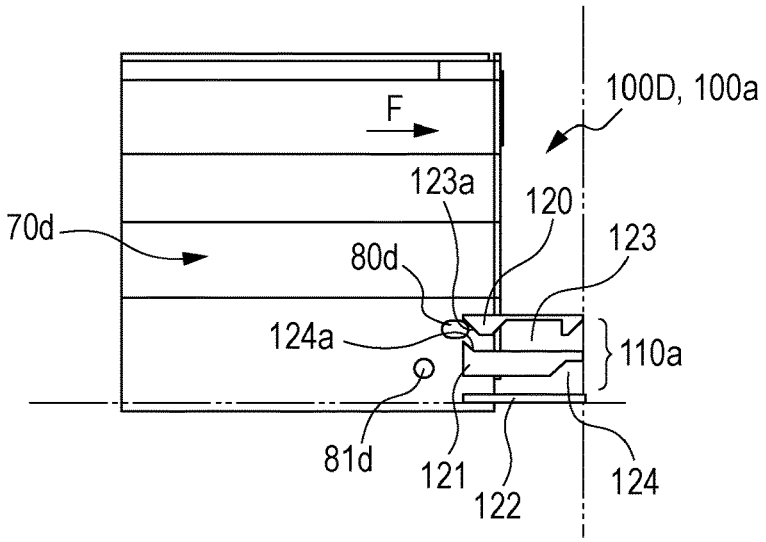
FIG. 23B is an explanatory view of the operation to prevent the wrong cartridge from being inserted when the cartridge is inserted into the image forming apparatus main body according to the third embodiment.

In contrast, when the third cartridge 70*d* not operable with the fourth main body 100D is inserted, attachment of the wrong cartridge can be prevented similarly to the first embodiment, and furthermore, attachment of the third cartridge 70*d* to the fourth main body 100D that corresponds to the cartridge 70D can be prevented. Referring to FIGS. 23A and 23B, a structure with which insertion of the third cartridge 70*d* is prevented is described by using a case in which the first main body 100*a* is used as the fourth main body 100D as an example. As illustrated in FIG. 23A, when the third cartridge 70*d* is initially moved, the fifth projecting portion 80*d* and the first recess portion 123 of the first movable member 110*a* are brought into engagement with each other.

When the third cartridge 70*d* is further inserted, the fifth projecting portion 80*d* is brought into contact with the first inclined portion 123*a* of the first contact portion 120 provided at the entrance of the first recess portion 123 as illustrated in FIG. 23B. Thus, the first movable member 110*a* receives a force from the third cartridge 70*d* through the fifth projecting portion 80*d*. This causes the first movable member 110*a* urged downward by the urging springs 111 to be moved upward (in the movement direction G). However, while the first movable member 110*a* is moved upward as the third cartridge 70*d* is inserted, the sixth projecting portion 81*d* is brought into contact with the end surface of the second contact portion 121 on the upstream side in the insertion direction. Thus, the sixth projecting portion 81*d* is not brought into engagement with the second recess portion 124 of the first movable member 110*a*. As a result, insertion of the third cartridge 70*d*, which is a wrong cartridge in this case, into the first main body 100*a* can be prevented.

Advantageous Effects

Thus, an image forming system which realizes the following structure in a reduced space can be provided: a structure that prevents a wrong cartridge not operable with the third main body 100*d* from being attached and that allows a plurality of types of cartridges operable with the third main body 100*d* to be attached. Furthermore, the first and second projecting portions can be used as visible identifiers, and accordingly, the types of the cartridges operable with and attachable to the main body can be easily identified.

Fourth Embodiment

According to a fourth embodiment, the effects similar to the effects obtained by the first embodiment can be obtained with a different structure. A structure is described in which a fifth main body 100*e*, a fifth cartridge 70*e* corresponding to and operable with the fifth main body 100*e*, and a sixth cartridge operable with the fifth main body 100*e* are used.

General structures of the entirety of the fifth main body 100*e*, the fifth cartridge 70*e*, and the sixth cartridge according to the fourth embodiment are similar to the structures described in the first embodiment, and description thereof is omitted. In the following, the difference between the fifth main body 100*e* and the first main body 100*a*, the difference between the fifth cartridge 70*e* and the cartridge 70*a*, and the relationships between the fifth main body 100*e*, the fifth cartridge 70*e*, and the sixth cartridge are mainly described. The fourth embodiment according to the present invention is described below with reference to FIGS. 24A to 26F.

In the present embodiment, the movable member 110*a* provided in the first main body 100*a* in the first embodiment is provided in the fifth cartridge 70*e*. In the following, a structure using the fifth main body 100*e* and the fifth cartridge 70*e* corresponding to and operable with the fifth main body 100*e* is described.

Figure 24A:
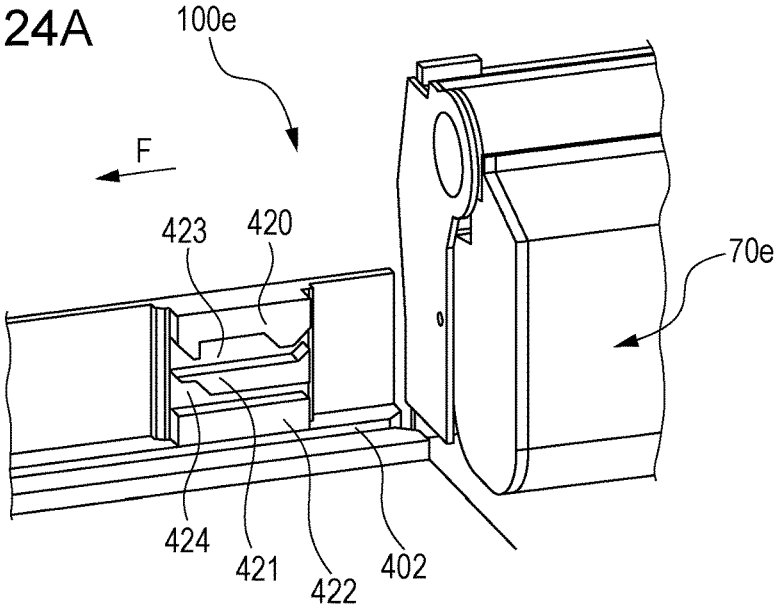
FIG. 24A is an explanatory view of a structure of a recess portion according to a fourth embodiment.

As illustrated in FIG. 24A, a first guide portion 402, a second guide portion (not illustrated), a seventh recess portion 423, and an eighth recess portion 424 are provided in the fifth main body 100*e*. The first guide portion 402 and the second guide portion guide the insertion of the fifth cartridge 70*e*. The seventh recess portion 423 and the eighth recess portion 424 are to be engaged with a ninth projecting portion 80*e* and a tenth projecting portion 81*e*. The seventh recess portion 423 is defined by a seventh contact portion 420 and an eighth contact portion 421. The eighth recess portion 424 is defined by the eighth contact portion 421 and a fourth entrance block portion 422. The seventh recess portion 423 is formed by the seventh contact portion 420 and the eighth contact portion 421. The eighth recess portion 424 is formed by the eighth contact portion 421 and the fourth entrance block portion 422.

Figure 24B:
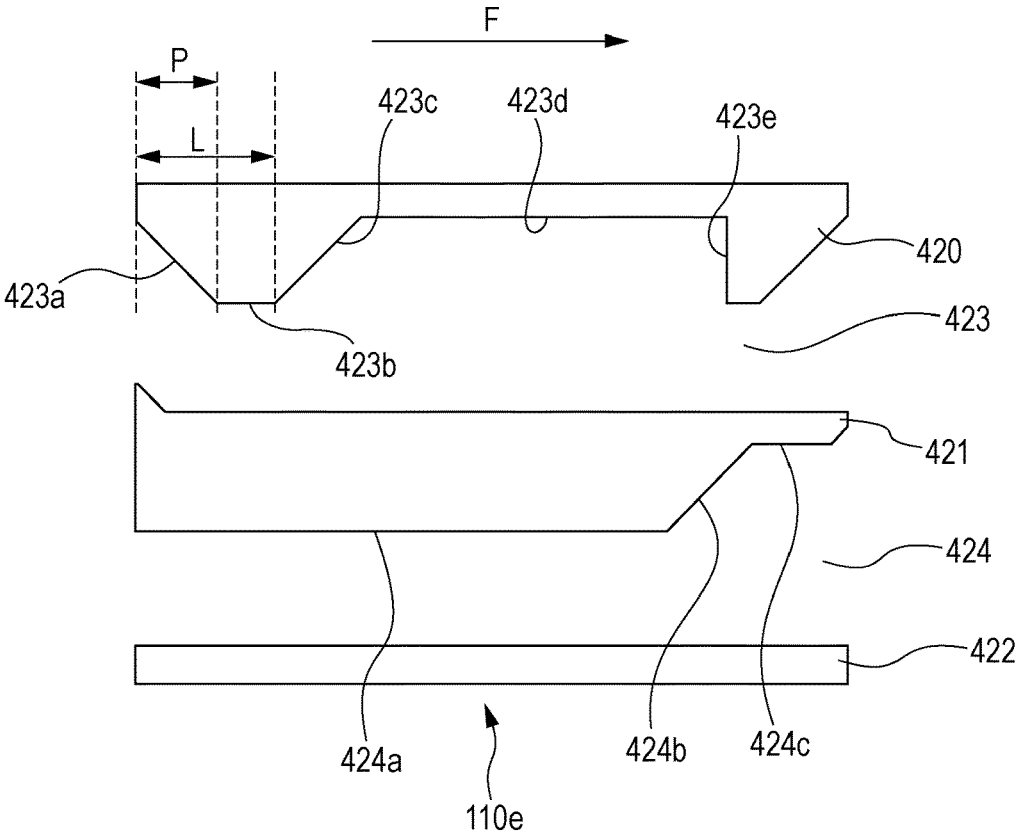
FIG. 24B is an explanatory view of the structure of the recess portion according to the fourth embodiment.

As illustrated in FIG. 24B, a tenth inclined portion 423*a*, a tenth flat portion 423*b*, an eleventh inclined portion 423*c*, a fourth recessed surface portion 423*d*, and a fourth regulating portion 423*e* are provided in this order in the insertion direction F in the seventh recess portion 423, that is, on a surface of the seventh contact portion 420 on the upstream side in the movement direction G. Specifically, the tenth inclined portion 423*a* is inclined toward the upstream side in the movement direction G as it extends toward the downstream side in the insertion direction F. The tenth flat portion 423*b* is connected to the tenth inclined portion 423*a* and extends substantially parallel to the insertion direction F. The eleventh inclined portion 423*c* is inclined toward the downstream side in the movement direction Gas it extends toward the downstream side in the insertion direction F. The fourth regulating portion 423*e*, which is perpendicular to the insertion direction F, that is, substantially parallel to the movement direction G, is continuous with the fourth recessed surface portion 423*d*, which is substantially parallel to the insertion direction F.

Likewise, an eleventh flat portion 424*a*, a twelfth inclined portion 424*b*, and a twelfth flat portion 424*c* are provided in this order in the insertion direction F in the eighth recess portion 424, that is, on a surface of the eighth contact portion 421 on the upstream side in the movement direction G. Specifically, the eleventh flat portion 424*a* and the twelfth flat portion 424*c* are substantially parallel to the insertion direction F. The twelfth inclined portion 424*b* is inclined toward the upstream side in the movement direction G as it extends toward the downstream side in the insertion direction F. The eighth recess portion 424 serving as a first receiving portion is not necessarily a recess portion. It is sufficient that the eighth recess portion 424 be at least engageable with the tenth projecting portion 81*e* on the downstream side of the seventh recess portion 423 in the movement direction G.

Figure 25:
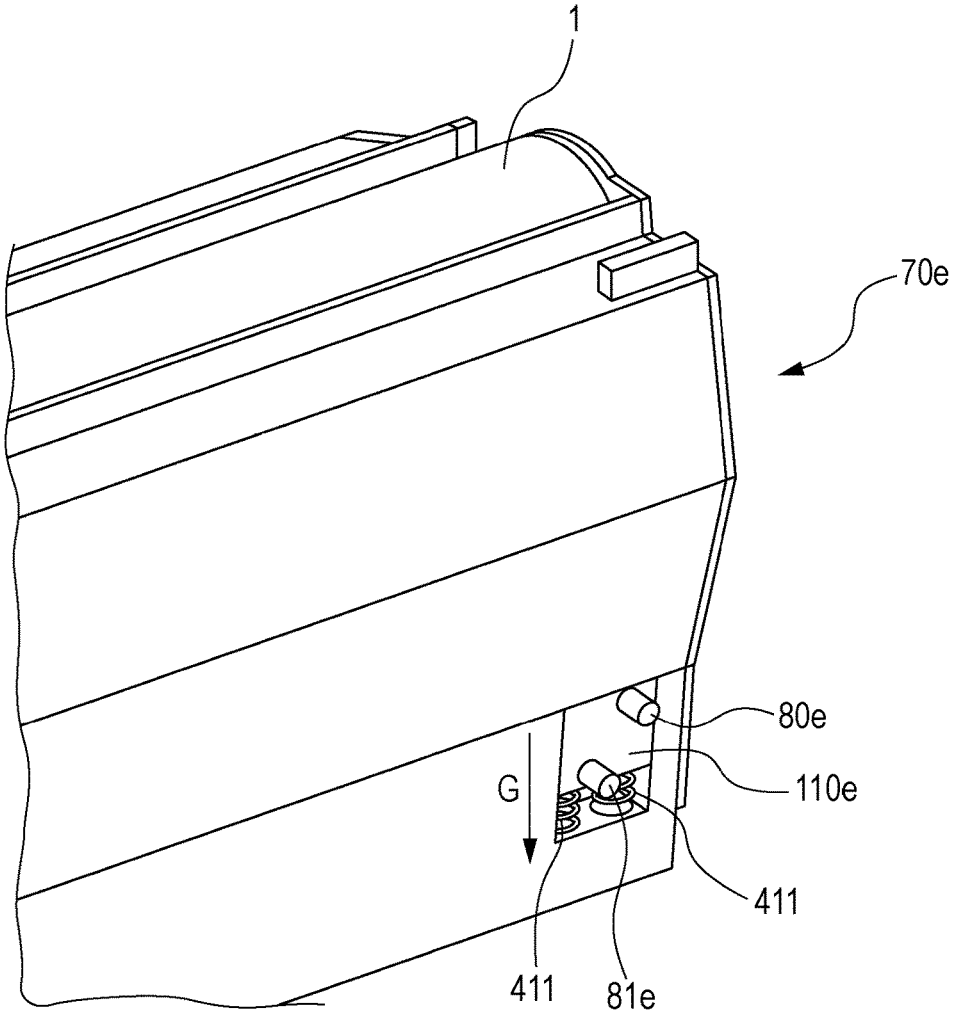
FIG. 25 is an explanatory view of structures of ninth and tenth projecting portions of a movable member of a cartridge according to the fourth embodiment.
Figure 26A:
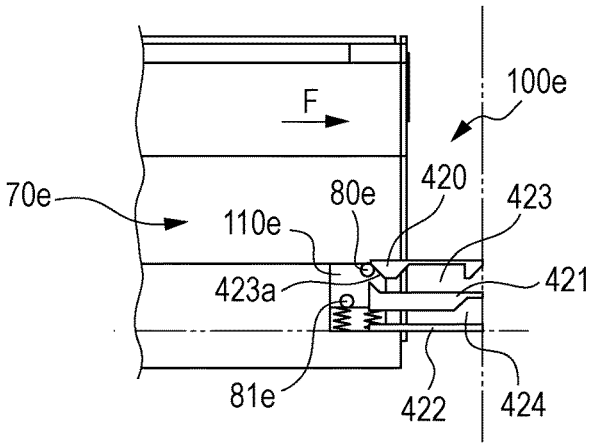
FIG. 26A is an explanatory view of an operation performed when the cartridge is inserted into an image forming apparatus main body according to the fourth embodiment.
Figure 26B:
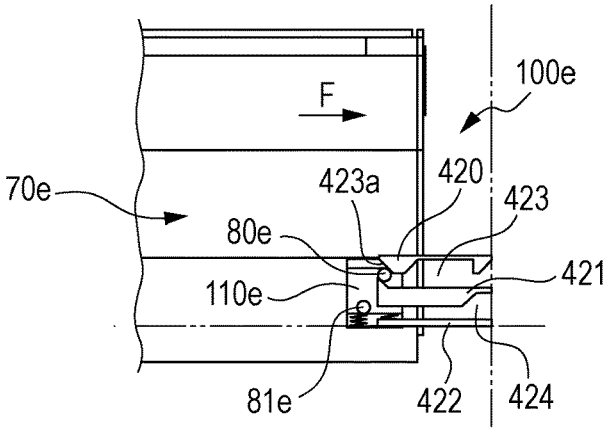
FIG. 26B is an explanatory view of the operation performed when the cartridge is inserted into the image forming apparatus main body according to the fourth embodiment.
Figure 26C:
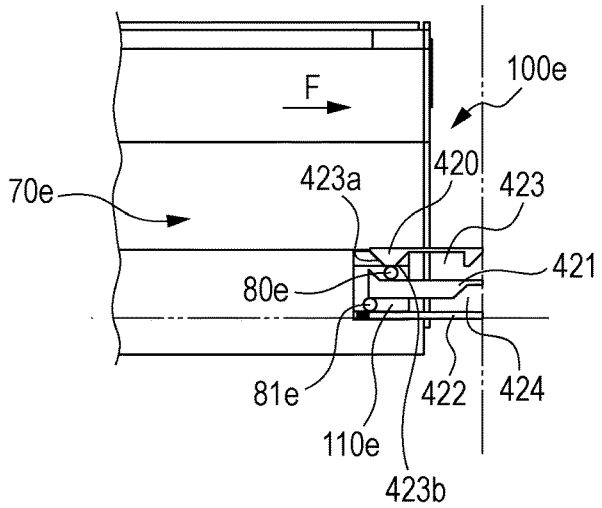
FIG. 26C is an explanatory view of the operation performed when the cartridge is inserted into the image forming apparatus main body according to the fourth embodiment.
Figure 26D:
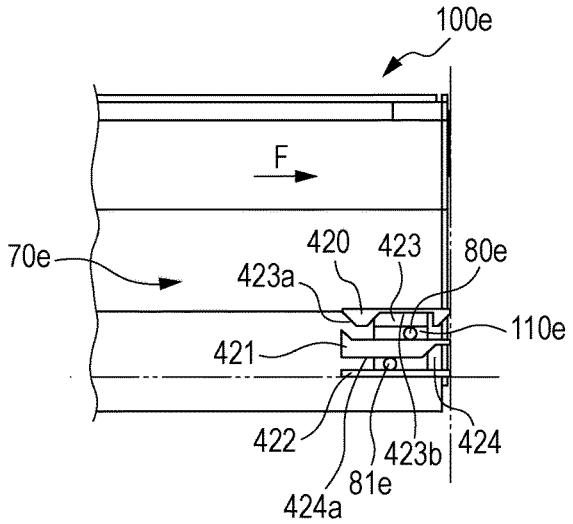
FIG. 26D is an explanatory view of the operation performed when the cartridge is inserted into the image forming apparatus main body according to the fourth embodiment.
Figure 26E:
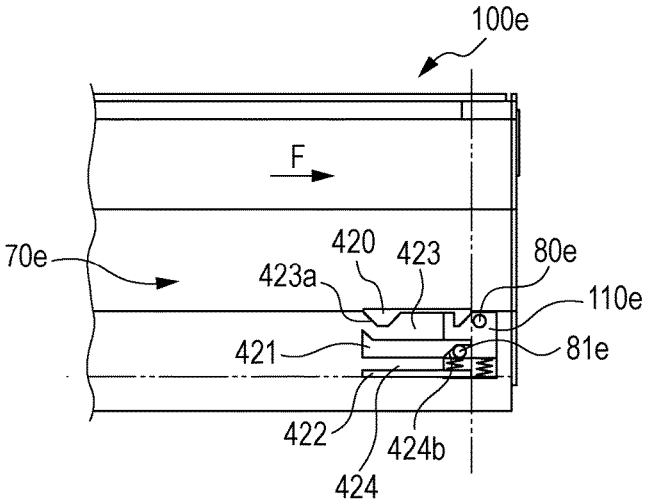
FIG. 26E is an explanatory view of the operation performed when the cartridge is inserted into the image forming apparatus main body according to the fourth embodiment.
Figure 26F:
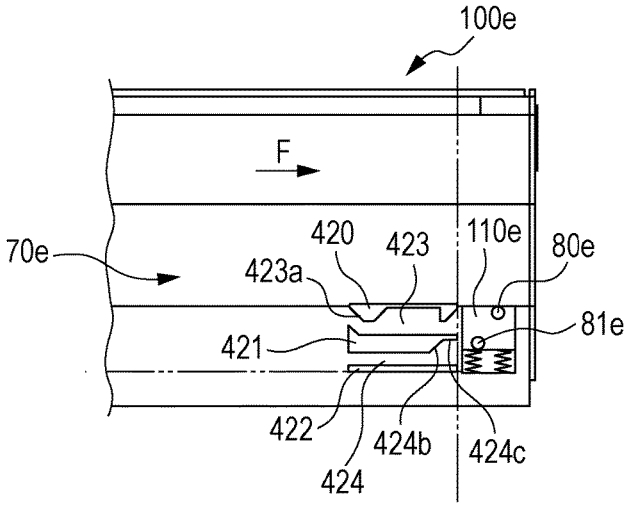
FIG. 26F is an explanatory view of the operation performed when the cartridge is inserted into the image forming apparatus main body according to the fourth embodiment.

As illustrated in FIG. 25, a fourth movable member 110*e* and urging springs 411 are provided in the fifth cartridge 70*e*. The fourth movable member 110*e* is movable. The urging springs 411 urge the fourth movable member 110*e* to a specified position. In the present embodiment, the fourth movable member 110*e* is urged upward in the fifth main body 100*e* by the urging springs 411 so as to be positioned at the first position and is downwardly movable in the fifth main body 100*e*. The ninth projecting portion 80*e* and the tenth projecting portion 81*e* are provided in the fourth movable member 110*e* such that the ninth projecting portion 80*e* and the tenth projecting portion 81*e* project in a direction intersecting the insertion direction F. The ninth projecting portion 80*e* is disposed on the downstream side in the insertion direction F of the fifth cartridge 70*e*, and the tenth projecting portion 81*e* is disposed upstream of the ninth projecting portion 80*e* in the insertion direction F of the fifth cartridge 70*e*.

In the present embodiment, the sections of the ninth projecting portion 80*e* and the tenth projecting portion 81*e* have circular shapes in a plane specified by the insertion direction F and the movement direction G. Alternatively, the section of the ninth projecting portion 80*e* in the plane specified by the insertion direction F and the movement direction G is sufficient that the length of the section in the insertion direction F be greater than the length of the section in the movement direction G and may have a non-circular shape including an ellipse, and a rectangle or a polygon chamfered so as to form a curved surface. The section of the tenth projecting portion 81*e* in the plane specified by the insertion direction F and the movement direction G may be one of a variety of shapes such as a circle, an ellipse, and a polygon.

Regarding the fifth main body 100*e* and the fifth cartridge 70*e*, in the movement direction G, the width of the seventh recess portion 423 is greater than the width of the ninth projecting portion 80*e*. Likewise in the movement direction G, the width of the eighth recess portion 424 is greater than the width of the tenth projecting portion 81*e*. Thus, the tenth projecting portion 81*e* becomes engageable with the eighth recess portion 424 when the ninth projecting portion 80*e* is moved to an end portion of the tenth inclined portion 423*a* on the downstream side in the movement direction G. That is, in the insertion direction F, the distance between the ninth projecting portion 80*e* and the tenth projecting portion 81*e* is greater than the first distance P, by which the fourth movable member 110*e* is moved from the first position to the second position along the tenth inclined portion 423*a*, and less than the second distance L, which is the sum of the first distance P and the length of the tenth flat portion 423*b*.

[About the Fifth Cartridge Attachable to the Fifth Main Body]

Next, the relationships between the ninth and tenth projecting portions 80*e* and 81*e* and the seventh and eighth recess portions 423 and 424 during attachment of the fifth cartridge 70*e* to the fifth main body 100*e* by inserting the fifth cartridge 70*e* in the insertion direction F are described. As is the case with the first embodiment, the fifth cartridge 70*e* is inserted into the fifth main body 100*e* along the first guide portion 402 (see FIG. 24A) and the second guide portion (not illustrated). As illustrated in FIGS. 26A to 26F, as the ninth and tenth projecting portions 80*e* and 81*e* are brought into engagement with the seventh and eighth recess portions 423 and 424 and the fifth cartridge 70*e* is inserted, the fourth movable member 110*e* is moved from the first position to the second position. Thus, the fifth cartridge 70*e* can be inserted into the attachment position of the fifth cartridge 70*e*.

Furthermore, the relationships between the ninth and tenth projecting portions 80*e* and 81*e* and the seventh and eighth recess portions 423 and 424 when the fifth cartridge 70*e* is removed from the fifth main body 100*e* by pulling the fifth cartridge 70*e* in the removal direction R are described. Similarly to the first embodiment illustrated in FIGS. 8A to 8F, as the ninth and tenth projecting portions 80*e* and 81*e* are brought into engagement with the seventh and eighth recess portions 423 and 424 and the fifth cartridge 70*e* is pulled, the fourth movable member 110*e* is moved from the first position to the second position. The fifth cartridge 70*e* is pulled from the attachment position of fifth main body 100*e* as described above, and accordingly, removable from the fifth main body 100*e*. Thus, the fifth cartridge 70*e* can be attached to and removed from the fifth main body 100*e*.

[About Sixth Cartridge Attachable to the Fifth Main Body]

Next, the sixth cartridge attachable to the fifth main body 100*e* is described, and after that, the relationship between eleventh and twelfth projecting portions and the seventh and eighth recess portions 423 and 424 are described (not illustrated).

The sixth cartridge has the twelfth projecting portion in addition to the eleventh projecting portion having a shape different from that of the ninth projecting portion 80*e*. Specifically, in the present embodiment, similarly to the first embodiment, in a plane specified by the insertion direction F and the movement direction G, the section of the eleventh projecting portion has a circular shape, and the sections of the eleventh projecting portion and the ninth projecting portion 80*e* have a common tangent line at the downstream end portion in the movement direction G and the diameters thereof are different from each other. Also, the eleventh projecting portion and twelfth projecting portion are provided on the sixth cartridge such that the eleventh projecting portion and the twelfth projecting portion project in a direction intersecting the insertion direction F. The eleventh projecting portion is disposed on the upstream side in the insertion direction F of the cartridge, and the twelfth projecting portion is disposed downstream of the eleventh projecting portion in the insertion direction F of the cartridge. Furthermore, the eleventh projecting portion has a shape that can enter the seventh recess portion 423.

Furthermore, the sixth cartridge is structured such that the twelfth projecting portion becomes engageable with the eighth recess portion 424 when the eleventh projecting portion is moved to the end portion of the tenth inclined portion 423*a* on the downstream side in the movement direction G. That is, in the insertion direction F, the distance between the eleventh projecting portion and the twelfth projecting portion is greater than the first distance P, by which the fourth movable member 110*e* is moved from the first position to the second position by using the tenth inclined portion 423*a*, and less than the second distance L, which is the sum of the first distance P and the length of the tenth flat portion 423*b* (see FIG. 24B).

Next, the relationships between the eleventh and twelfth projecting portions and the seventh and eighth recess portions 423 and 424 during attachment of the sixth cartridge to the fifth main body 100*e* by inserting the fifth cartridge 70*e* in the insertion direction F are described. As is the case with the first embodiment, the sixth cartridge is inserted along the first guide portion 402 (see FIG. 24A) and the second guide portion (not illustrated). As the eleventh and twelfth projecting portions are brought into engagement with the seventh and eighth recess portions 423 and 424 and the sixth cartridge is inserted, the fourth movable member 110*e* is moved from the first position to the second position. Thus, the sixth cartridge can be inserted into the attachment position of the fifth cartridge 70*e*.

Furthermore, the relationships between the eleventh and twelfth projecting portions and the seventh and eighth recess portions 423 and 424 when the cartridge is removed from the fifth main body 100*e* by pulling the sixth cartridge in the removal direction R are described. Similarly to the first embodiment illustrated in FIGS. 8A to 8F, as the eleventh and twelfth projecting portions of the fourth movable member 110*e* are brought into engagement with the seventh and eighth recess portions 423 and 424 and the sixth cartridge is pulled, a movement from the first position to the second position is performed. The sixth cartridge is pulled from the attachment position of fifth main body 100*e* as described above, and accordingly, removable from the fifth main body 100*e*. Thus, the sixth cartridge can be attached to and removed from the fifth main body 100*e*.

In contrast, when a cartridge not operable with the fifth main body 100*e* is inserted, the projecting portions cannot pass through the seventh and eighth recess portions 423 and 424. Thus, attachment of the wrong cartridge can be prevented. Description of this feature, which is similar to that of the first embodiment, is omitted.

Advantageous Effects

Thus, even when the movable member 110 is provided in the cartridge 70, an image forming system which realizes the following structure in a reduced space can be provided: a structure that prevents the wrong cartridge not operable with the fifth main body 100*e* from being attached and that allows a plurality of types of the cartridges to be attached. Furthermore, the two projecting portions can be used as visible identifiers, and accordingly, the types of the cartridges operable with and attachable to the main body can be easily identified.

Alternatively, similarly to the second embodiment, the following sixth main body may be used: that is, the sixth main body is provided with a sixth movable member having a ninth recess portion and a tenth recess portion so as to allow the sixth cartridge operable with the sixth main body to be attached and so as to prevent the fifth cartridge 70*e* not operable with the sixth main body from being attached. In this case, it is sufficient that, in comparison with the fourth movable member 110*e*, the width of the inside of the ninth recess portion in the arrangement direction be reduced from the width of the inside of the ninth recess portion of the sixth movable member 110E in the movement direction G and allow the eleventh projecting portion to enter the eighth recess portion 424. In addition, with a thirteenth inclined portion, a thirteenth flat portion, a fourteenth inclined portion, a sixth recessed surface portion, and a sixth regulating portion provided in this order in the insertion direction F on the downstream side of a tenth recessed portion in the movement direction G, attachment of cartridges other than specified cartridges can be reliably prevented.

Other Embodiments

Figure 27:
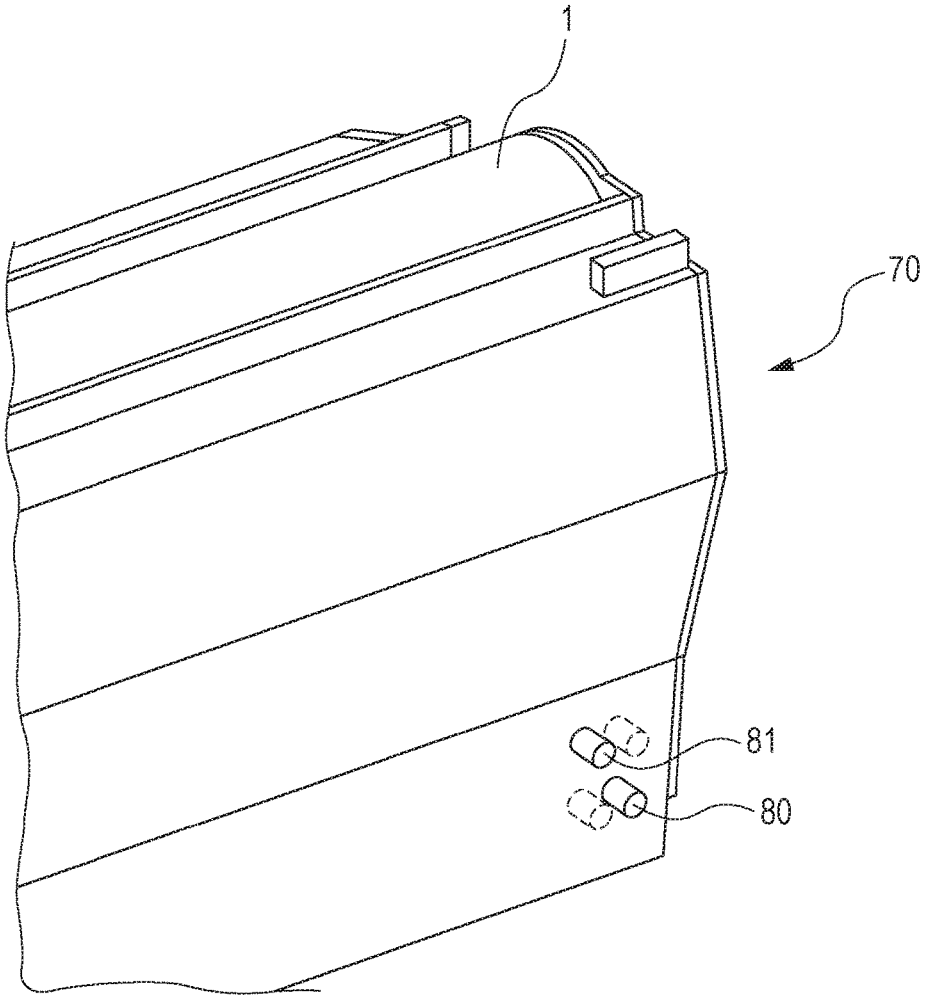
FIG. 27 illustrates an entire structure of a variant of the first projecting portion and the second projecting portion in the first and second embodiments.
Figure 28A:
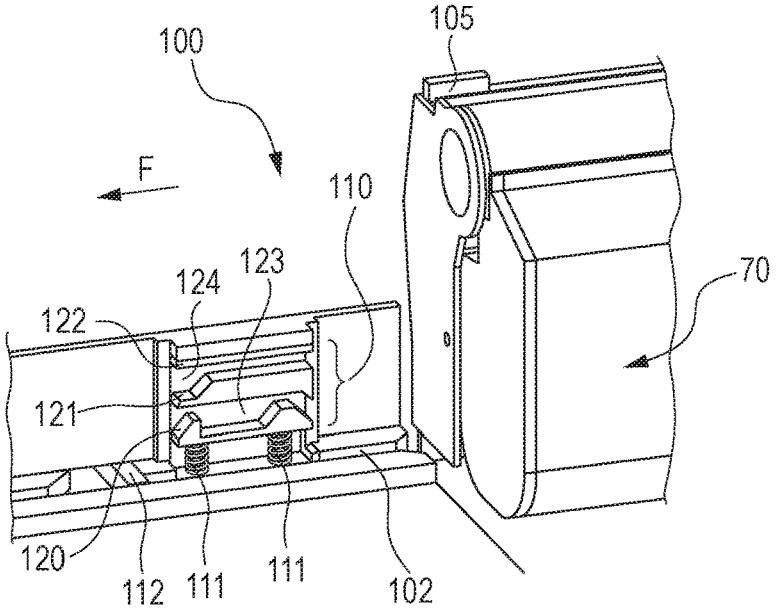
FIG. 28A illustrates an entire structure of a variant of the movable member in the first and second embodiments.
Figure 28B:
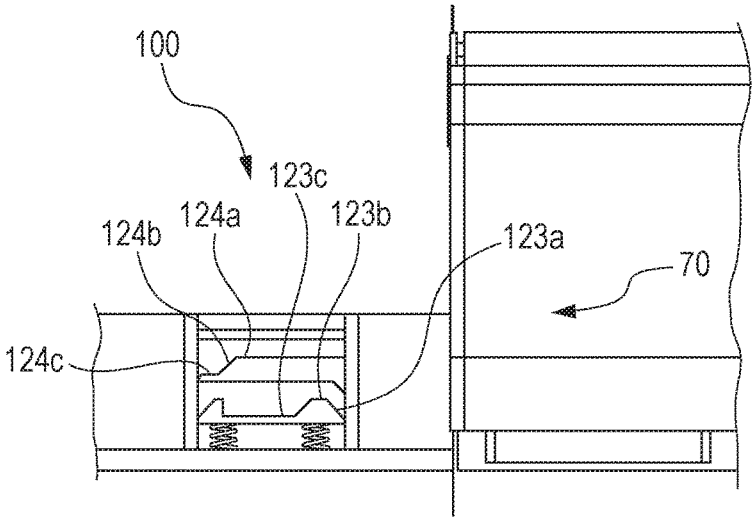
FIG. 28B illustrates an entire structure of the variant of the movable member in the first and second embodiments.

In the aforementioned embodiments, arrangement of the first and second projecting portions 80 and 81 provided on the aforementioned cartridge and the first and second recess portions 123 and 124 in the first embodiment can be changed in the movement direction G and the insertion direction F as long as these portions can be arranged. For example, as illustrated in FIG. 27, the positions of the first and second projecting portions 80 and 81 provided on the cartridge 70 in the movement direction G can be inverted. In this case, as illustrated in FIGS. 28A and 28B, regarding the shapes of the first and second recess portions 123 and 124 provided in the movable member 110, by inverting the arrangement of the first and second recess portions 123 and 124 in the movement direction G, several types of structures that produce similar effects can be made.

Although the urging springs 111 are used as urging units of the movable member 110 in the aforementioned embodiments, the urging units are not limited to these. For example, other than the urging springs 111, urging members formed of an elastic material such as rubber may be used as the urging units of the movable member 110. Furthermore, in the case where gravity acts downward in the movement direction G of the movable member 110 as is the case with the first embodiment, the urging springs 111 or the like are not necessarily provided. In this case, by urging the movable member 110 toward the upstream side in the movement direction G by gravity, the first and second projecting portions 80 and 81 of the cartridge 70 and the first and second recess portions 123 and 124 are brought into contact with one another. Thus, a structure producing the similar effects can be made.

Furthermore, when the second recess portion 124 provided in the movable member 110 has the second contact portion 121, the entrance block portion is not necessarily provided. In this case, by increasing the length of the first inclined portion 123*a* compared to the case where the entrance block portion is provided, a region where the second position, at which the second projecting portion 81 is engageable with the second recess portion 124, is set can be increased. This can allow a certain degree of accuracy deviation in size and shape in manufacturing. Thus, a structure without the first flat portion 123*b* may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-060768, filed Mar. 24, 2014, which is hereby incorporated by reference herein in its entirety.

The invention claimed is:

1. An image forming apparatus main body that allows a first cartridge and a second cartridge to be inserted into an attachment position thereof, the first cartridge including a first projecting portion and a second projecting portion, the second cartridge including a third projecting portion, which has a shape different from that of the first projecting portion, and a fourth projecting portion, the image forming apparatus main body comprising:

a movable member that has a first portion, a second portion and has a first recess portion disposed between the first portion and the second portion, wherein, during attachment of the first cartridge to the image forming apparatus main body, the first portion is moved from a first position where the first projecting portion is allowed to enter the first recess portion to a second position by a movement of the first projecting portion in the first recess portion toward a downstream side in an insertion direction of the first cartridge, and allows the second projecting portion to pass through an upstream side of the second portion in a movement direction in which the second portion is moved with the movement of the first portion from the first position to the second position so as to allow the first cartridge to be moved to the attachment position of the image forming apparatus main body, and wherein, during attachment of the second cartridge to the image forming apparatus main body, the first portion at the first position allows the third projecting portion to enter the first recess portion, and, when the third projecting portion enters the first recess portion, the first portion at the second position allows the fourth projecting portion to pass through the upstream side of the second portion in the movement direction so as to allow the second cartridge to be moved to the attachment position of the image forming apparatus main body.

2. The image forming apparatus main body according to claim 1, wherein a first inclined portion is provided on a downstream side of the first recess portion in the movement direction, and wherein, the first inclined portion is brought into contact with the first projecting portion and the third projecting portion so as to receive a force to move the first portion from the first position to the second position.

3. The image forming apparatus main body according to claim 2, wherein, in the first recess portion, a width of an inside of the first recess portion in a direction perpendicular to the first inclined portion is greater than a width of the inside of the first recess portion in the movement direction at an end portion of the first inclined portion on the downstream side in the insertion direction.

4. The image forming apparatus main body according to claim 2, wherein, in the insertion direction of the first cartridge, a length of part of the first inclined portion brought into contact with the first projecting portion is less than a distance between the first projecting portion and the second projecting portion, and, in the insertion direction of the second cartridge, a length of part of the first inclined portion brought into contact with the third projecting portion is less than a distance between the third projecting portion and the fourth projecting portion.

5. The image forming apparatus main body according to claim 4, wherein, for the first recess portion, a first flat portion is provided so as to be connected to a downstream portion of the first inclined portion in the insertion direction, and wherein, a sum of a distance of the first flat portion and a distance of the first inclined portion brought into contact with the first projecting portion in the insertion direction of the first cartridge is greater than the distance between the first projecting portion and the second projecting portion in the insertion direction of the first cartridge, and a sum of a distance of the first flat portion and a distance of the first inclined portion brought into contact with the third projecting portion in the insertion direction of the second cartridge is greater than the distance between the third projecting portion and the fourth projecting portion in the insertion direction of the second cartridge.

6. The image forming apparatus main body according to claim 2, wherein the first inclined portion, a second inclined portion, which is inclined toward the downstream side in the movement direction as the second inclined portion extends toward the downstream side in the insertion direction of a third cartridge not operable with the image forming apparatus main body, and a first regulating portion, which blocks entrance of the third cartridge into the attachment position, are provided in this order from an upstream side in the insertion direction of the third cartridge for the first recess portion on a surface on the downstream side of the first recess portion in the movement direction.

7. The image forming apparatus main body according to claim 2, wherein the second portion is urged toward the upstream side in the movement direction by an urging member.

8. The image forming apparatus main body according to claim 2, wherein the second portion is urged toward the upstream side in the movement direction by gravity.

9. The image forming apparatus main body according to claim 1, wherein, during removal of the first cartridge from the image forming apparatus main body, the first portion is moved from the first position to the second position by a movement of the second projecting portion toward an upstream side in the insertion direction of the first cartridge, thereby allowing the first projecting portion to enter the first recess portion so as to allow the first cartridge to be removed from the image forming apparatus main body, and wherein, during removal of the second cartridge from the image forming apparatus main body, the first portion is moved from the first position to the second position by a movement of the fourth projecting portion toward the upstream side in the insertion direction of the second cartridge, thereby allowing the third projecting portion to enter the first recess portion so as to allow the second cartridge to be removed from the image forming apparatus main body.

10. The image forming apparatus main body according to claim 1, wherein the movable member has a third portion and a second recess portion disposed between the second portion and the third portion, and the second recess portion allows entrance of the second projecting portion and the fourth projecting portion thereinto.

11. The image forming apparatus main body according to claim 1, further comprising:

a guide portion that guides the first cartridge and the second cartridge in the insertion direction from a position where the first cartridge and the second cartridge are present before the movable member acts on the first cartridge and the second cartridge to the attachment position of the image forming apparatus main body.

12. An image forming system comprising:

a first cartridge that includes a first projecting portion and a second projecting portion;

a second cartridge that includes a third projecting portion, which has a shape different from that of the first projecting portion, and a fourth projecting portion; and a first image forming apparatus main body that allows the first cartridge and the second cartridge to be inserted into an attachment position thereof, wherein the first image forming apparatus main body includes a first movable member that has a first portion, a second portion and a first recess portion disposed between the first portion and the second portion, wherein, during attachment of the first cartridge to the first image forming apparatus main body, the first portion is moved from a first position where the first projecting portion is allowed to enter the first recess portion to a second position by a movement of the first projecting portion in the first recess portion toward a downstream side in an insertion direction of the first cartridge, thereby allowing the second projecting portion to pass through an upstream side of the second portion in a first movement direction in which the second portion is moved with the movement of the first portion from the first position to the second position so as to allow the first cartridge to be moved to the attachment position of the first image forming apparatus main body, and wherein, during attachment of the second cartridge to the first image forming apparatus main body, the first portion at the first position allows the third projecting portion to enter the first recess portion, and, when the third projecting portion enters the first recess portion, first portion at the second position allows the fourth projecting portion to pass through the upstream side of the second portion in the first movement direction so as to allow the second cartridge to be moved to the attachment position of the first image forming apparatus main body.

13. The image forming system according to claim 12, wherein a first inclined portion is provided on a downstream side of the first recess portion in the first movement direction, and wherein, the first inclined portion is brought into contact with the first projecting portion and the third projecting portion so as to receive a force to move the first portion from the first position to the second position.

14. The image forming system according to claim 13, wherein, in the first recess portion, a width of an inside of the first recess portion in a direction perpendicular to the first inclined portion is greater than a width of the inside of the first recess portion in the first movement direction at an end portion of the first inclined portion on the downstream side in the insertion direction of at least one of the first cartridge or the second cartridge.

15. The image forming system according to claim 13, wherein, in the insertion direction of the first cartridge, a length of part of the first inclined portion brought into contact with the first projecting portion is less than a distance between the first projecting portion and the second projecting portion, and, in the insertion direction of the second cartridge, a length of part of the first inclined portion brought into contact with the third projecting portion is less than a distance between the third projecting portion and the fourth projecting portion.

16. The image forming system according to claim 15, wherein, a sum of a distance of the first flat portion and a distance of the first inclined portion brought into contact with the first projecting portion in the insertion direction of the first cartridge is greater than the distance between the first projecting portion and the second projecting portion in the insertion direction of the first cartridge, and a sum of a distance of the first flat portion and a distance of the first inclined portion brought into contact with the third projecting portion in the insertion direction of the second cartridge is greater than the distance between the third projecting portion and the fourth projecting portion in the insertion direction of the second cartridge.

17. The image forming system according to claim 13, wherein the first inclined portion, a second inclined portion, which is inclined toward the downstream side in the first movement direction as the second inclined portion extends toward the downstream side in the insertion direction of a third cartridge not operable with the first image forming apparatus main body, and a first regulating portion, which blocks entrance of the third cartridge into the attachment position, are provided in this order from an upstream side in the insertion direction for the first recess portion on a surface on the downstream side of the first recess portion in the first movement direction.

18. The image forming system according to claim 13, wherein the second portion is urged toward the upstream side in the first movement direction by an urging member.

19. The image forming system according to claim 13, wherein the second portion is urged toward the upstream side in the first movement direction by gravity.

20. The image forming system according to claim 12, wherein, during removal of the first cartridge from the first image forming apparatus main body, the first portion is moved from the first position to the second position by a movement of the second projecting portion toward an upstream side in the insertion direction of the first cartridge, thereby allowing the first projecting portion to enter the first recess portion so as to allow the first cartridge to be removed from the first image forming apparatus main body, and wherein, during removal of the second cartridge from the first image forming apparatus main body, the first portion is moved from the first position to the second position by a movement of the fourth projecting portion toward the upstream side in the insertion direction of the second cartridge, thereby allowing the third projecting portion to enter the first recess portion so as to allow the second cartridge to be removed from the first image forming apparatus main body.

21. The image forming system according to claim 12, wherein the first movable member has a third portion and a second recess portion disposed between the second portion and the third portion, and the second recess portion allows entrance of the second projecting portion and the fourth projecting portion thereinto.

22. The image forming system according to claim 12, wherein the first image forming apparatus main body includes a guide portion that guides the first cartridge and the second cartridge in the insertion direction from a position where the first cartridge and the second cartridge are present before the first movable member acts on the first cartridge and the second cartridge to the attachment position of the first image forming apparatus main body.

23. The image forming system according to claim 12, further comprising:

a second image forming apparatus main body includes a second movable member that has a fourth portion, a fifth portion and a second recess portion disposed between the fourth portion and the fifth portion, wherein, during attachment of the second cartridge to the second image forming apparatus main body, the fourth portion is moved from a third position where the third projecting portion is allowed to enter the second recess portion to a fourth position when the third projecting portion enters the second recess portion, and allows the fourth projecting portion to pass through an upstream side of the fifth portion in a second movement direction in which the fifth portion is moved with the movement of the fourth portion from the third position to the fourth position so as to allow the second cartridge to be moved to an attachment position of the second image forming apparatus main body, and wherein, during attachment of the first cartridge to the second image forming apparatus main body, the second recess portion blocks the movement of the first projecting portion in the insertion direction of the first cartridge.

24. The image forming system according to claim 23, wherein the second cartridge includes the third projecting portion, and the fourth projecting portion, a section of the third projecting portion in a plane determined by the insertion direction of the second cartridge and the second movement direction is less than a section of the first projecting portion in a plane determined by the insertion direction of the first cartridge and the second movement direction, wherein a length of an inside of the second recess portion is less than that of the first recess portion in a direction perpendicular to the insertion direction of the second cartridge, and the third projecting portion is brought into contact with the inside of the second recess portion, and wherein, during the attachment of the first cartridge to the second image forming apparatus main body, the second movable member blocks entrance of the first projecting portion into the second recess portion.

25. The image forming system according to claim 23, wherein a first inclined portion, which is brought into contact with the third projecting portion so as to receive a force to move the second movable member from the third position to the fourth position, a second inclined portion, which is inclined toward the downstream side in the second movement direction as the fifth inclined portion extends toward the downstream side in the insertion direction of a third cartridge not operable with the second image forming apparatus main body, and a first regulating portion, which blocks entrance of the third cartridge into the attachment position, are provided in this order from the upstream side in the insertion direction for the second recess portion on a surface on the downstream side of the second recess portion in the second movement direction.

26. The image forming system according to claim 12, wherein a section of the first projecting portion in a plane determined by the insertion direction of the first cartridge and the first movement direction has a circular shape, a section of the third projecting portion in a plane determined by the insertion direction of the second cartridge and the movement direction has a circular shape, and a diameter of the third projecting portion is less than that of the first projecting portion.

27. The image forming system according to claim 12, wherein a section of the first projecting portion in a plane determined by the insertion direction of the first cartridge and the first movement direction, and a section of the third projecting portion in a plane determined by the insertion direction of the second cartridge and the first movement direction respectively have a non-circular shape that have a length in the insertion direction shorter than a length in the first movement direction, and the section of the first projecting portion and the second of the third projecting portion have substantially identical length to the first movement direction.

28. An image forming apparatus main body that allows a first cartridge and a second cartridge to be inserted into an attachment position thereof, the first cartridge including a first movable member including a first projecting portion and a second projecting portion, the first movable member being movable, the second cartridge including a second movable member including an third projecting portion, which has a shape different from that of the first projecting portion, and a fourth projecting portion, the second movable member being movable, wherein the image forming apparatus main body has a first portion, a second portion, and a first recess portion disposed between the first portion and the second portion, wherein, during attachment of the first cartridge to the image forming apparatus main body, the first recess portion causes the first movable member to be moved from a first position where the first projecting portion is allowed to enter the first recess portion to a second position by a movement of the first projecting portion to a movement direction on a downstream side in an insertion direction of the first cartridge in the first recess portion, thereby allowing the second projecting portion to pass through a downstream side of the second portion in the movement direction so as to allow the first cartridge to be moved to the attachment position of the image forming apparatus main body, and wherein, during attachment of the second cartridge to the image forming apparatus main body, the first recess portion causes the second movable member to be moved from a third position where the third projecting portion is allowed to enter the first recess portion to a fourth position by a movement of the third projecting portion to the movement direction on the downstream side in the insertion direction of the second cartridge in the first recess portion, thereby allowing the fourth projecting portion to pass through the downstream side of the second portion in the movement direction so as to allow the second cartridge to be moved to the attachment position of the image forming apparatus main body.

29. The image forming apparatus main body according to claim 28, wherein a first inclined portion is provided on the downstream side of the first recess portion in the movement direction, wherein, the first inclined portion is brought into contact with the first projecting portion so as to receive a force to move the first movable member from the first position to the second position, and the first inclined portion is brought into contact with the third projecting portion so as to receive a force to move the second movable member from the first position to the second position.

30. The image forming apparatus main body according to claim 29, wherein, in the first recess portion, a width of an inside of the first recess portion in a direction perpendicular to the first inclined portion is greater than a width of the inside of the first recess portion in the movement direction at an end portion of the first inclined portion on the downstream side in the insertion direction of at least one of the first cartridge or the second cartridge.

31. The image forming apparatus main body according to claim 29, wherein, in the insertion direction of the first cartridge, a length of part of the first inclined portion brought into contact with the first projecting portion is less than a distance between the first projecting portion and the second projecting portion, and, in the insertion direction of the second cartridge, a length of part of the first inclined portion brought into contact with the third projecting portion is less than a distance between the third projecting portion and the fourth projecting portion.

32. The image forming apparatus main body according to claim 31, wherein, for the first recess portion, a first flat portion is provided so as to be connected to a downstream portion of the first inclined portion in the insertion direction, and wherein, a sum of a distance of the first flat portion and a distance of the first inclined portion brought into contact with the first projecting portion in the insertion direction of the first cartridge is greater than the distance between the first projecting portion and the second projecting portion in the insertion direction of the first cartridge, and a sum of a distance of the first flat portion and a distance of the first inclined portion brought into contract with the third projecting portion in the insertion direction of the second cartridge is greater than the distance between the third projecting portion and the fourth projecting portion in the insertion direction of the second cartridge.

33. The image forming apparatus main body according to claim 29, wherein the first inclined portion, an second inclined portion, which is inclined toward the downstream side in the movement direction as the second inclined portion extends toward the downstream side in the insertion direction of a third cartridge not operable with the image forming apparatus main body, and a first regulating portion, which blocks entrance of the third cartridge into the attachment position, are provided in this order from an upstream side in the insertion direction of the third cartridge for the first recess portion on a surface on the downstream side of the first recess portion in the movement direction.

34. The image forming apparatus main body according to claim 29, wherein the first movable member and the second movable member are urged toward an upstream side in the movement direction by respective urging members.

35. The image forming apparatus main body according to claim 29, wherein the first movable member and the second movable member are urged toward an upstream side in the movement direction by gravity.

36. The image forming apparatus main body according to claim 28, wherein, during removal of the first cartridge from the image forming apparatus main body, the second portion causes the first movable member to be moved from the first position to the second position by a movement of the second projecting portion toward the upstream side in the insertion direction of the first cartridge, thereby allowing the first projecting portion to enter the first recess portion so as to allow the first cartridge to be removed from the image forming apparatus main body, and wherein, during removal of the second cartridge from the image forming apparatus main body, the second portion causes the second movable member to be moved from the third position to the fourth position by a movement of the fourth projecting portion toward the upstream side in an insertion direction of the second cartridge, thereby allowing the third projecting portion to enter the first recess portion so as to allow the second cartridge to be removed from the image forming apparatus main body.

37. The image forming apparatus main body according to claim 28, wherein a third portion and a second recess portion disposed between the second portion and the third portion, and the second recess portion allows the second projecting portion and the fourth projecting portion to enter thereinto.

38. The image forming apparatus main body according to claim 28, wherein a guide portion is provided, and the guide portion guides the first cartridge and the second cartridge in the insertion direction from a position where the first projecting portion and the third projecting portion are present before the first recess portion acts on the first projecting portion and the third projecting portion to the attachment position of the image forming apparatus main body.

39. An image forming system comprising:

a first cartridge that includes a first movable member that is movable and that includes a first projecting portion and a second projecting portion;

a second cartridge that includes a second movable member that is movable and that includes an third projecting portion, which has a shape different from that of the first projecting portion, and a fourth projecting portion; and a first image forming apparatus main body that has a first portion, a second portion, and a first recess portion disposed between the first portion and the second portion, and the first recess portion and that allows the first cartridge and the second cartridge to be inserted to an attachment position thereof, wherein, during attachment of the first cartridge to the first image forming apparatus main body, the first recess portion causes the first movable member to be moved from a first position where the first projecting portion is allowed to enter the first recess portion to a second position by a movement of the first projecting portion to a first movement direction on a downstream side in an insertion direction of the first cartridge in the first recess portion, thereby allowing the second projecting portion to pass through a downstream side of the second recess portion in the first movement direction so as to allow the first cartridge to be moved to the attachment position of the first image forming apparatus main body, and wherein, during attachment of the second cartridge to the first image forming apparatus main body, the first recess portion causes the seconds movable member to be moved from a third position where the third projecting portion is allowed to enter the first recess portion to a fourth position by a movement of the third projecting portion to a second movement direction on the downstream side in the insertion direction of the second cartridge in the first recess portion, thereby allowing the fourth projecting portion to pass through on the downstream side of the second portion in the second movement direction so as to allow the second cartridge to be moved to the attachment position of the first image forming apparatus main body.

40. The image forming system according to claim 39, wherein a first inclined portion is provided on a surface on the downstream side of the first recess portion in the first movement direction and the second movement direction, and wherein the first inclined portion is brought into contact with the first projecting portion and the third projecting portion so as to receive forces to allow the first movable member and the second movable member to be moved.

41. The image forming system according to claim 40, wherein, in the first recess portion, a width of an inside of the first recess portion in a direction perpendicular to the first inclined portion is greater than a width of the inside of the first recess portion in at least one of the first movement direction or the second movement direction at an end portion of the first inclined portion on the downstream side in the insertion direction.

42. The image forming system according to claim 40, wherein, in the insertion direction of the first cartridge, a length of part of the first inclined portion brought into contact with the first projecting portion is less than a distance between the first projecting portion and the second projecting portion, and, in the insertion direction of the second cartridge, a length of part of the first inclined portion brought into contact with the third projecting portion is less than a distance between the third projecting portion and the fourth projecting portion.

43. The image forming system according to claim 42, wherein, for the first recess portion, a first flat portion is provided so as to be connected to a downstream portion of the first inclined portion in the insertion direction, and wherein, a sum of a distance of the first flat portion and a distance of the first inclined portion brought into contact with the first projecting portion in the insertion direction of the first cartridge is greater than the distance between the first projecting portion and the second projecting portion in the insertion direction of the first cartridge, and a sum of a distance of the first flat portion and a distance of the first inclined portion brought into contact with the third projecting portion in the insertion direction of the second cartridge is greater than the distance between the third projecting portion and the fourth projecting portion in the insertion direction of the second cartridge.

44. The image forming system according to claim 40, wherein a third cartridge not operable with the first image forming apparatus main body, the third cartridge includes a third movable member that is movable in a third movement direction, and wherein the first inclined portion, an second inclined portion, which is inclined toward the downstream side in the third movement direction as the second inclined portion extends toward the downstream side in the insertion direction of the third cartridge, and a first regulating portion, which blocks entrance of the third cartridge into the attachment position, are provided in this order from an upstream side in the insertion direction of the third cartridge for the first recess portion on the surface on the downstream side of the first recess portion in the third movement direction.

45. The image forming system according to claim 40, wherein the first movable member is urged toward an upstream side in the first movement direction by a first urging member, and the second movable member is urged toward an upstream side in the second movement direction by a second urging member.

46. The image forming system according to claim 40, wherein the first movable member is urged toward an upstream side in the first movement direction by gravity, and the second movable member is urged toward an upstream side in the second movement direction by gravity.

47. The image forming system according to claim 39, wherein, during removal of the first cartridge from the first image forming apparatus main body, the second portion causes the first movable member to be moved from the first position to the second position by a movement of the second projecting portion toward the upstream side in an insertion direction of the first cartridge, thereby allowing the first projecting portion to enter the first recess portion so as to allow the first cartridge to be removed from the first image forming apparatus main body, and wherein, during removal of the second cartridge from the first image forming apparatus main body, the second portion causes the second movable member to be moved from the third position to the fourth position by a movement of the fourth projecting portion toward the upstream side in an insertion direction of the second cartridge, thereby allowing the third projecting portion to enter the first recess portion so as to allow the second cartridge to be removed from the first image forming apparatus main body.

48. The image forming system according to claim 39, wherein a third portion and an second recess portion disposed between the second portion and the third portion, and the second recess portion that allows the second projecting portion and the fourth projecting portion to enter there into.

49. The image forming system according to claim 39, wherein the first image forming apparatus main body includes a guide portion that guides the first cartridge and the second cartridge in the insertion direction from a position where the first projecting portion and the third projecting portion are present before the first recess portion acts on the first projecting portion and the third projecting portion to the attachment position of the first image forming apparatus main body.

50. The image forming system according to claim 39, further comprising:

a second image forming apparatus main body that has a fourth portion, a fifth portion, and a third recess portion disposed between the fourth portion and the fifth portion, wherein, during attachment of the second cartridge to the sixth image forming apparatus main body, the third recess portion causes the second movable member to be moved from the third position where the third projecting portion is allowed to enter the third recess portion to the fourth position by a movement of the third projecting portion toward the downstream side the insertion direction of the second cartridge in the third recess portion, thereby allowing the fourth projecting portion to pass through the downstream side of the fifth portion in the second movement direction so as to allow the second cartridge to be moved to the attachment position of the second image forming apparatus main body, and wherein, during attachment of the first cartridge to the second image forming apparatus main body, the third recess portion blocks a movement of the first projecting portion in the insertion direction of the first cartridge.

51. The image forming system according to claim 50, wherein a section of the third projecting portion in a plane determined by the insertion direction of the second cartridge and the second movement direction is less than a section of the first projecting portion in a plane determined by the insertion direction of the first cartridge and the first movement direction, and wherein, a length of an inside of the third recess portion perpendicular to the insertion direction of the first cartridge is less than that of the first recess portion perpendicular to the insertion direction of the first cartridge so as to allow the third projecting portion to enter the third recess portion and block entrance of the first projecting portion at the first position during attachment of the first cartridge to the second image forming apparatus main body.

52. The image forming system according to claim 50, wherein a third cartridge not operable with the second image forming apparatus main body, the third cartridge includes a third movable member that is movable in a third movement direction, and wherein a first inclined portion, which is brought into contact with the first projecting portion so as to cause the first movable member to be moved from the first position to the second position, a second inclined portion, which is inclined toward the downstream side in the third movement direction as the second inclined portion extends toward the downstream side in the insertion direction, and a second regulating portion, which blocks entrance of the third cartridge into the attachment position, are provided in this order from the upstream side in the insertion direction of the third cartridge for the third recess portion on a surface on the downstream side of the third recess portion in the third movement direction.

53. The image forming system according to claim 50, wherein a section of the first projecting portion in a plane determined by the insertion direction of the first cartridge and the first movement direction has a circular shape, a section of the third projecting portion in a plane determined by the insertion direction of the second cartridge and the second movement direction has a circular shape, and a diameter of the third projecting portion is less than that of the first projecting portion.

54. The image forming system according to claim 50, wherein a section of the first projecting portion in a plane determined by the insertion direction of the first cartridge and the first movement direction, and a section of the third projecting portion in a plane determined by the insertion direction of the second cartridge and the second movement direction, respectively have a non-circular shape that have a length in the insertion direction shorter than a length in the movement direction, and the section of the first projecting portion and the section of the third projecting portion have substantially identical length to the movement direction.

* * * * *